US008446395B2

(12) United States Patent
Song et al.

(10) Patent No.: US 8,446,395 B2
(45) Date of Patent: May 21, 2013

(54) LIQUID CRYSTAL DISPLAY AND DRIVING METHOD THEREOF

(75) Inventors: Hong Sung Song, Gyeongsangbuk-do (KR); Woong Ki Min, Daegu (KR); Byung Jin Choi, Gyeongsangbuk-do (KR); Dong Il Kim, Gyeonggi-do (KR); Su Hyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 236 days.

(21) Appl. No.: 13/051,406

(22) Filed: Mar. 18, 2011

(65) Prior Publication Data

US 2011/0169797 A1 Jul. 14, 2011

Related U.S. Application Data

(62) Division of application No. 12/003,585, filed on Dec. 28, 2007, now Pat. No. 7,932,884.

(30) Foreign Application Priority Data

| | | |
|---|---|---|
| Jan. 15, 2007 | (KR) | 10-2007-0004255 |
| Feb. 27, 2007 | (KR) | 10-2007-0019587 |
| Mar. 22, 2007 | (KR) | 10-2007-0028228 |
| Apr. 10, 2007 | (KR) | 10-2007-0035126 |
| Apr. 18, 2007 | (KR) | 10-2007-0037936 |

(51) Int. Cl.
*G09G 5/00* (2006.01)

(52) U.S. Cl.
USPC ..... 345/209; 345/54; 345/96

(58) Field of Classification Search
USPC ..... 345/50, 53, 54, 87, 94, 95, 96, 204, 345/209
See application file for complete search history.

(56) References Cited

U.S. PATENT DOCUMENTS

| | | | | |
|---|---|---|---|---|
| 7,403,185 | B2 | 7/2008 | Song et al. | |
| 7,764,258 | B2 | 7/2010 | Kitamura et al. | |
| 8,044,910 | B2 * | 10/2011 | Song et al. | 345/96 |
| 2002/0186193 | A1 | 12/2002 | Lee et al. | |
| 2003/0103026 | A1 * | 6/2003 | Yamakawa et al. | 345/87 |

(Continued)

FOREIGN PATENT DOCUMENTS

| | | | |
|---|---|---|---|
| JP | 2002-091403 | A | 3/2002 |
| JP | 2004-045741 | A | 2/2004 |
| JP | 2005-156661 | A | 6/2005 |
| JP | 2008-170994 | A | 7/2008 |

*Primary Examiner* — Dmitriy Bolotin

(74) *Attorney, Agent, or Firm* — Morgan, Lewis & Bockius LLP

(57) ABSTRACT

A liquid crystal display device includes a liquid crystal display panel including a plurality of data lines to which a data voltage is supplied, a plurality of gate lines to which a gate pulse is supplied, and a plurality of liquid crystal cells, a data drive circuit to invert a polarity of the data voltage in response to a polarity control signal and to output the data voltage to the data lines in response to a source output enable signal, a gate drive circuit to supply the gate pulse to the gate lines, and a POL/SOE logic circuit to invert the polarity control signal for every frame period except at Nth-multiple frame period (where N is a positive integer), wherein the POL/SOE logic circuit controls the polarity control signal at every Nth-multiple frame period such that the polarity of the data voltage is the same as the previous frame period and controls a pulse width of the source output enable signal at every Nth-multiple frame period to be longer than for the other frame periods.

12 Claims, 50 Drawing Sheets

U.S. PATENT DOCUMENTS

2004/0104873 A1 6/2004 Kang et al.
2004/0263466 A1 12/2004 Song et al.
2007/0152942 A1 7/2007 Yamagishi
2007/0242019 A1 10/2007 Jung et al.
2007/0296680 A1 12/2007 Lee et al.
2008/0001888 A1 1/2008 Lee
2008/0001893 A1 1/2008 Moon et al.
2008/0284704 A1* 11/2008 Song et al. ..... 345/94

* cited by examiner

Fig. 7

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| POL | + | − | + | − | + | − | + | + | − | + | − | + | − | + | − | − | + | − | + | − | + | − | + | + | − | + | − | + | − | + |

| Frame | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|
| POL | − | − | + | − | + | − | + | − | + | + | − | + | − | + | − | + | − | − |

LIQUID CRYSTAL DISPLAY AND DRIVING METHOD THEREOF

This application is a divisional application of U.S. patent application Ser. No. 12/003,585, filed Dec. 28, 2007 now U.S. Pat. No. 7,932,884, which claims the benefit of the Korean Patent Application Nos. P2007-0004255 filed Jan. 15, 2007, P2007-0019587 filed Feb. 27, 2007, P2007-0028228 filed Mar. 22, 2007, P2007-0035126 filed Apr. 10, 2007, and P2007-0037936 filed Apr. 18, 2007, all of which are hereby incorporated by reference.

BACKGROUND OF THE INVENTION

1. Field of the Invention

The present invention relates to a liquid crystal display device, and more particularly to a liquid crystal display device that is adaptive for increasing display quality by preventing flickers and DC image sticking, and a driving method thereof.

2. Discussion of the Related Art

A liquid crystal display device controls the light transmittance of liquid crystal cells in accordance with video signals, thereby displaying a picture. An active matrix type liquid crystal display device actively controls the displayed images by switching data voltages supplied to a thin film transistor TFT formed at each liquid crystal cell Clc, as shown in FIG. 1, thus increasing the display quality of motion pictures. As shown in FIG. 1, a reference numeral "Cst" represents a storage capacitor for keeping data voltages charged in the liquid crystal cell Clc. "DL" represents a data line to which the data voltages are supplied, and "GL" represents a gate line to which scan voltages are supplied to activate the thin film transistor TFT.

The liquid crystal display device is driven by an inversion method where polarities are inverted between adjacent liquid crystal cells and between successive frame periods, in order to reduce the deterioration of liquid crystals and to decrease DC offset components. If any one polarity between two polarities of the data voltage is dominantly supplied for a long time, a residual image is generated. Such a residual image, referred to as "DC image sticking," is created because a voltage of the same polarity is repeatedly charged in the liquid crystal cell.

An example of when DC image sticking occurs is when interlaced data voltages are supplied to the liquid crystal display device. An interlace method applies odd-numbered line data voltages to liquid crystal cells in odd-numbered horizontal lines during odd-numbered frame periods and even-numbered line data voltages to liquid crystal cells in even-numbered horizontal line during even-numbered frame periods.

FIG. 2 illustrates a waveform diagram representing an example of data voltages supplied to a liquid crystal cell Clc using an interlace method. The data voltages of FIG. 2 represent data voltages supplied to any one of the liquid crystal cells disposed on an odd-numbered horizontal line.

As shown in FIG. 2, using the interlace method, high data voltages (i.e., image data) are supplied to a liquid crystal cell Clc (not shown) disposed on an odd-numbered horizontal lines only during odd-numbered frame periods. In addition, because the polarity of the data voltages alternate every frame period, the liquid crystal cell Clc is supplied with high voltages that are positive only during odd-numbered frame periods and with low voltages (i.e., no image data) during even-numbered frame periods. Because of this, the positive data voltage, like the waveform shown in the box of FIG. 2, becomes more dominant than the negative data voltage over a four-frame period, for example, thus creating a DC image sticking phenomenon.

FIG. 3 shows exemplary images of an experimental result of a DC image sticking phenomenon generated due to interlace data. For example, if an original picture (e.g., left image of FIG. 3) is displayed on a liquid crystal display panel using the interlace method for a fixed period of time, a DC image sticking pattern of the original picture (e.g., right image of FIG. 3) dimly appears when a data voltage of an intermediate gray level (e.g., gray level of 127) is supplied to all of the liquid crystal cells Clc of the liquid crystal display panel after the original picture.

As another example of when the DC image sticking occurs is when an image is moved or scrolled at a fixed speed because the image data voltage of the same polarity is repeatedly accumulated in the liquid crystal cell Clc based on the scroll speed (or moving speed) and the size of a picture which is scrolled (or moved). FIG. 4 shows exemplary images of an experimental result of a DC image sticking phenomenon generated when moving an oblique line or character pattern at a fixed speed.

In a liquid crystal display device, the display quality of motion pictures is degraded not only because of the DC image sticking, but also because of a flicker phenomenon caused by a visual perception of difference in brightness. Accordingly, in order to improve the display quality of a liquid crystal display device, the DC image sticking phenomenon and the flicker phenomenon need to be prevented or minimized.

SUMMARY OF THE INVENTION

Accordingly, the present invention is directed to a liquid crystal device and a driving method thereof that substantially obviates one or more problems due to limitations and disadvantages of the related art.

An object of the present invention is to provide a liquid crystal device and a driving method thereof for improving display quality by preventing DC image sticking and flicker.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal display panel including a plurality of data lines to which a data voltage is supplied, a plurality of gate lines to which a gate pulse is supplied, and a plurality of liquid crystal cells, a data drive circuit to invert a polarity of the data voltage in response to a polarity control signal and to output the data voltage to the data lines in response to a source output enable signal, a gate drive circuit to supply the gate pulse to the gate lines, and a POL/SOE logic circuit to invert the polarity control signal for every frame period except at Nth-multiple frame period (where N is a positive integer), wherein the POL/SOE logic circuit controls the polarity control signal at every Nth-multiple frame period such that the polarity of the data voltage is the same as the previous frame period and controls a pulse width of the source output enable signal at every Nth-multiple frame period to be longer than for the other frame periods.

In another aspect, a liquid crystal display device includes a liquid crystal display panel including a plurality of data lines to which a data voltage is supplied, a plurality of gate lines to which a gate pulse is supplied, and a plurality of liquid crystal cells, an image analyzing circuit to detect any one of interlace data and scroll data in an input image, a data drive circuit to invert a polarity of the data voltage in response to a polarity control signal and to output the data voltage to the data lines in response to a source output enable signal, a gate drive circuit to supply the gate pulse to the gate lines, and a POL/SOE logic circuit to invert the polarity control signal for every frame period except at Nth-multiple frame period (where N is a positive integer), wherein the POL/SOE logic circuit controls the polarity control signal at every Nth-multiple frame period such that the polarity of the data voltage is the same as the previous frame period and controls a pulse width of the source output enable signal at every Nth-multiple frame period to be longer than for the other frame periods when the image analyzing circuit detects that the input image data is any one of the interlace data and the scroll data.

In yet another aspect, a liquid crystal display device includes liquid crystal display panel including a plurality of data lines, a plurality of gate lines, and a plurality of liquid crystal cells, a data drive circuit to invert a polarity of the data voltage in response to a polarity control signal and supplies the data voltage to the data lines in response to a source output enable signal, a gate drive circuit to supply a scan pulse to the gate lines, an image analyzing circuit to detect any one of interlace data and scroll data in an input image, a first controller to increase a data charge amount of the liquid crystal cell during an aging period, the aging period beginning from the time when power to drive the drive circuits is generated to a predetermined time thereafter, and to decrease the data charge amount of the liquid crystal cell at every Nth-multiple frame period (wherein N is a positive integer) using the source output enable signal when any one of the interlace data and the scroll data is detected by the image analyzing circuit during a normal drive period after the aging period, and a second controller to control the polarity of the data supplied to the liquid crystal cell at every Nth-multiple frame period to be the same as the previous frame period when any one of the interlace data and the scroll data is detected by the image analyzing circuit during the normal drive period, and to invert the polarity of the data supplied to the liquid crystal cell at all other frame periods using the polarity control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 7 is a diagram illustrating DC image sticking not generated in scroll data;

DETAILED DESCRIPTION OF THE EMBODIMENTS

Reference will now be made in detail to the embodiments of the present invention, examples of which are illustrated in the accompanying drawings.

Figure 1:
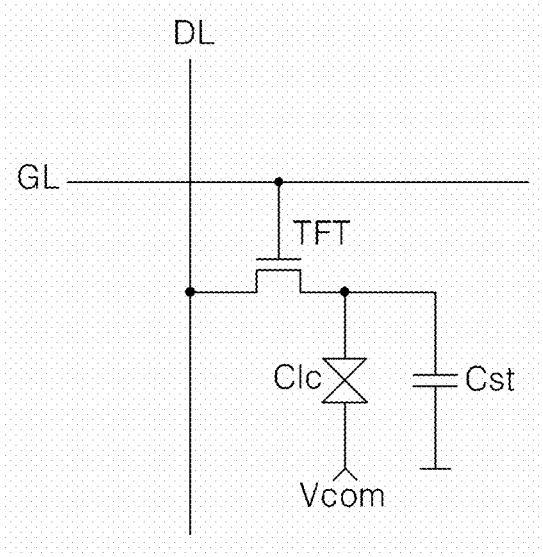
Fig. 1 [Related Art]
FIG. 1 is a circuit diagram showing a liquid crystal cell of a liquid crystal display device.
Figure 2:
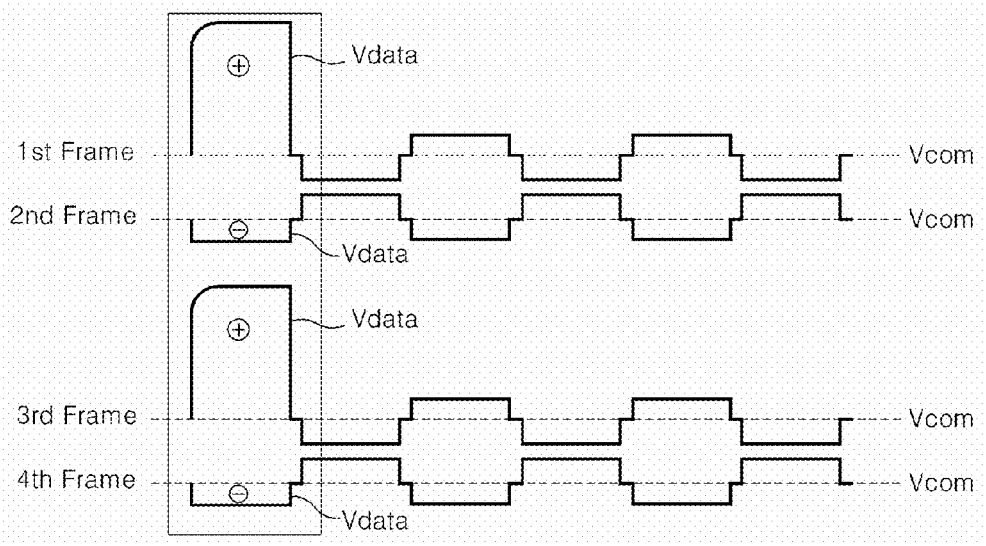
Fig. 2 [Related Art]
FIG. 2 is a waveform diagram showing an example of interlace data.
Figure 3:
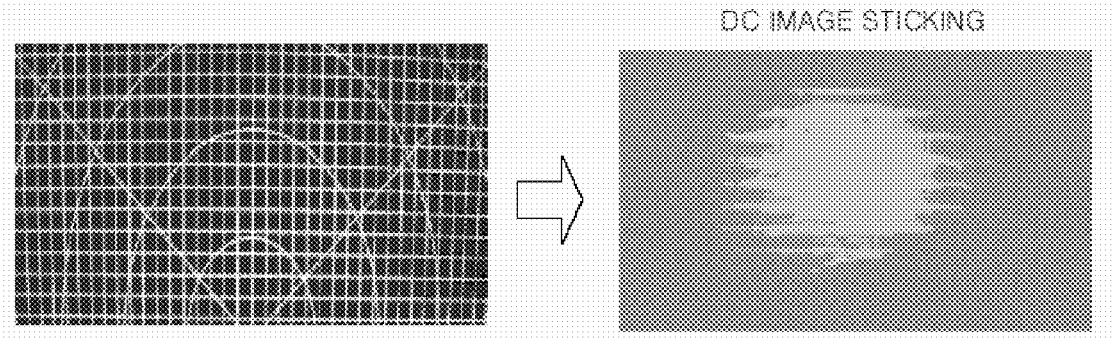
Fig. 3 [Related Art]
FIG. 3 is an experimental result screen showing DC image sticking caused by the interlace data.
Figure 4:
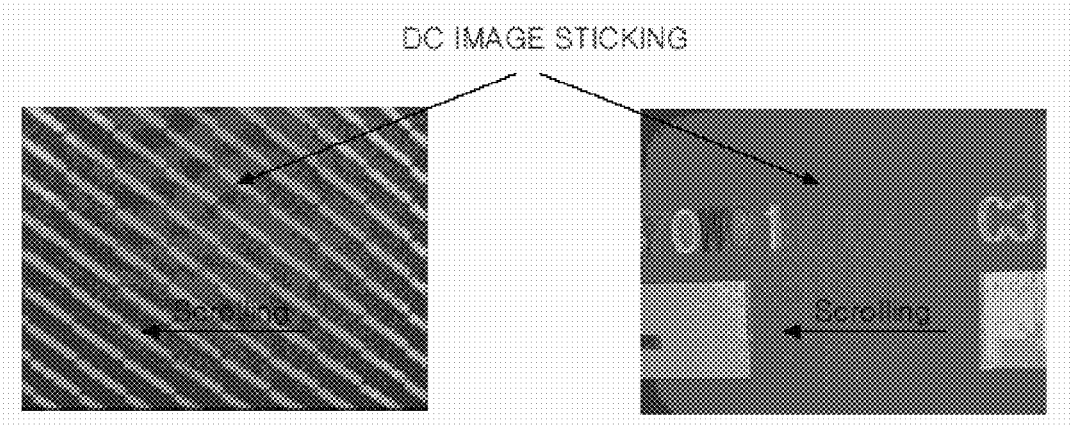
Fig. 4 [Related Art]
FIG. 4 is an experimental result screen showing DC image sticking caused by scroll data.
Figure 5:
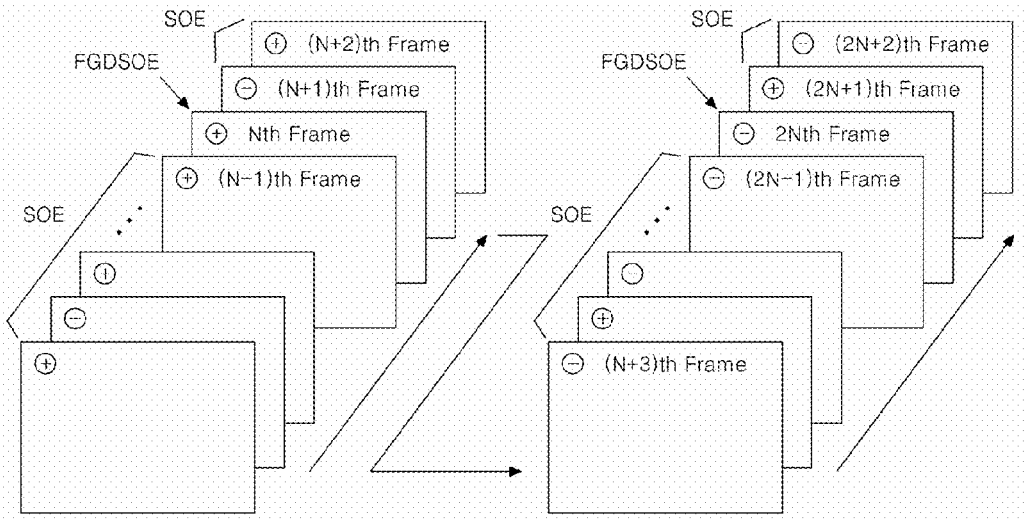
FIG. 5 is a diagram illustrating an exemplary driving method of a liquid crystal display device according to a first embodiment of the present invention.

As shown in FIG. 5, an exemplary method for driving a liquid crystal display device according to a first embodiment of the present invention inverts the polarity of a data voltage supplied to a liquid crystal cell Clc every frame period and then maintains the same polarity as the previous frame period at each Nth-multiple frame period.

'N' is preferably an integer of not less than 8 because it has been found experimentally that DC image sticking does not seem to appear either in interlace data or scroll data when N is an integer of not less than 8. However, other values of 'N' may be used without departing from the scope of the present invention.

Figure 6:
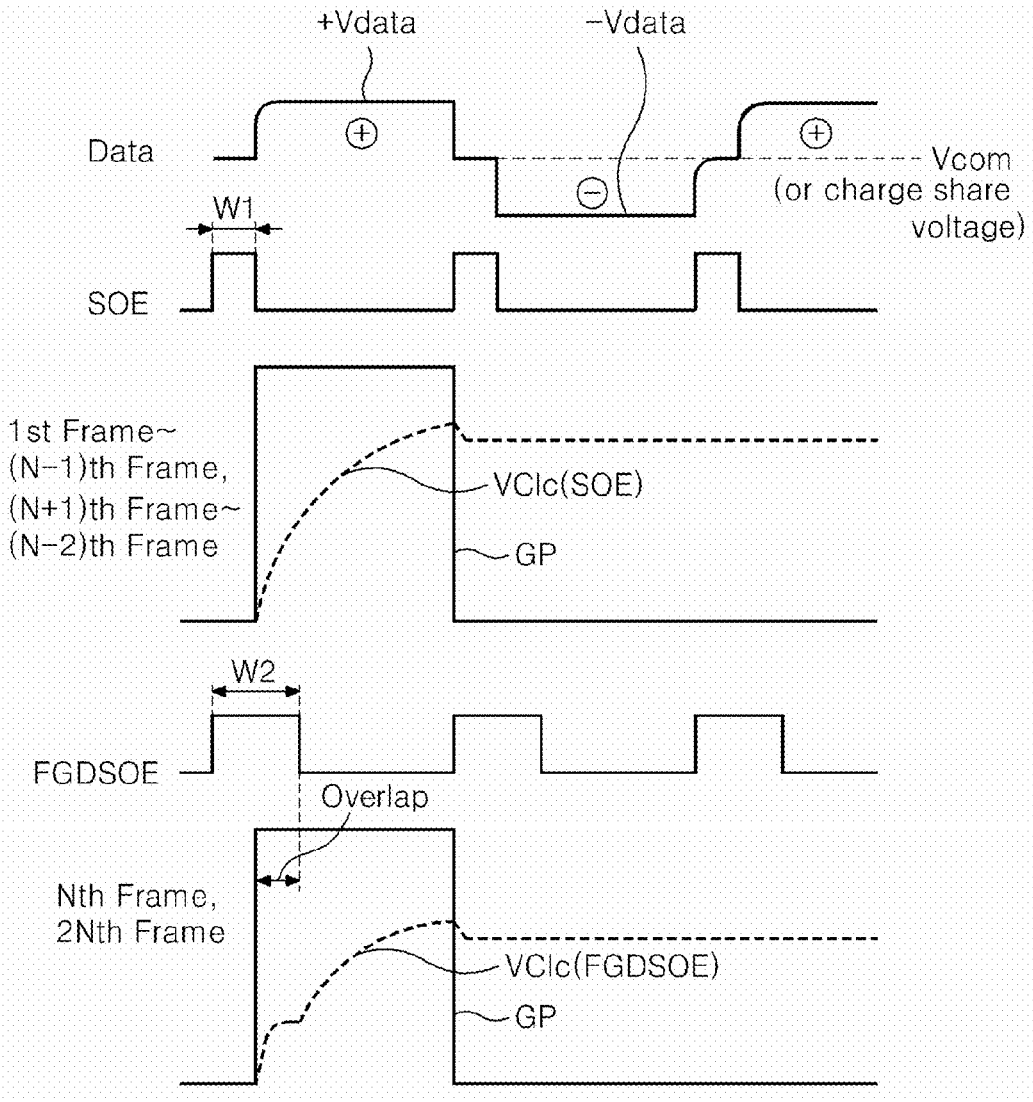
FIG. 6 is a waveform diagram illustrating source output enable signals shown in FIG. 5.

Furthermore, as shown in FIG. 6, the exemplary driving method according to the first embodiment of the present invention generates a first source output enable signal SOE having a first pulse width W1 during the first to (N−1)th frame periods, and a second source output enable signal FGDSOE having a second pulse width W2, which is wider than the first pulse width W1, at the Nth frame period. The first and second source output enable signals SOE, FGDSOE are a timing control signal which indicates the output of a data drive circuit. Subsequently, the exemplary driving method according to the first embodiment of the present invention generates the first source output enable signal SOE having the first pulse width W1 during (N+1)th to (2N−1)th frame periods, and the second source output enable signal FGDSOE having the second pulse width W2 during 2Nth frame period, and so on. In other words, the second source output enable signal FGDSOE having the second pulse width W2 is generated at every Nth-multiple frame period while the first source output enable signal SOE having the first pulse width W1 is generated at all other frame periods.

During a high logic section of the first and second source output enable signals SOE, FGDSOE, a data drive circuit generates a common voltage Vcom or a charge share voltage. The common voltage Vcom is an intermediate voltage between a positive data voltage and a negative data voltage. The charge share voltage is a voltage which is generated to be an average value of the positive data voltage and the negative data voltage by a short circuit between adjacent data lines, one of which the positive data voltage is supplied during the high logic section of the source output enable signal SOE and the other of which is disposed to be close thereto and to which the negative data voltage is supplied. During a low logic period of the first and second source output enable signal SOE, FGDSOE, the data drive circuit generates a positive data voltage +Vdata or a negative data voltage −Vdata.

During the first to (N−1)th frame periods and the (N+1)th to (2N−1)th frame periods, the high logic section of the first source output enable signal SOE and a gate pulse GP are generated not to overlap, or may overlap for a very short time. Accordingly, during the first to (N−1)th frame periods and the (N+1)th to (2N−1)th frame periods, a liquid crystal cell Clc is charged with the positive data voltage +Vdata or the negative data voltage −Vdata while a TFT connected to the liquid crystal cell Clc is turned on by the gate pulse GP. Thereafter, the data voltages +Vdata or −Vdata are maintained by a storage capacitor Cst after the TFT is turned off. The amount of voltage charged by the first source output enable signal SOE is indicated by the dotted line VClc (SOE).

However, for each of the Nth-multiple frame period (e.g., the Nth and 2Nth frame periods), the high logic section of the second source output enable signal FGDSOE and the gate pulse GP are generated to overlap for a relatively long time. Accordingly, at each Nth-multiple frame period (e.g., the Nth and 2Nth frame periods), the liquid crystal cell Clc is charged with the data voltages +Vdata and −Vdata after being charged with the common voltage Vcom or the charge share voltage while the TFT is turned on by the gate pulse GP. Subsequently, the liquid crystal cell Clc maintains the data voltages +Vdata and −Vdata by the storage capacitor Cst after the TFT is turned off. The amount of voltage charged by the second source output enable signal FGDSOE is indicated by the dotted line VClc (FGDSOE).

Therefore, when the liquid crystal cell Clc is supplied with the data voltages +Vdata and −Vdata of the same gray level at every frame period, the charge amount of the liquid crystal cell Clc at each Nth-multiple frame period (e.g., the Nth and 2Nth frame periods) will be less than the charge amount during the first to (N−1)th frame periods and the (N+1)th to (2N−1)th frame periods because at each Nth-multiple frame period, the liquid crystal cell Clc is charged with the data voltages +Vdata and −Vdata after being charged with the common voltage Vcom or the charge share voltage due to the overlapping of the second source output enable signal FGDSOE and the gate pulse GP.

For purposes of example, if the first pulse width W1 of the first source output enable signal SOE is set to '1,' then the second pulse width W2 of the second source output enable signal FGDSOE should be set to about 1.36-1.71. While these values were found to be the optimum second pulse width values through experimentation at which neither DC image sticking nor flicker was generated during interlace method and scrolling, other proportions between the first pulse width W1 and second pulse width W2 may be used without departing from the scope of the invention.

The experiment included taking 2.24 μs as the first pulse width W1 of the first source output enable signal SOE, driving a liquid crystal display panel by controlling the data voltage to have the same polarity as the previous frame for N frame periods, adjusting the second pulse width W2 of the second source output enable signal FGDSOE, and checking for the presence or absence of the DC image sticking and flicker during both of the interlace method and scrolling. Using this experiment, the second pulse width W2 of the second source output enable signal with which neither DC image sticking nor flicker was generated during both the interlace method and scrolling was confirmed to be about 3.04 μs-3.8 μs. It was found that if the second pulse width W2 of the second source output enable signal FGDSOE was narrower than 3.04 μs, the charge amount of the liquid crystal cell Clc was not decreased enough at the Nth frame period and 2Nth frame period. Thus, flicker was visually perceived on the screen. On the other hand, if the second pulse width W2 of the second source output enable signal FGDSOE was wider than 3.84 μs, the charge amount of the liquid crystal cell Clc was decreased too much at the Nth frame period and 2Nth frame period. Thus, flicker and reduction of brightness was visually perceived on the screen.

As described above, the principle of the exemplary driving method of the liquid crystal display device according to the first embodiment of the present invention is to prevent DC image sticking and flicker by inverting the polarity of the data voltage during each frame period except at every Nth-multiple frame period, and increasing the pulse width of the source output enable signal SOE at every Nth-multiple frame period, thereby decreasing the charge amount of the liquid crystal cell Clc.

Figure 8:
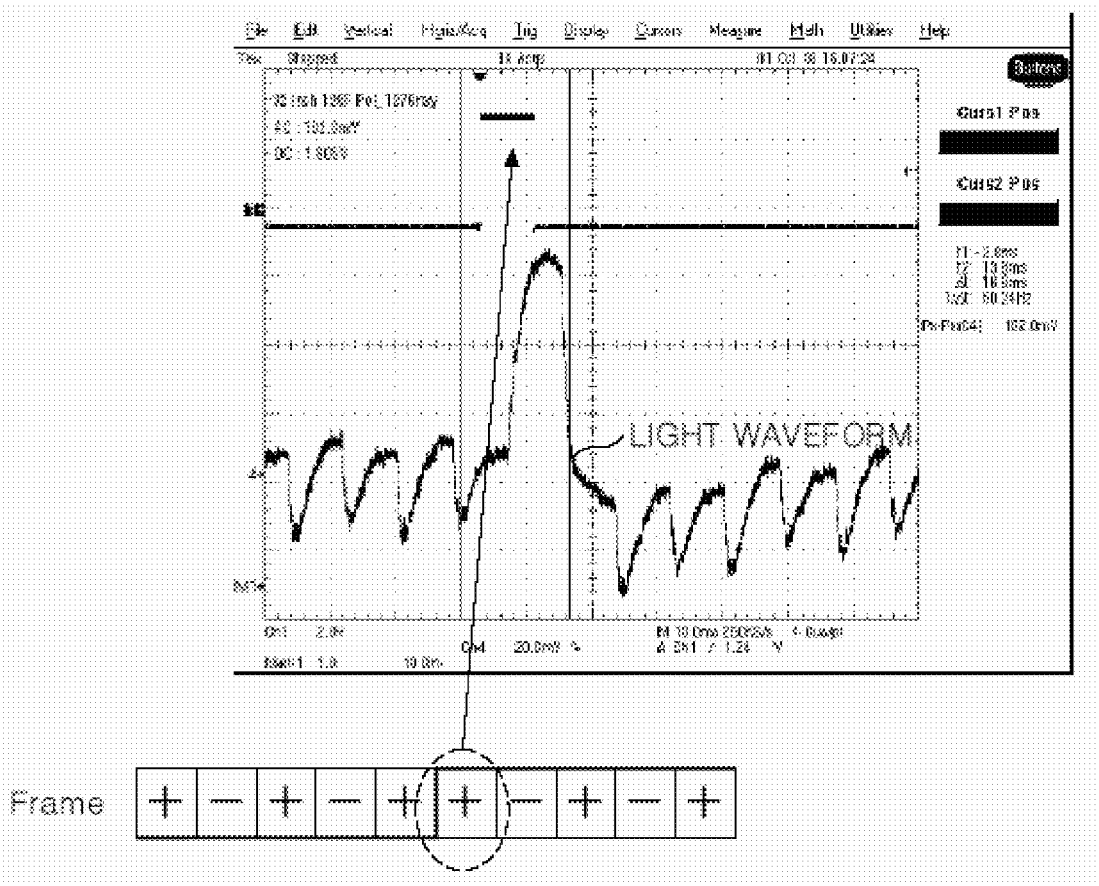
FIG. 8 is a waveform diagram illustrating an experimental result of increased light in Nth-multiple frame period.
Figure 9:
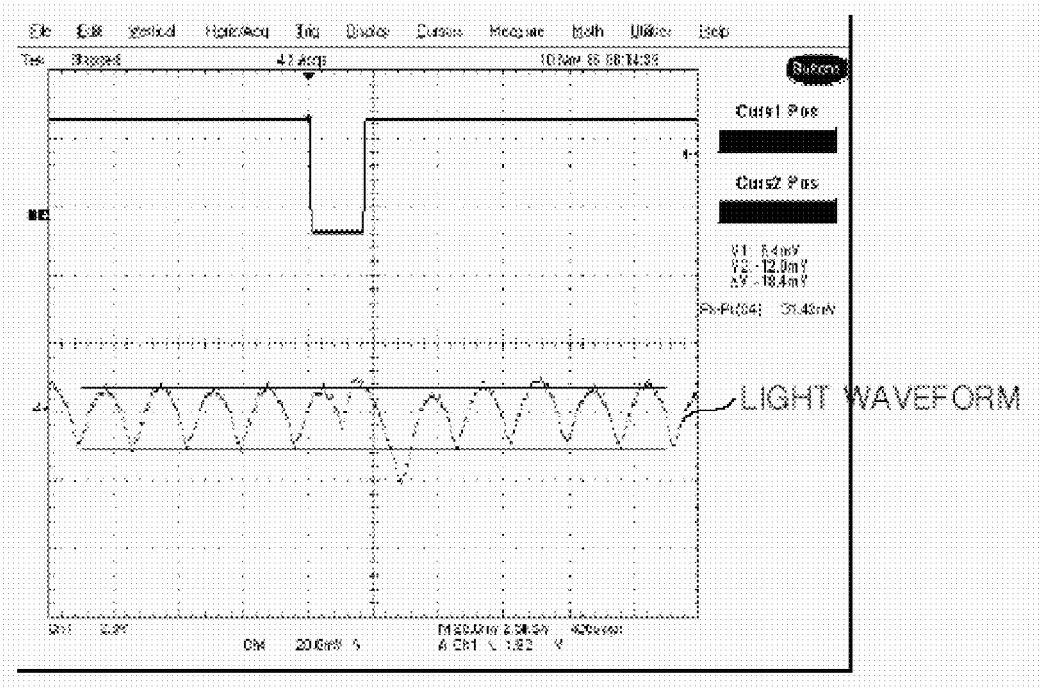
FIG. 9 is a waveform diagram illustrating an experimental result of decreased light in Nth-multiple frame period a second source enable signal.

FIGS. 7 to 9 are diagrams illustrating an explanation of DC image sticking and flicker prevention effects when scroll data are supplied to an arbitrary liquid crystal cell Clc. As shown in FIG. 7, if symbols and characters are moved at a speed of 8 pixels per frame, for example, and the data voltage is controlled with the same polarity as the previous frame by 8 frame period units (i.e., every 8th frame period) using a polarity control signal POL, then the arbitrary liquid crystal cell Clc is charged with the data voltage of the symbols and characters in the shaded frame periods shown in FIG. 7. Looking at the polarity pattern, then, the data voltages are changed in the order of "+" to "−−" to "++" to "−−" and so on. Accordingly, the present invention prevents the DC image sticking, which is generated because the polarity of the voltage charged in the liquid crystal cell Clc is periodically inverted in the scroll data, of which the symbols and characters are moved at a fixed speed.

As can be seen in a light waveform shown in FIG. 8, an output waveform of a photo diode disposed on top of a liquid crystal display panel shows that when the data voltage of the same polarity is repeated for two frame periods at each 8th frame period, the data voltage of the same polarity is accumulated in the liquid crystal cell, thereby increasing the accumulated voltage. Due to the accumulated voltage of the same polarity, the brightness of the liquid crystal cell Clc increases rapidly between the two frame periods in which the polarity stays the same. This occurs every 8th frame period as shown in FIG. 7, thereby creating a flickering effect. In order to prevent such a flicker phenomenon, the driving method of the liquid crystal display device according to an embodiment of the present invention reduces the charge amount of the liquid crystal cell Clc using the second source output enable signal FGDSOE at every Nth-multiple frame period when the polarity stays the same, thereby preventing a rapid change of the brightness. FIG. 9 shows a light waveform showing that a drastic change in brightness is prevented.

Figure 10:
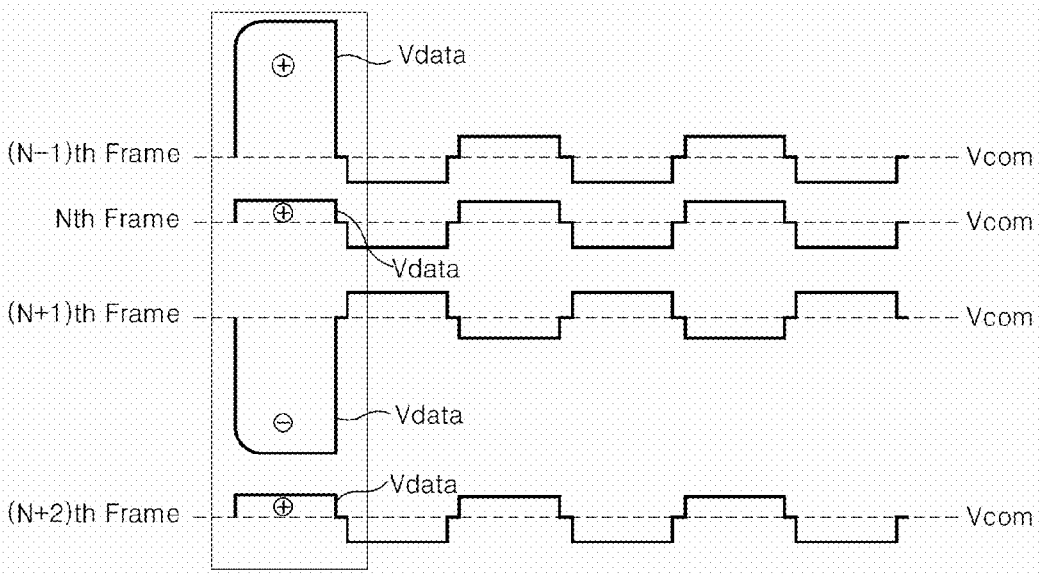
FIG. 10 is a diagram illustrating DC image sticking not generated in interlace data.

FIG. 10 is a diagram illustrating DC image sticking and flicker prevention effect when interlace data are supplied to an arbitrary liquid crystal cell Clc. As shown in FIG. 10, if interlace data are supplied to an arbitrary liquid crystal cell Clc, a high data voltage is supplied to the liquid crystal cell Clc only in the (N−1)th frame period and the (N+1)th frame period (i.e., odd-numbered frame periods) and a relatively low black voltage or an average voltage is supplied thereto in the Nth frame period and the (N+2)th frame period (i.e., even-numbered frame periods). As a result, the positive data voltage supplied in the (N−1)th frame period and the negative data voltage supplied in the (N+1)th frame period cancel each other so that a voltage charge of the biased polarity is not accumulated in the liquid crystal cell Clc. Accordingly, the liquid crystal display device according to the present invention does not generate the DC image sticking and flicker even when the interlace data are supplied thereto.

Figure 11:
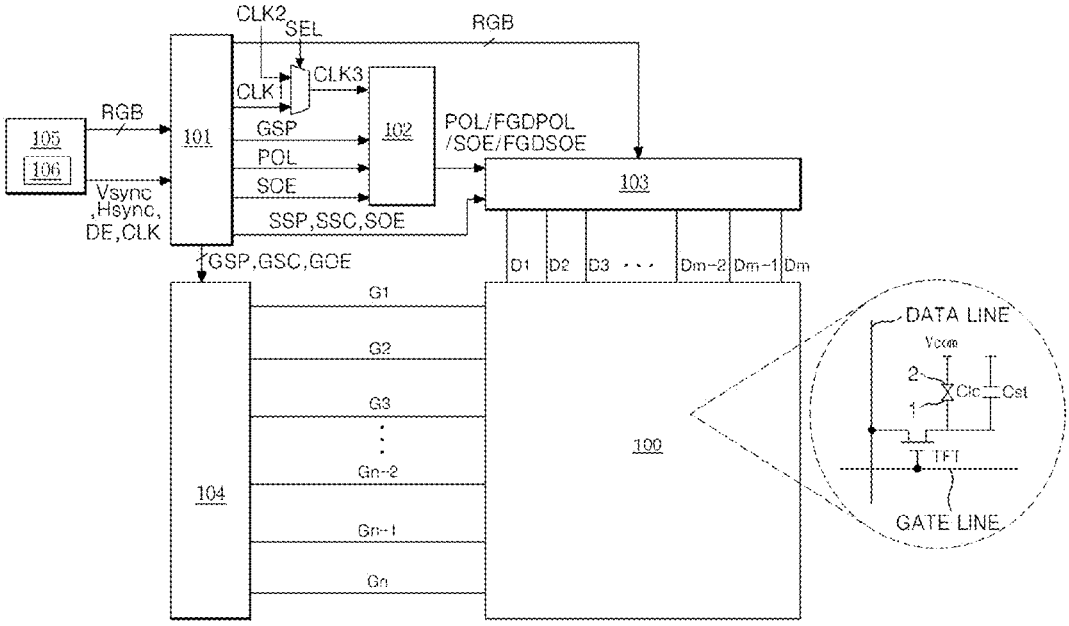
FIG. 11 is a block diagram illustrating an exemplary liquid crystal display device according to a first embodiment of the present invention.

FIGS. 11 to 15 illustrate an exemplary a liquid crystal display device according to a first embodiment of the present invention. As shown in FIG. 11, a liquid crystal display device according to a first embodiment of the present invention includes a liquid crystal display panel 100, a timing controller 101, a POL/SOE logic circuit 102, a data drive circuit 103, and a gate drive circuit 104.

In the liquid crystal display panel 100, liquid crystal molecules are injected between two glass substrates. The liquid crystal display panel 100 includes m×n number of liquid crystal cells Clc where m number of data lines D1 to Dm and n number of gate lines G1 to Gn are arranged in a matrix pattern crossing each other. On one glass substrate of the liquid crystal display panel 100, there are formed data lines D1 to Dm, gate lines G1 to Gn, TFT's, pixel electrodes 1 of the liquid crystal cells Clc connected to the TFTs, storage capacitors Cst, as well as other components. On the other glass substrate of the liquid crystal display panel 100, there are formed a black matrix, color filters, a common electrode 2, as well as other components.

In one alternative, the common electrode 2 is formed on a glass substrate opposing the pixel electrode 1 in a vertical electric field driving configuration such as a TN (Twisted Nematic) mode and a VA (Vertical Alignment) mode. In another alternative, the common electrode 2 is formed together with the pixel electrode 1 on the same glass substrate in a horizontal electric field driving configuration such as an IPS (In-Plane Switching) mode and an FFS (Fringe Field Switching) mode. The common electrode 2 is supplied with common voltage Vcom between the positive data voltage and the negative data voltage. Polarizers with optical axes perpendicularly crossing each other are formed on the upper glass substrate and the lower glass substrate of the liquid crystal display panel 100, and alignment films for setting the pre-tilt angle of the liquid crystals are formed on the internal surfaces thereof which face the liquid crystals.

The timing controller 101 receives timing signals such as vertical/horizontal synchronization signals Vsync, Hsync, data enable signals, clock signals, and other control signals to control the operation timing of the POL/SOE logic circuit 102, the gate drive circuit 104, and the data drive circuit 102. The control signals include a gate start pulse GSP, a gate shift clock signal GSC, a gate output enable GOE, a source start pulse SSP, a source sampling clock SSC, a source output enable signal SOE, and a first polarity control signal POL. The gate start pulse GSP indicates a start horizontal line from which a scan starts among a first vertical period when a screen is to be displayed. The gate shift clock signal GSC is input to a shift register within the gate drive circuit and has a pulse that corresponds to the on-period of the TFT as a timing control signal for sequentially shifting the gate start pulse GSP. The gate output signal GOE indicates the output of the gate drive circuit 104. The source start pulse SSP is a data control signal DDC and indicates a start pixel in a first horizontal line where data are to be displayed. The source sampling clock SSC indicates a latch operation of the data within the data drive circuit 103 on the basis of a rising or falling edge. The source output enable signal SOE indicates the output of the data drive circuit 103. The first polarity control signal POL indicates the polarity of the data voltages which are to be supplied to the liquid crystal cells Clc of the liquid crystal display panel 100. The first polarity control signal POL may be generated as any type of 1-dot inversion polarity control signal of which the logic is inverted for each horizontal period and 2-dot inversion polarity control signal of which the logic is inverted for each two horizontal periods.

The timing controller 101 generates timing control signals at a frame frequency of 120 Hz or 60 Hz to control the operation timing of the POL/SOE logic circuit 102, the data drive circuit 103, and the gate drive circuit 104 on the basis of 120 Hz or 60 Hz. The frame frequency is a frequency corresponding to the vertical synchronization signal Vsync and indicates the number of screens per second. The 120 Hz frame frequency generates 120 screens per second displayed on the liquid crystal display panel 100, and 60 Hz frame frequency generates 60 screens per second displayed on the liquid crystal display panel 100. The flicker is less noticeable when the liquid crystal display device is driven at the 120 Hz frame frequency in comparison with the 60 Hz frame frequency.

Figure 16:
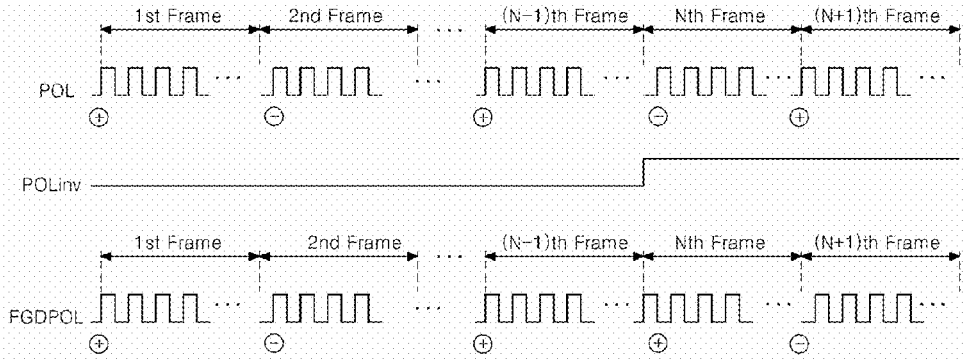
FIG. 16 is a waveform diagram illustrating an exemplary POL inversion signal and first and second polarity control signals shown in FIG. 15.

The POL/SOE logic circuit 102 receives the gate start pulse GSP and the first polarity control signal POL and, in order to prevent the residual image and flicker as described above, generates the second polarity control signal FGDPOL in the frame period of a multiple of N (i.e., in the Nth, 2Nth frame periods, and so on) to selectively supply either the first polarity control signal POL or the second polarity control signal FGDPOL to the data drive circuit 103. The first polarity control signal POL has its logic inverted for each horizontal period (i.e., 1-dot) or for each two horizontal periods (i.e., 2-dot), and the logic is also inverted for each frame period in order to invert the polarity of the data voltage for each frame period, as shown in FIG. 16. At each Nth-multiple frame period, the second polarity control signal FGDPOL is generated in the same phase as in the previous frame period and has its logic inverted for each horizontal period or for each two horizontal periods in order to control the polarity of the data voltage in the same polarity pattern as in the previous frame period, as shown in FIG. 16.

The POL/SOE logic circuit 102 also receives a first source output enable signal SOE and a third clock signal CLK3 so that the POL/SOE logic circuit 102 generates the second source output enable signal FGDSOE adjusted to have a wider pulse signal at every Nth-multiple frame period. The POL/SOE logic circuit 102 selectively either the first source output enable signal SOE or the second source output enable signal FGDSOE to the data drive circuit 103. The first source output enable signal SOE is generated to have a first pulse width W1. The second source output enable signal FGDSOE is generated to have a second pulse width W2, which is wider than the first pulse width W1. The second source output enable signal FGDSOE is supplied to the data drive circuit 103 at every Nth-multiple frame period, and the first source output enable signal SOE is supplied at all other frame periods.

The exemplary liquid crystal display device according to the first embodiment of the present invention further includes a multiplexer which is connected between the timing controller 101 and the POL/SOE logic circuit 102 to supply the third clock signal CLK3. The multiplexer chooses from a first clock signal CLK1, which is generated from an internal oscillator of the timing controller, or a second clock signal CLK2, which is supplied from an external oscillator, in accordance with a control signal SEL supplied to its own control terminal. Based on the control signal SEL, the multiplexer supplies the selected clock signal CLK1 or CLK2 as the third clock signal CLK3 to the POL/SOE logic circuit 102. The control terminal of the multiplexer is connected to an option pin. The option pin is connected to the control terminal of the multiplexer and might be selectively connected to a ground voltage source GND or a power supply voltage Vcc by the manufacturer. For example, if the option pin is connected to the ground voltage source GND, the multiplexer has the control terminal supplied with a selection control signal SEL of "0" to output the first clock signal CLK1 as the third clock signal CLK3, and if the option pin is connected to the power supply voltage Vcc, the multiplexer has the control terminal supplied with the selection control signal SEL of "1" to output the second clock signal CLK2 as the third clock signal CLK3.

The data drive circuit 103 latches the digital video data RGB under control of the timing controller 101. The data drive circuit 103 converts the digital video data into an analog positive/negative gamma compensation voltage in accordance with the polarity control signal POL/FGDPOL to generate a positive/negative analog data voltage, thereby supplying the data voltage to the data lines D1 to Dm.

The gate drive circuit 104 is composed of a plurality of gate drive integrated circuits (hereinafter, referred to as "IC") of which each includes a shift register, a level shifter for converting the swing width of the output signal of the shift register into a swing width that is suitable for driving the TFT of the liquid crystal cell, and an output buffer connected between the level shifter and the gate line G1 to Gn. The gate drive circuit 104 sequentially outputs gate pulses which have a pulse width of about one horizontal period. The POL/SOE logic circuit 102 may be embedded within the timing controller 101.

The exemplary liquid crystal display device according to the first embodiment of the present invention further includes a video signal source 105 for supplying the digital video data RGB and the timing signals Vsync, Hsync, DE, CLK to the timing controller 101. The video signal source 105 includes a broadcasting signal, an external device interface circuit, a graphic processing circuit, a line memory 106 and the like. The video signal source 105 extracts the video data from an external device or a broadcasting signal and converts the video data into the digital data to supply to the timing controller 101. An interlaced broadcasting signal received by the video signal source 105 is stored in the line memory 106 before being output. As described above, the video data of an interlaced broadcasting signal exist only in the odd-numbered lines in the odd-numbered frame period and only in even-numbered lines in the even-numbered frame. Accordingly, if the interlaced broadcasting signal is received, the video signal source 105 generates a black data value or an average value of the effective data stored in the line memory 106 as the even-numbered line data in the odd-numbered frame period and as the odd-numbered line data in the even-numbered frame.

The video signal source 105 supplies the timing signals Vsync, Hsync, DE, CLK together with the digital video data to the timing controller 101. Further, the video signal source 105 supplies power to circuits such as the timing controller 101, the POL/SOE logic circuit 102, the data drive circuit 103, the gate drive circuit 104, a DC-DC converter for generating a drive voltage of the liquid crystal display panel, an inverter for lighting the light source of a backlight unit, and the like.

Figure 12:
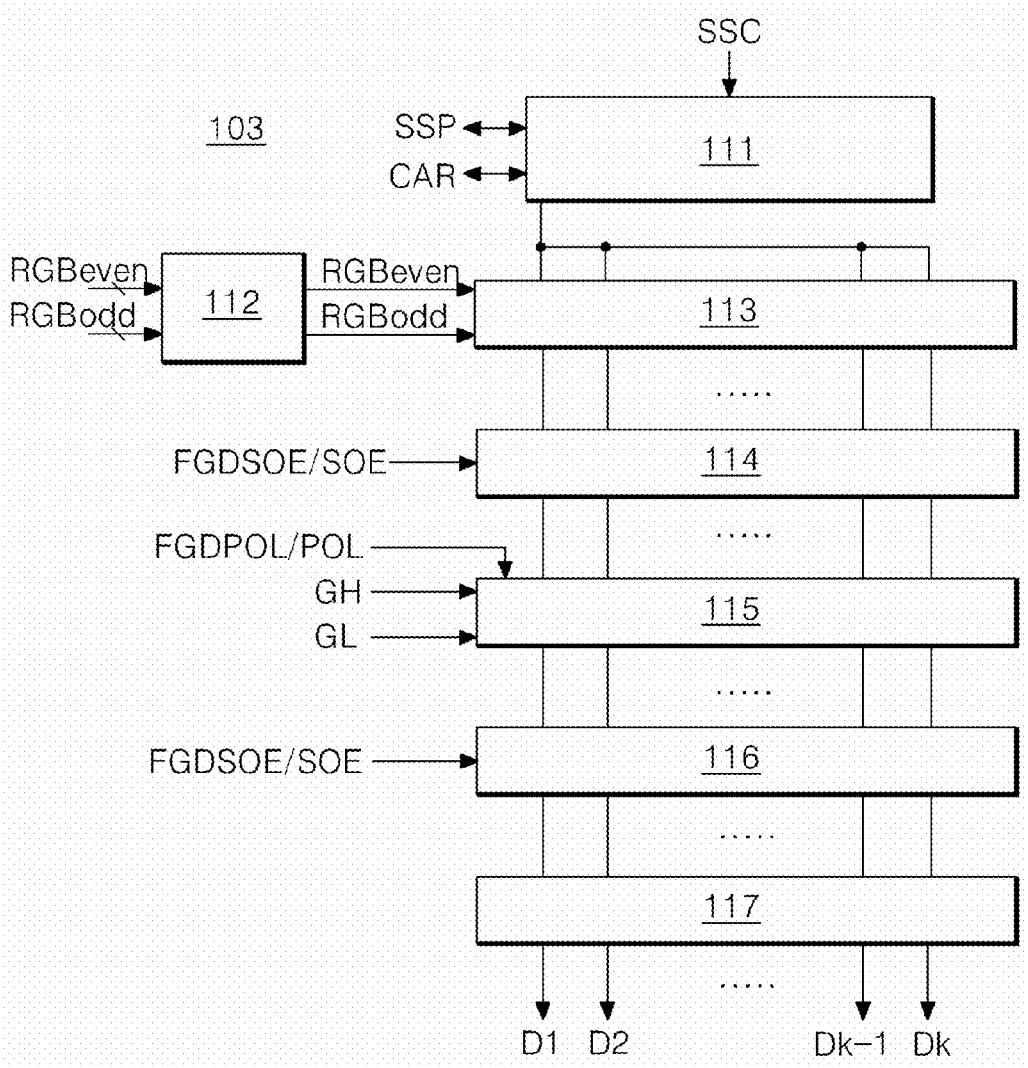
FIG. 12 is a block diagram illustrating an exemplary data drive circuit shown in FIG. 11.
Figure 13:
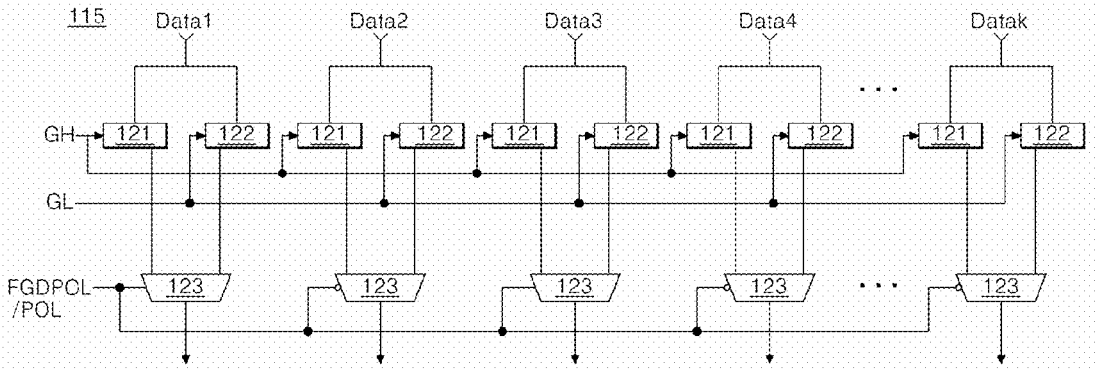
FIG. 13 is a circuit diagram illustrating an exemplary digital/analog converter shown in FIG. 12.

FIGS. 12 and 13 are circuit diagrams representing an exemplary data drive circuit 103 in detail. Referring to FIGS. 12 and 13, the data drive circuit 103 includes a plurality of source IC's of which each drives k (k is an integer less than m) number of data lines D1 to Dk. The source IC includes a shift register 111, a data register 112, a first latch 113, a second latch 114, a digital/analog converter (hereinafter, referred to as "DAC") 115, a charge share circuit 116, and an output circuit 117.

The shift register 111 shifts the source start pulse SSP from the timing controller 101 in accordance with the source sampling clock SSC to generate a sampling signal. Further, the shift register 111 shifts the source start pulse SSP to transmit a carry signal CAR to the shift register 111 of the next stage. The data register 112 temporarily stores the digital video data RGBodd of odd-numbered pixels and the digital video data RGBeven of even-numbered pixels divided by the timing controller 101 and supplies the stored digital video data RGBodd, RGBeven to the first latch 113. The first latch 113 samples the digital video data RGBodd, RGBeven from the data register 112 in response to the sampling signal sequentially input from the shift register 111, latches the digital video data RGBodd, RGBeven, and outputs them. The second latch 114 latches the latched data input from the first latch 113 and outputs the digital video data simultaneously with the other second latches 114 of other ICs during the low logic period of the source output enable signal SOE, FGDSOE.

As shown in FIG. 13, the DAC 115 of FIG. 12 includes a P-decoder PDEC 121 to which a positive gamma reference voltage GH is supplied, an N-decoder NDEC 122 to which a negative gamma reference voltage GL is supplied, and a multiplexer 123 to select either the output of the P-decoder 121 or the output of the N-decoder 122 in response to the polarity control signals FGDPOL, POL. The P-decoder 121 decodes the digital video data input from the second latch 114 and outputs a positive gamma compensation voltage corresponding to the gray level value of the data. The N-decoder 122 decodes the digital video data input from the second latch 114 and outputs a negative gamma compensation voltage corresponding to the gray level value of the data. The multiplexer 123 selects between the positive gamma compensation voltage and the negative gamma compensation voltage in response to the polarity control signal FGDPOL, POL, and outputs the selected positive/negative gamma compensation voltage as an analog data voltage.

The charge share circuit 116 shorts adjacent data output channels during the high logic period of the source output enable signal SOE, FGDSOE to output the average value of the data voltages in adjacent data output channels as a charge share voltage. Alternatively, the charge share circuit 116 supplies the common voltage Vcom to the data output channels during the high logic period of the source output enable signal SOE, FGDSOE. As explained above, the charge share circuit 116 generates either the charge share voltage or the common voltage to thereby reduce a rapid change of the positive data voltage and the negative data voltage. The output circuit 117 includes a buffer to minimize signal attenuation of the analog data voltages supplied to the data lines D1 to Dk.

Figure 14:
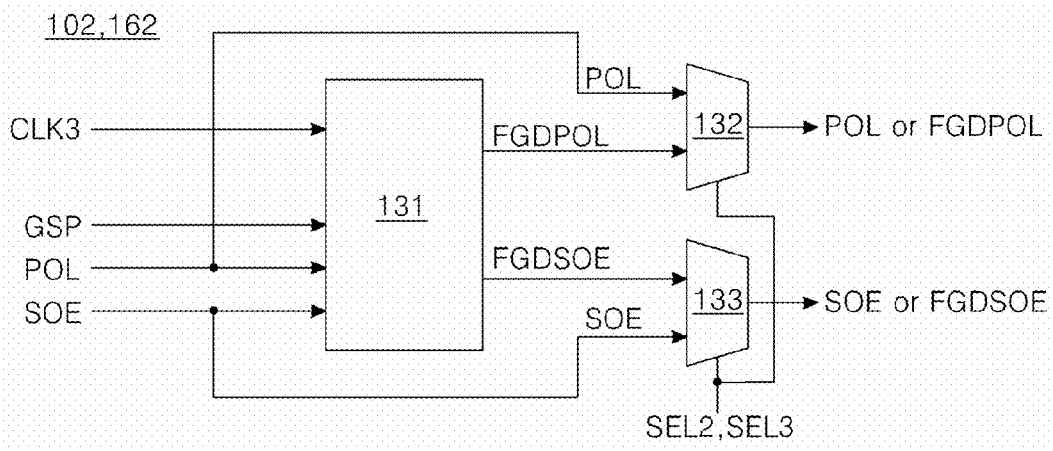
FIG. 14 is a block diagram illustrating an exemplary POL/SOE logic circuit shown in FIG. 11.
Figure 15:
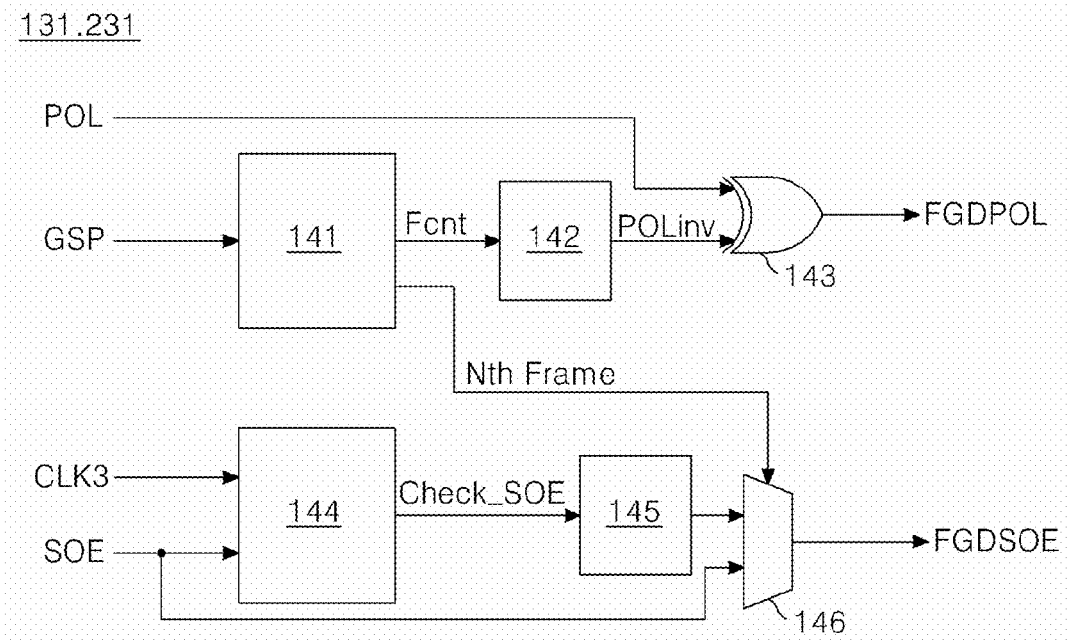
FIG. 15 is a block diagram illustrating an exemplary logic part shown in FIG. 14.

FIGS. 14 and 15 are circuit diagrams representing an exemplary POL/SOE logic circuit 102 in detail. As shown in FIG. 14, the POL/SOE logic circuit 102 includes a logic part 131, a first multiplexer 132, and a second multiplexer 133. The logic part 131 receives the gate start pulse GSP, the first polarity control signal POL, the first source output enable signal SOE, and the clock signal CLK3 from the timing controller 101, and generates the second polarity control signal FGDPOL and the second source output enable signal FGDSOE at every Nth-multiple frame period.

The first multiplexer 132 selects between the first polarity control signal POL and the second polarity control signal FGDPOL in accordance with the logic value of the control signal (SEL2 or SEL3, to be described below) applied to its control terminal. The second multiplexer 133 selects between the first source output enable signal SOE and the second output enable signal FGDSOE in accordance with the logic value of the control signal applied to its own control terminal.

The control terminal of the first and second multiplexers 132, 133 is connected to an option pin. The option pin is connected to the control terminals of the first and second multiplexers 132, 133 and may be selectively connected to a ground voltage source GND or a power supply voltage Vcc by a manufacturer. For example, if the option pin is connected to the ground voltage source GND, the first multiplexer 132 has the control terminal supplied with a selection control signal SEL2 of "0" to output the second polarity control signal FGDPOL, and the second multiplexer 133 has the control terminal supplied with the selection control signal SEL2 of "0" to output the second source output enable signal FGDSOE. If the option pin is connected to the power supply voltage Vcc, the first multiplexer 132 has the control terminal supplied with a selection control signal SEL2 of "1" to output the first polarity control signal POL, and the second multiplexer 133 has the control terminal supplied with the selection control signal SEL2 of "1" to output the first source output enable signal SOE.

As shown in FIGS. 15 and 16, the logic part 131 includes a frame counter 141, a POL inverter 142, an exclusive OR gate (hereinafter, referred to as "XOR") 143, a SOE timing analyzer 144, a SOE adjuster 145, and a third multiplexer 146.

The frame counter 141 outputs a frame count information Fcnt, which indicates the number of frames of a picture that is to be displayed on the liquid crystal display panel 100, in response to the gate start pulse GSP, which is generated one time during one frame period and which is generated at the same time as the start of the frame period. Further, the frame counter 141 generates the value of "N" to indicate the multiple of the N frame period at which the second polarity control signal FGDPOL and the second source output enable signal FGDSOE are to be generated.

The POL inverter 142 receives the frame count information Fcnt from the frame counter 141 and performs a modulus division on the frame count information Fcnt with N, thereby generating an inverted output signal when the remainder from the operation results in a "0". The output signal is a POL inversion signal POLinv. Therefore, as shown in FIG. 16, the logic (i.e., high or low logic) of the output signal POLinv is maintained for (N−1) number of frame periods and the logic of the output signal POLinv inverts when the frame period is a multiple of N. Accordingly, the POL inversion signal POLinv output from the POL inverter 142 indicates a start time for each Nth-multiple frame period. XOR 143 performs exclusive OR operation on the first polarity control signal POL and the POL inversion signal POLinv to generate the second polarity control signal FGDPOL in order to keep the polarity pattern the same in the Nth frame as the polarity pattern in the previous frame period (e.g., (N−1) frame period).

The SOE timing analyzer 144 analyzes the first source output enable signal SOE by the unit of the clock signal CLK3 and detects a rising edge, a pulse width, and a falling edge of the first source output enable signal SOE. The SOE adjuster 145 generates the second source output enable signal FGDSOE having the second pulse width W2 at every Nth-multiple frame period by using an SOE information Check_SOE from the SOE timing analyzer 144. The third multiplexer 146 selects the output of the SOE adjuster 145 at every Nth-multiple frame period, and for all other frame periods, the third multiplexer 146 selects the first source output enable signal SOE in accordance with the N frame information from the frame counter 141, thereby generating the second source output enable signal FGDSOE.

Figure 17:
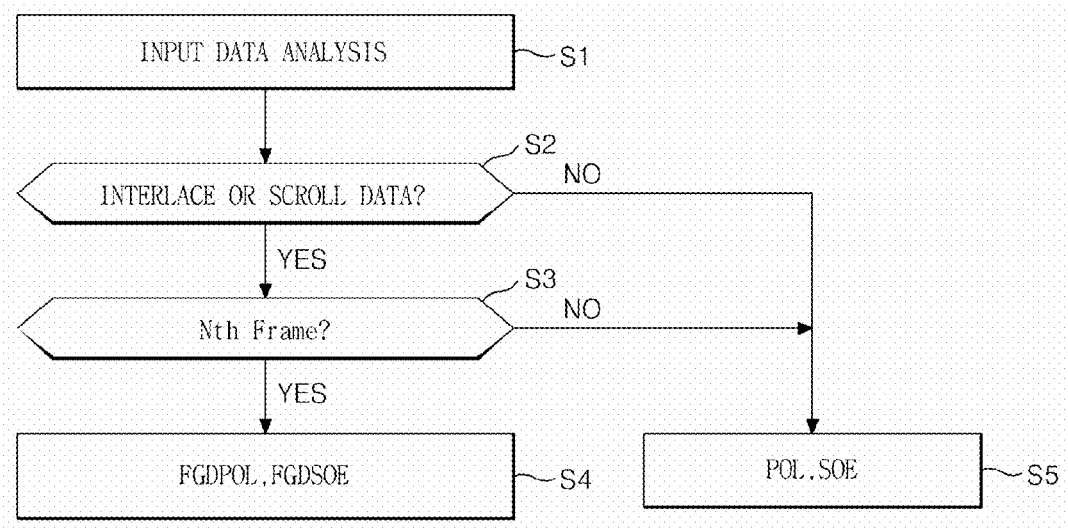
FIG. 17 is a flow chart illustrating an exemplary driving method of a liquid crystal display device according to a second embodiment of the present invention.

FIG. 17 is a flow chart illustrating an exemplary driving method of a liquid crystal display device according to a second embodiment of the present invention. As shown in FIG. 17, the exemplary driving method of the liquid crystal display device according to the second embodiment of the present invention includes an analysis of the input data to judge whether the input data is data with which the DC image sticking may likely occur (e.g., the input data is interlace data or the scroll data). (S1, S2) If the input data is determined not to likely cause DC image sticking, then the liquid crystal display device is configured to operate normally using the polarity signal POL and source output signal SOE. (S5)

However, if the currently input data is determined to likely cause DC image sticking (S2), a judgment is made as to whether the current frame is a multiple of N. (S3) If the current frame is an Nth-multiple frame period, the polarity of the data voltage to be displayed on the liquid crystal display panel is controlled using of the second polarity control signal FGDPOL and the second source output enable signal FGDSOE. (S4)

Figure 18:
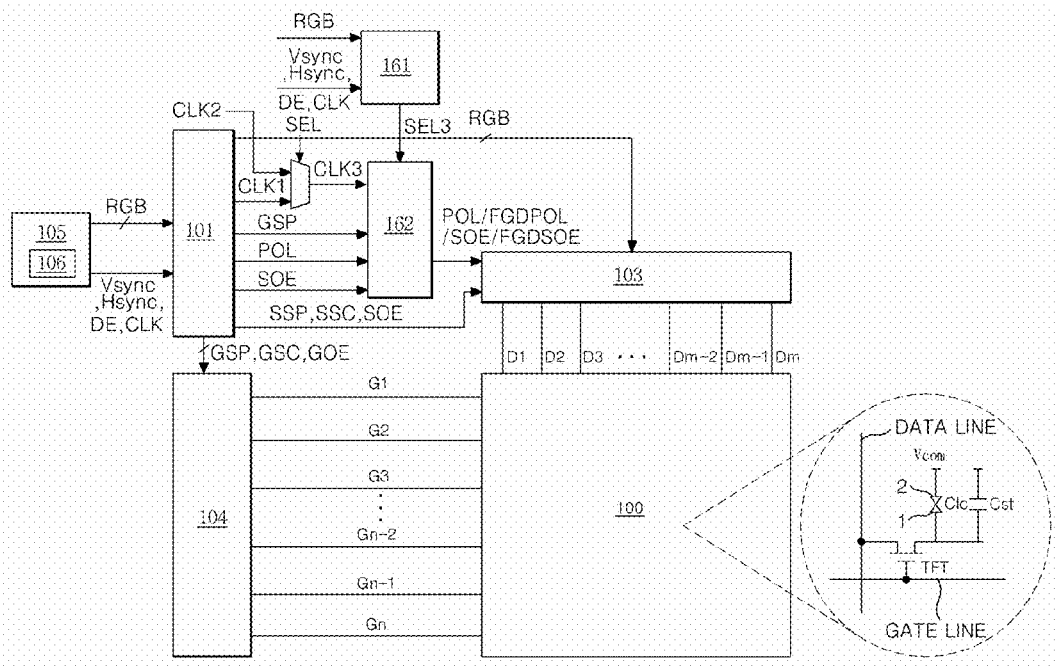
FIG. 18 is a block diagram illustrating an exemplary liquid crystal display device according to the second embodiment of the present invention.

FIG. 18 illustrates an exemplary liquid crystal display device according to the second embodiment of the present invention. As shown in FIG. 18, the liquid crystal display device according to the second embodiment of the present invention include a video signal source 105, a liquid crystal display panel 100, an imaging analyzing circuit 161, a timing controller 101, a POL/SOE logic circuit 162, a data drive circuit 103, and a gate drive circuit 104. In this embodiment, the video signal source 105, the liquid crystal display panel 100, the timing controller 101, the data drive circuit 103, and the gate drive circuit 104 are equivalent to the foregoing description of the first embodiment. Thus, the same reference numerals are given to the same components and a detail description thereof will be omitted.

The image analyzing circuit 161 judges whether the digital video data of the currently input image is data with which the DC image sticking will likely occur. For example, the image analyzing circuit 161 compares the data between adjacent lines in one frame image and determines whether the currently input data is interlace data. The currently input data is deemed to be interlace data if the data between the lines is not less than a predetermined threshold value. In addition, the image analyzing circuit 161 compares the data of each pixel in a frame with another frame to detect a moving picture in a display image and the speed of the moving picture. If the moving picture moves at a pre-set speed, the frame data having the moving picture is deemed to be scroll data. Based on the result of the image analysis, the image analyzing circuit 161 generates a selection signal SEL3 which indicates that the currently input data is either interlace data or scroll data. The selection signal SEL3 is then used to control the POL/SOE logic circuit 162.

The POL/SOE logic circuit 162 generates the second polarity control signal FGDPOL and the second source output enable signal FGDSOE in the Nth-multiple frame period in response to the first logic value of the selection signal SEL3 generated by the image analyzing circuit 161 when the input data likely to cause DC image sticking is detected. Otherwise, the POL/SOE logic circuit 162 generates the first polarity control signal POL and the first source output enable signal SOE in response to the second logic value of the selection signal SEL3 from the image analyzing circuit 161. The timing controller 101, the image analyzing circuit 161, and the POL/SOE logic circuit 162 may be integrated into one chip.

Figure 19:
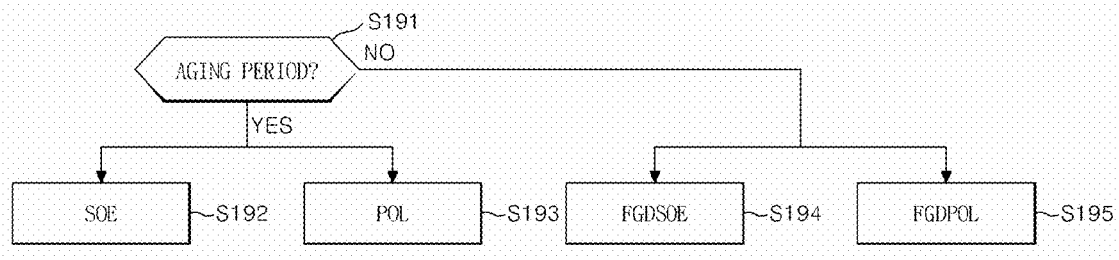
FIG. 19 is a flow chart illustrating an exemplary driving method of a liquid crystal display device according to a third embodiment of the present invention.
Figure 20:
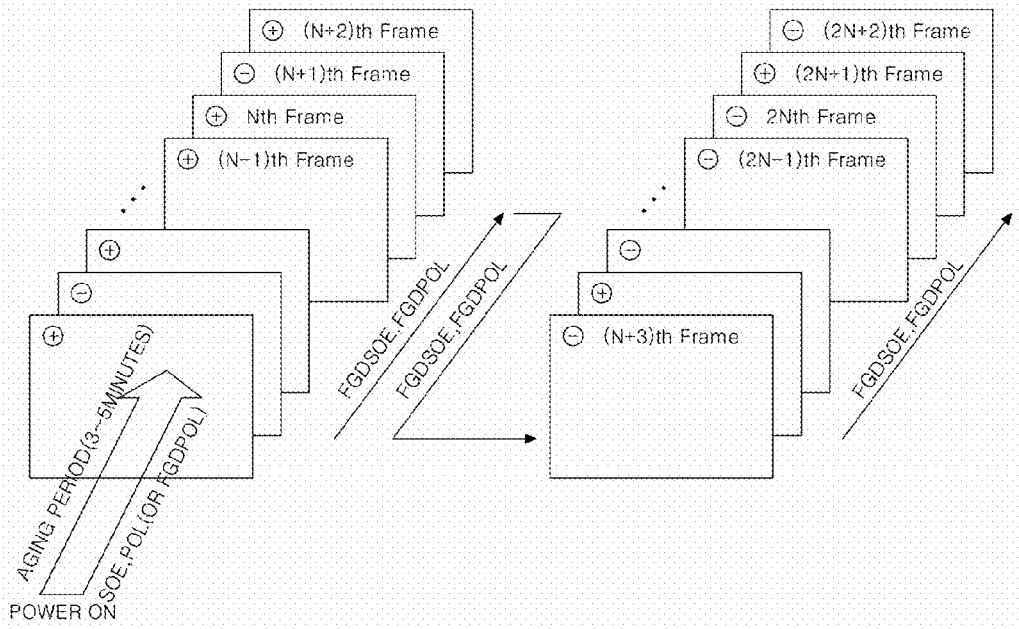
FIG. 20 is an exemplary frame configuration diagram illustrating the exemplary driving method of the liquid crystal display device according to the third embodiment of the present invention.

FIGS. 19 and 20 represent an exemplary driving method of a liquid crystal display device according to a third embodiment of the present invention. As shown in FIGS. 19 and 20, in addition to controlling the generation of the second source output enable signal FGDSOE and the second polarity control signal FGDPOL, the exemplary driving method of the liquid crystal display device according to the third embodiment of the present invention increases the charge amount of the liquid crystal cell by controlling pulse width of the source output enable signal during an aging period and inverts the polarity of the data voltage charged in the liquid crystal cell for each frame period. The "aging period" is a period when the response characteristic of the liquid crystal cell does not reach a satisfactory level and is defined to be a period between when power is supplied to the liquid crystal display device and the liquid crystal cell reaches full response characteristic. The aging period may be about 3 to 5 minutes from the time of the power up. However, the aging period may be changed in accordance with the liquid crystal characteristic of the display panel without departing from the scope of the present invention.

Specifically, the exemplary driving method of the liquid crystal display device according to the third embodiment of the present invention increases the data charge amount of the liquid crystal cell by controlling the pulse width of the source output enable signal SOE supplied to the data drive circuit for the aging period. (S191 and S192) As described above, the amount of data voltage charged in the liquid crystal cell may be controlled by the width of the source output enable signal SOE. Accordingly, by generating a source output enable signal SOE to have a narrow pulse width, the amount of data voltage charged in the liquid crystal cell may be increased. Further, the present invention generates the polarity control signal, which is supplied to the data drive circuit for the aging period, as the first polarity control signal POL shown in FIG. 16, thereby inverting the polarity of the data voltage for each frame period. (S193)

Figure 21:
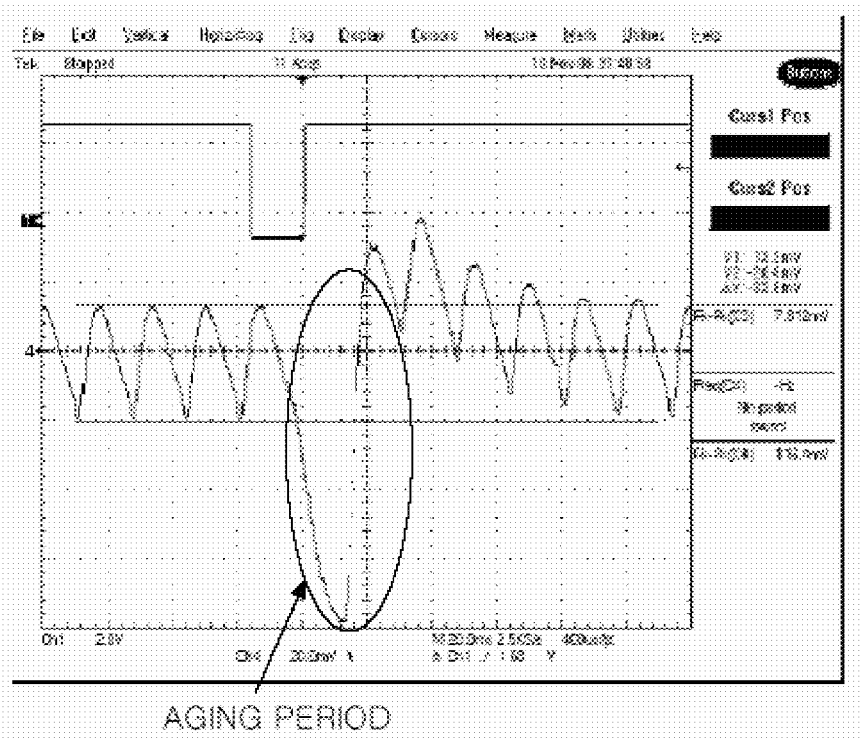
FIG. 21 is a waveform diagram illustrating an exemplary light waveform of a liquid crystal cell during an aging period.

Through experimentation, it has been found that if the liquid crystal display device is driven using the second source output enable signal FGDSOE and the second polarity control signal FGDPOL as described above during the aging period, the light waveform of the liquid crystal cell includes an undershoot and the brightness is noticeably reduced during the aging period as shown in FIG. 21. This phenomenon occurs because the response characteristic of the liquid crystal is low during the aging period (i.e., warm-up period after power up). Accordingly, the exemplary driving method of the liquid crystal display device according to the third embodiment of the present invention increases the data charge amount of the liquid crystal cell by making the pulse width of the source output enable signal SOE relatively narrow and inverts the polarity of the data voltage at every frame period during the aging period, thereby increasing the brightness and the response speed of the liquid crystal cell during the aging period.

After the aging period has passed (i.e., during the normal driving period), the exemplary driving method of the liquid crystal display device according to the third embodiment of the present invention controls the polarity of the data voltage charged in the liquid crystal cell and the amount of data voltage charged in the liquid crystal cell using the second polarity control signal FGDPOL and the second source output enable signal FGDSOE as described above. For example, the exemplary driving method of the liquid crystal display device according to the third embodiment of the present invention decreases the charge amount of the data voltage charged in the liquid crystal cell at every Nth-multiple frame period during the normal drive period using the second source output enable signal FGDSOE in the manner described above. That is to say, the present invention increases the data charge amount of the liquid crystal cell by using the source output enable signal SOE, which has a pulse width that is relatively narrow, at every frame period other than the Nth-multiple frame period during the normal driving period (i.e., after the aging period has passed). At every Nth-multiple frame period, the first source output enable signal SOE is converted into the second source output enable signal FGDSOE, which has a pulse width that is relatively wide, thereby reducing the data charge amount of the liquid crystal cell. (S194) In addition, the exemplary driving method of the liquid crystal display device according to the third embodiment of the present invention also converts the polarity control signal POL into the second polarity control signal FGDPOL, as shown in FIG. 16, during the normal driving period (i.e., after the aging period) to control the polarity of the data voltage charged in the liquid crystal cell at every Nth multiple of the frame period to be the same as the previous frame period and to invert the polarity of the data voltage charged in the liquid crystal cell at each frame period for the remaining frame period. (S195)

Figure 22:
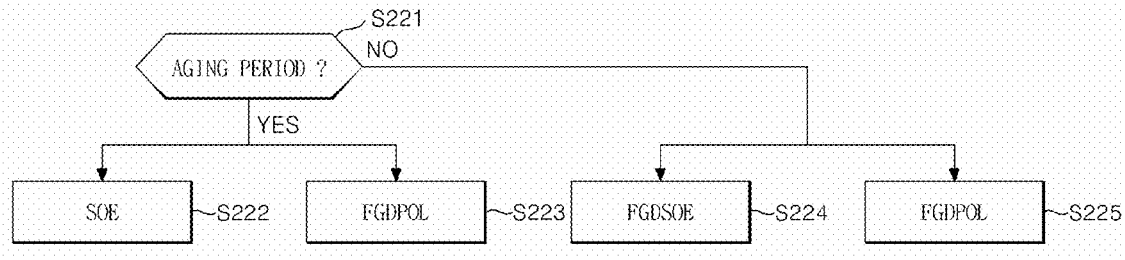
FIG. 22 is a flow chart illustrating an exemplary driving method of a liquid crystal display device according to a fourth embodiment of the present invention.

FIG. 22 is a flow chart illustrating an exemplary control sequence of a driving method of a liquid crystal display device according to a fourth embodiment of a present invention. As shown in FIGS. 20 and 22, the exemplary driving method of the liquid crystal display device according to the fourth embodiment of the present invention increases the charge amount of the liquid crystal cell during an aging period, controls the polarity of the data voltage charged in the liquid crystal cell at the Nth-multiple frame period to be the same as the previous frame period, and inverts the polarity of the data voltage charged in the liquid crystal cell at each frame period for the remaining frame period.

Specifically, the present invention increases the data charge amount of the liquid crystal cell by controlling the pulse width of the source output enable signal SOE supplied to the data drive circuit during the aging period to be narrow. (S221 and S222) Further, the present invention controls the polarity of the data voltage output from the data drive circuit using the second polarity control signal FGDPOL during the aging period to control the polarity of the data voltage charged in the liquid crystal cell at each Nth-multiple frame period to be the same as the previous frame period and inverts the polarity of the data voltage charged in the liquid crystal cell at each frame period for the remaining frame periods. (S223)

After the aging period has passed (i.e., during the normal driving period), the driving method of the liquid crystal display device according to the fourth embodiment of the present invention follows the same steps described for the normal driving period of the third embodiment above. That is to say, the present invention decreases the data charge amount of the liquid crystal cell using the second source output enable signal FGDSOE, which has a pulse width that is wider than the first source output enable signal SOE, at every Nth-multiple frame period after the aging period has passed. (S224) In addition, after the aging period, the polarity of the data voltage charged in the liquid crystal cell at every Nth-multiple frame period is kept the same as the previous frame period by using the second polarity control signal FGDPOL and inverts the polarity of the data voltage charged in the liquid crystal cell at each frame period for the remaining frame period. (S225)

Figure 23:
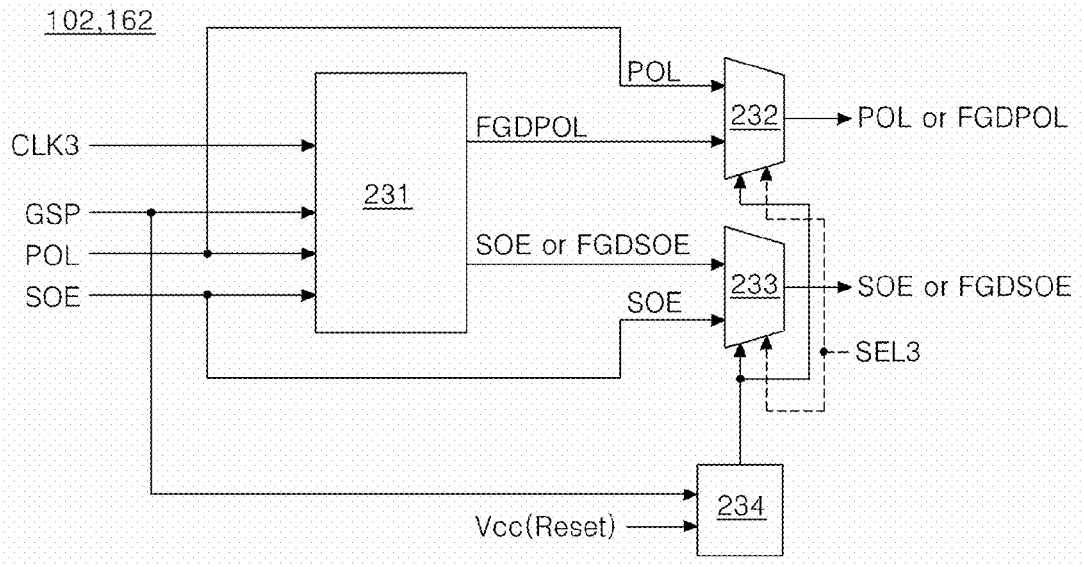
FIG. 23 is a block diagram illustrating another exemplary embodiment of a POL/SOE logic circuit shown in FIG. 14.

The exemplary driving method of the liquid crystal display device according to the third and fourth embodiments of the present invention may be implemented in accordance with the liquid crystal display device shown in FIG. 11 with the addition of an aging stabilization circuit 234 shown in FIG. 23. As shown in FIG. 23, a POL/SOE logic circuit (e.g., 102 in FIG. 11, 162 in FIG. 18) receives the gate start pulse GSP and the first polarity control signal POL during or after the aging period and outputs the second polarity control signal FGDPOL (e.g., as shown in FIG. 16). Further, the POL/SOE logic circuit (102, 162) receives the first source output enable signal SOE and the third clock signal CLK3 after the aging period and outputs the second source output enable signal FGDSOE, which has a pulse width adjusted to be wider than the first source output enable signal SOE, at every Nth-multiple frame period and the first source output enable signal SOE, which has a narrow pulse width, at all the other frame periods in order to prevent the generation of residual images and flicker. The POL/SOE logic circuit (102, 162) can selectively supply any one of the first and second polarity control signals POL, FGDPOL and the first and second source output enable signals SOE, FGDSOE to the data drive circuit 103 based on the selection signal SEL2 determined by the manufacturer.

In accordance with the third and fourth embodiments of the present invention, the POL/SOE logic circuit (102, 162) includes a logic part 231, first and second multiplexers 232, 233, and an aging stabilization circuit 234. The logic part 231 generates the second source output enable signal FGDSOE based on the clock signal CLK3, the gate start pulse GSP, and the first source output enable signal SOE and also outputs the second polarity control signal FGDPOL. The logic part 231 may be implemented by the circuit shown in FIG. 15.

The first multiplexer 232 selects between the first polarity control signal POL and the second polarity control signal FGDPOL based on the control signal from the aging stabilization circuit 234. The second multiplexer 233 selects between the first source output enable signal SOE and the second source output enable signal FGDSOE based on the control signal from the aging stabilization circuit 234.

Figure 24:
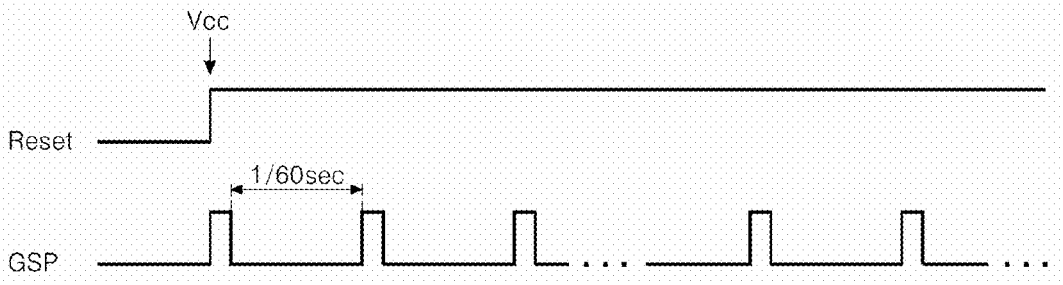
FIG. 24 is a waveform illustrating an exemplary power supply voltage and a gate start pulse shown in FIG. 23.

When a user turns on the power supply source of the liquid crystal display device or the video signal source 105, a reset signal Reset, as shown in FIG. 24, and a power supply voltage Vcc is generated. The aging stabilization circuit 234 determines the aging period by counting the supply period of the power supply voltage Vcc with the gate start pulse GSP, as shown in FIG. 24, and controls the second multiplexer 233 to output the first source output enable signal SOE during the aging period. The aging stabilization circuit 234 controls the first multiplexer 232 to output either the first polarity control signal POL or the second polarity control signal FGDPOL during the aging period.

Figure 25:
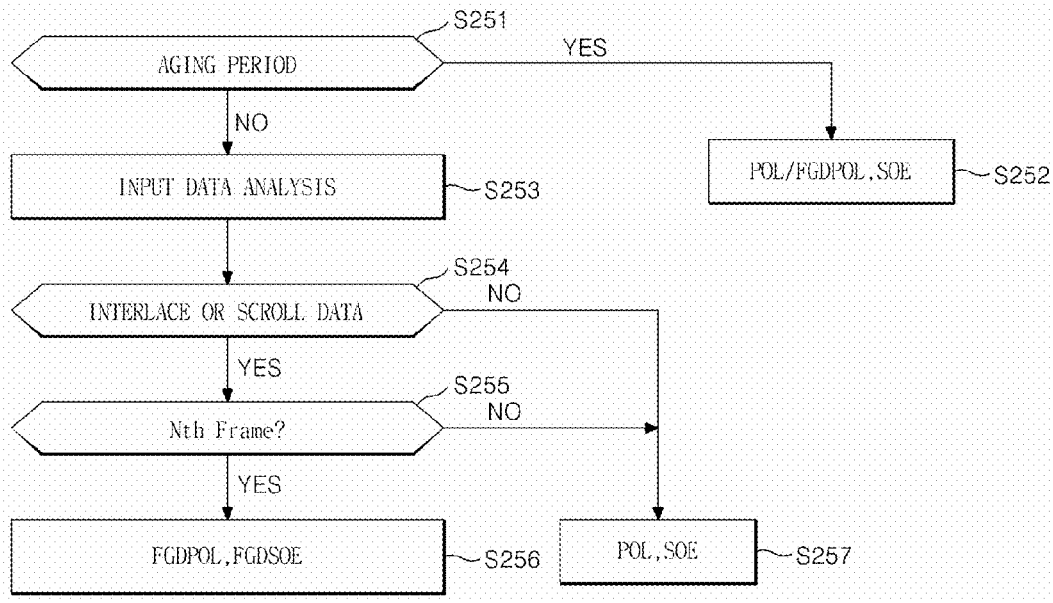
FIG. 25 is a flow chart illustrating an exemplary driving method of a liquid crystal display device according to a fifth embodiment of the present invention.

FIG. 25 is a flow chart illustrating an exemplary driving method of a liquid crystal display device according to a fifth embodiment of the present invention. As shown in FIG. 25, the exemplary driving method of the liquid crystal display device according to the fifth embodiment of the present invention is a combination of the first through fourth embodiment as described above. That is to say, the exemplary driving method according to the fifth embodiment of the present invention controls the data drive circuit using the first source output enable signal SOE during the aging period, thereby increasing the data charge amount of the liquid crystal cell. Further, the present invention inverts the polarity of the data voltage supplied to the liquid crystal cell for each frame period using the first polarity control signal POL during the aging period, or controls the polarity of the data voltage charged in the liquid crystal cell at the Nth-multiple frame period to be the same as the previous frame period using the second polarity control signal FGDPOL and inverts the polarity of the data voltage charged in the liquid crystal cell at every frame period for the remaining frame periods. (S251, S252)

Once the liquid crystal display device is operating during the normal driving period (i.e., after the aging period has passed), the present invention analyzes the input data after and judges whether the input data is data that would likely cause DC image sticking, such as interlace data or the scroll data. (S253, S254) In the step S254, if the currently input data is data which is likely to cause DC image sticking, then a determination is made as to whether the current frame period is an Nth-multiple frame period. If the current frame period is an Nth-multiple frame period, the polarity of the data voltage to be displayed in the liquid crystal display panel is controlled using the second polarity control signal FGDPOL and the data charge amount of the liquid crystal cell is controlled to be reduced using the second source output enable signal FGDSOE. (S255, S256) If the currently input data is not data that is likely to cause DC image sticking, the polarity of the data voltage to be displayed in the liquid crystal display panel is controlled using the first polarity control signal POL and the data charge amount of the liquid crystal cell is controlled to be increased using of the first source output enable signal SOE. (S257)

The exemplary driving method of the liquid crystal display device according to the fifth embodiment of the present invention may be implemented according to the liquid crystal display device shown in FIG. 18 with the addition of an aging stabilization circuit 234, as shown in FIG. 23, in combination with the POL/SOE logic circuit of the liquid crystal display device shown in FIG. 18. As shown in FIGS. 18 to 25, the POL/SOE logic circuit 162 determines the aging period by counting the supply period of the power supply voltage Vcc, generates either the first or second polarity control signals POL, FGDPOL during the aging period, and outputs the first source output enable signal SOE during the aging period. The POL/SOE logic circuit 162 outputs the second polarity control signal FGDPOL and the second source output enable signal FGDSOE in response to the first logic value of the selection signal SEL3 from the image analyzing circuit 161 after the aging period when data that is likely to generate DC image sticking are input. On the other hand, the POL/SOE logic circuit 162 generates the first polarity control signal POL and the first source output enable signal SOE in response to the second logic value of the selection signal SEL3 from the image analyzing circuit 161 after aging period if the input data is not likely to cause DC image sticking.

Figure 26A:
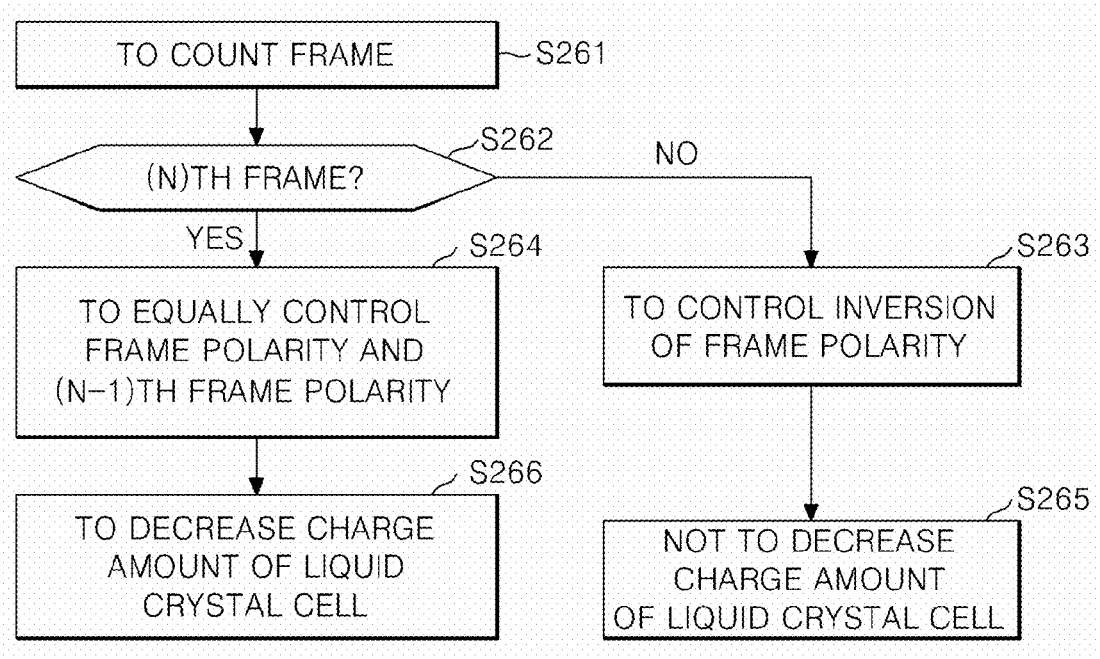
FIG. 26A is a flow chart illustrating an exemplary method of driving the liquid crystal display according to a sixth embodiment of the present invention.

FIG. 26A illustrates an exemplary method of driving the liquid crystal display according to a sixth embodiment of the present invention. As shown in FIG. 26A, the exemplary method of driving the liquid crystal display according to the sixth embodiment of the present invention counts a timing signal input with digital video data to count frame periods. (S261) Next, the exemplary method of driving the liquid crystal display according to the sixth embodiment of the present invention inverts a frame polarity at each frame period to invert the polarity of a data voltage charged in the liquid crystal cell Clc at each frame period (S262 and S263), and maintains a frame polarity of the Nth-multiple frame period to be the same as a frame polarity of the previous frame period. (S262 and S264)

A frame polarity refers to a polarity of a data voltage in liquid crystal cells that are determined by a polarity control signal POL within each frame period. The polarity control signal POL is generated from a timing controller. The present invention generates a second polarity control signal FGDPOL to control a polarity of a data voltage supplied to the liquid crystal cell at an Nth-multiple frame period to be the same as a data voltage supplied to the liquid crystal cell in the previous frame period. The present invention inverts a polarity of a data voltage supplied to the liquid crystal cell at all other frame periods. The second polarity control signal FGDPOL is generated to have the same phase in the Nth-multiple frame period as the previous frame period and is inverted at all other frame periods. In addition, the logic of the second polarity control signal FGDPOL is inverted at each horizontal period (e.g., 1-dot) or every two horizontal periods (e.g., 2-dot) within a first frame period. Accordingly, a polarity of a data voltage charged in the liquid crystal cell at a frame period prior to the Nth-multiple frame period is inverted for each frame period (S262 and S263), and polarities of a data voltage charged in the liquid crystal cell at the Nth-multiple frame period and the previous frame period are controlled to be the same. (S262 and S264) The exemplary method of driving the liquid crystal display according to the sixth embodiment of the present invention does not reduce an amount of voltage charged in the liquid crystal cell except during the Nth-multiple frame period. (S265)

In order to compensate an overcharge of the liquid crystal cell during the Nth-multiple frame periods by applying data voltages having the same polarity for two frame periods, the exemplary method of driving the liquid crystal display according to the sixth embodiment of the present invention temporarily supplies a voltage having a different polarity to the liquid crystal cell to decrease the amount of voltage charged in the liquid crystal cell during the Nth-multiple time periods. (S266) To decrease an amount of voltage charged in the liquid crystal cell during the Nth-multiple frame periods, the present invention applies a different gate timing control signal, which controls a timing of when the gate driving circuit is operation, during the Nth-multiple frame periods to continuously generate two scan pulses for each gate line to overlap a portion of scanning pulses supplied to adjacent gate lines.

Figure 26B:
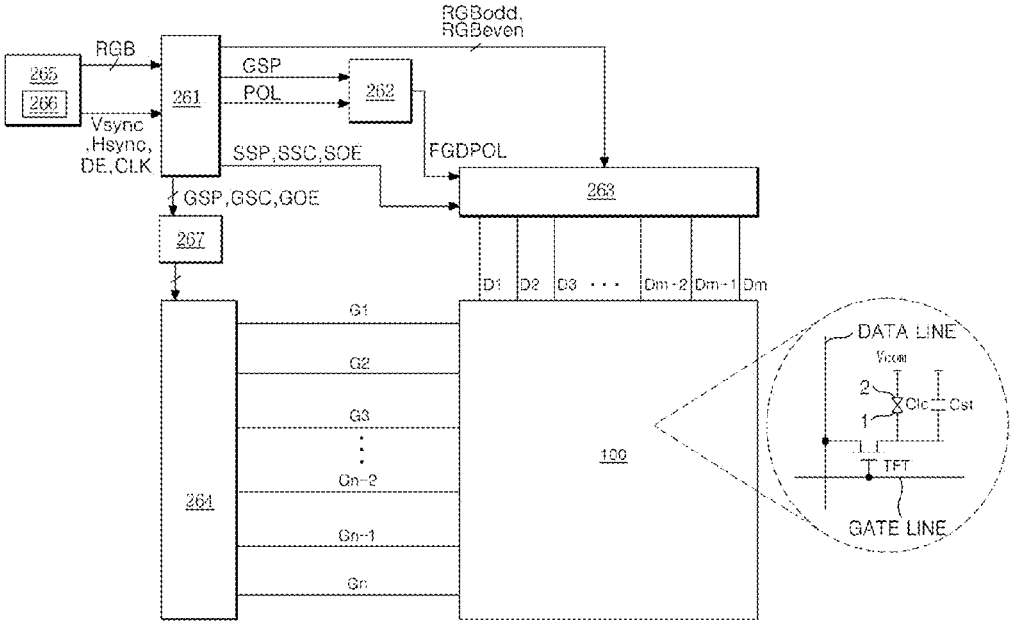
FIG. 26B is a block diagram showing an exemplary liquid crystal display according to the sixth embodiment of the present invention.

FIG. 26B shows an exemplary liquid crystal display device according to the sixth embodiment of the present invention. As shown in FIG. 26B, the exemplary liquid crystal display device according to the sixth embodiment of the present invention includes a liquid crystal display panel 100, a timing controller 261, a first logic circuit 262, a data driving circuit 263, a gate driving circuit 264, and a second logic circuit 267. The liquid crystal display panel of FIG. 26B may be implemented in accordance with the liquid crystal display panel 100 as described above in reference to the first embodiment. Accordingly, a detailed description of the liquid crystal display panel 100 is not repeated here.

The timing controller 261 receives timing signals such as vertical/horizontal synchronization signals Vsync and Hsync, data enable signals, clock signals, and other signals to generate control signals that controls the operation timing of the data driving circuit 263, the gate driving circuit 264, and the first and second logic circuits 262 and 267. The control signals include a gate timing control signal having a gate start pulse GSP, a gate shift clock signal GSC, and a gate output enable signal GOE, etc. Furthermore, the control signals include a data timing control signal having a source start pulse SSP, a source sampling clock SSC, a source output enable signal SOE, and a first polarity control signal POL, etc. The gate start pulse GSP is a timing control signal that indicates a start horizontal line from which a scan starts among a first vertical period when a screen is displayed. That is, the gate start pulse GSP is a first scanning pulse with which the first gate line is supplied. The gate shift clock signal GSC is input to a shift register within the gate driving circuit to sequentially shift the gate start pulse GSP. The source start pulse SSP indicates a start pixel in a first horizontal line where image data are to be displayed. The source sampling clock SSC indicates a latch operation of the data within the data driving circuit 263 on the basis of a rising or falling edge. The source output enable signal SOE indicates the output of the data driving circuit 263.

The first polarity control signal POL indicates the polarity of the data voltages which are to be supplied to the liquid crystal cells Clc of the liquid crystal display panel 100. The first polarity control signal POL may be generated in any type of 1-dot inversion polarity control signal of which the logic is inverted for each horizontal period and 2-dot inversion polarity control signal of which the logic is inverted for each two horizontal periods. The timing controller 261 generates timing control signals at a frame frequency of 120 Hz or 60 Hz to control the operation timing of the first logic circuit 262, the data driving circuit 263, and the gate driving circuit 264 on the basis of 120 Hz or 60 Hz.

The frame frequency is a frequency corresponding to the vertical synchronization signal Vsync and indicates the number of screen per second. The 120 Hz frame frequency makes 120 screens per second displayed on the liquid crystal display panel 100, and 60 Hz frame frequency makes 60 screens per second displayed on the liquid crystal display panel 100. Flicker is generally not perceivable when the liquid crystal display is driven at the 120 Hz frame frequency compared to the 60 Hz frame frequency. Accordingly, the timing controller 261 generates the control signals on the basis of the 120 Hz frame frequency in order to improve reduction of the flicker effect. However, other frame frequencies may be used without departing from the scope of the present invention. The timing controller 261 divides input digital video data RGB into the digital video data RGBodd of an odd-numbered pixel and the digital video data RGBeven of an even-numbered pixel to reduce by half a transmission frequency of data transmitted to the data driving circuit 263.

In order to prevent a residual image (i.e., DC image sticking) and flicker, the first logic circuit 262 receives the gate start pulse GSP and the first polarity control signal POL to generate the second polarity control signal FGDPOL such that the polarity of the data voltage is inverted at every frame period except at the Nth-multiple frame period, at which the polarity of the data voltage is kept the same as the polarity of the previous frame period. Herein, the first logic circuit 262 may selectively supply either the first polarity control signal POL or the second polarity control signal FGDPOL to the data driving circuit 263. As shown in FIG. 16, the first polarity control signal POL has its logic inverted for each horizontal period or for each two horizontal periods, and the logic is also inverted for each frame period in order to invert the polarity of the data voltage for each frame period.

The second logic circuit 267 is supplied with two scanning pulses for each horizontal line at every Nth-multiple frame period and modulates gate timing signals to overlap a first scanning pulse of the two scanning pulses with a second scanning pulse supplied to the previous gate line. There are generally two ways of modulating the gate timing signal. The first is a method that generates a pre-SP clock PreGSC prior to a gate shift clock GSC, which is firstly generated in the Nth-multiple frame period, and generates a pre-GOE clock PreGOE prior to a gate output enable signal GOE, which is firstly generated in the Nth-multiple frame period. The second is a method that widens the pulse width of the gate start pulse GSP in the Nth-multiple frame period. In the latter method of modulating the gate timing control signal, the timing controller 261 must be delayed digital video data RGB, which are supplied to the data driving circuit 263, to synchronize a second scanning pulse of a first and second scanning pulse, which are supplied to the first gate line G1, with a first data. The first and second logic circuit 262 and 267 may be mounted within the timing controller 261.

The data driving circuit 263 latches the digital video data RGBodd and RGBeven under the control of the timing controller 261. Then, the data driving circuit 263 converts the digital video data RGBodd and RGBeven into an analog positive/negative gamma compensation voltage in accordance with the second polarity control signal FGDPOL to generate a positive/negative analog data voltage and supply the data voltage to the data lines D1 to Dm.

The gate driving circuit 264 includes a plurality of gate drive ICs of which each includes a shift register, a level shifter for converting the swing width of the output signal of the shift register into a swing width that is suitable for driving the TFT of the liquid crystal cell, and an output buffer connected between the level shifter and the gate line G1 to Gn. The gate driving circuit 264 sequentially supplies a pair of scanning pulses to each gate line in response to the gate timing control signals. The pair of scanning pulses includes first and second scanning pulses, which are continuously generated. At least a portion of the first scanning pulse is overlapped with the second scanning pulse with which the previous gate line is supplied.

The exemplary liquid crystal display according to the sixth embodiment of the present invention further includes a video signal source 265 that supplies the digital video data RGB and the timing signals Vsync, Hsync, DE, and CLK to the timing controller 261. The video signal source 265 includes a broadcasting signal, an external device interface circuit, a graphic processing circuit, a line memory 266, and the like. The video signal source 265 extracts the video data from an image source input from an external device or a broadcasting signal and converts the video data into the digital data to supply to the timing controller 261. An interlaced broadcasting signal received in the video signal source 265 is stored at the line memory 266. The video data of the interlaced broadcasting signal exist only in the odd-numbered lines of the odd-numbered frame period and only in even-numbered lines of the even-numbered frame period. Accordingly, if the interlaced broadcasting signal is received, the video signal source 265 generates a black data value or an average value of the effective data stored in the line memory 266 as the even-numbered line data of the odd-numbered frame period and the odd-numbered line data of the even-numbered frame.

The video signal source 265 supplies the timing signals Vsync, Hsync, DE, CLK together with the digital video data to the timing controller 261. Further, the video signal source 265 supplies power to circuits such as the timing controller 261, the first and second logic circuit 262 and 267, the data driving circuit 263, the gate driving circuit 264, a DC-DC converter for generating a drive voltage of the liquid crystal display panel, an inverter for lighting the light source of a backlight unit, and other components for operating the liquid crystal display device.

Figure 27:
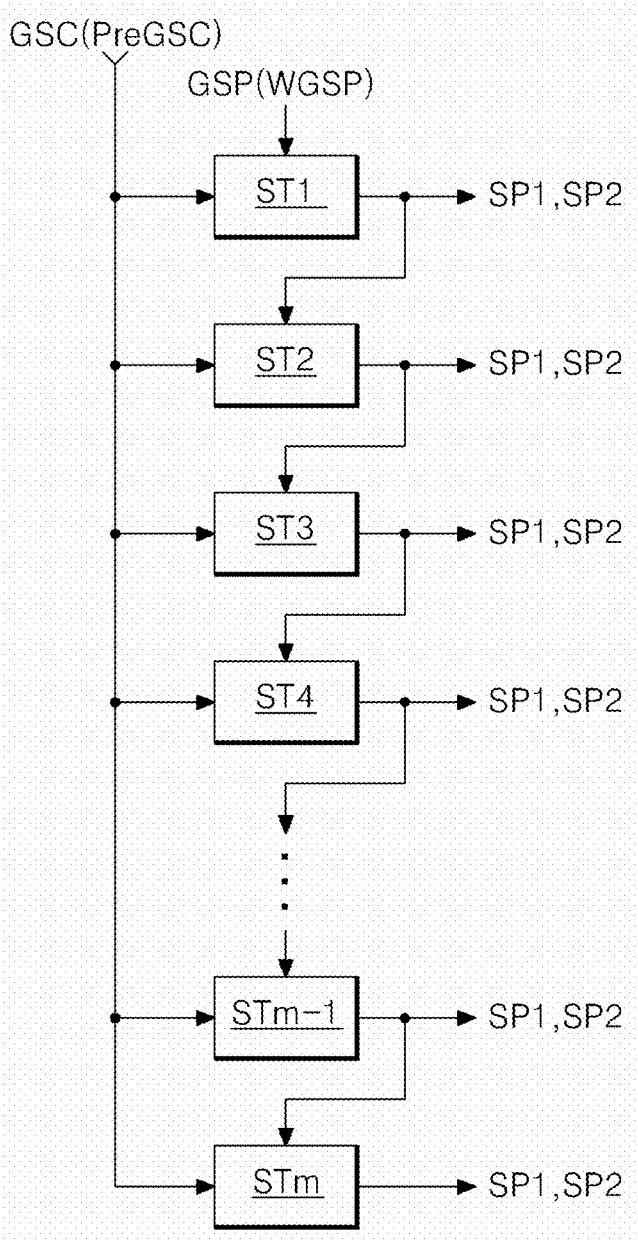
FIG. 27 is a block diagram illustrating an exemplary shift register of a gate driving circuit according to the sixth embodiment of the present invention.

FIG. 27 shows an exemplary shift register of the gate driving circuit 264. The exemplary shift register of the gate driving circuit 264 is supplied with the gate shift clock GSC and includes a plurality of stages ST1 to STm which are connected to each other in a cascading manner. The gate start pulse GSP is input to a first stage ST1 that generates a first scanning pulse. The first stage ST1 generates a scanning pulse in response to the gate shift clock GSC when the gate start pulse is maintained as a high logic voltage. The second to mth stages (i.e., ST2 to STm) receive an output of the previous stage as a start pulse and sequentially shift an output of the previous stage to output a scanning pulse through their output terminals in response to the gate shift clock GSC.

As described above, the exemplary embodiment of the present invention modulates a gate timing control signal using the second logic circuit 267 to continuously output the first and second scanning pulses from each stage of the shift register. Furthermore, the present invention overlaps the second scanning pulse SP2, which is output to the previous stage, with the first scanning pulse SP1, which is output to the next stage, to cause a decrease in the charge amount of the liquid crystal cell at the Nth-multiple frame period.

Figure 28:
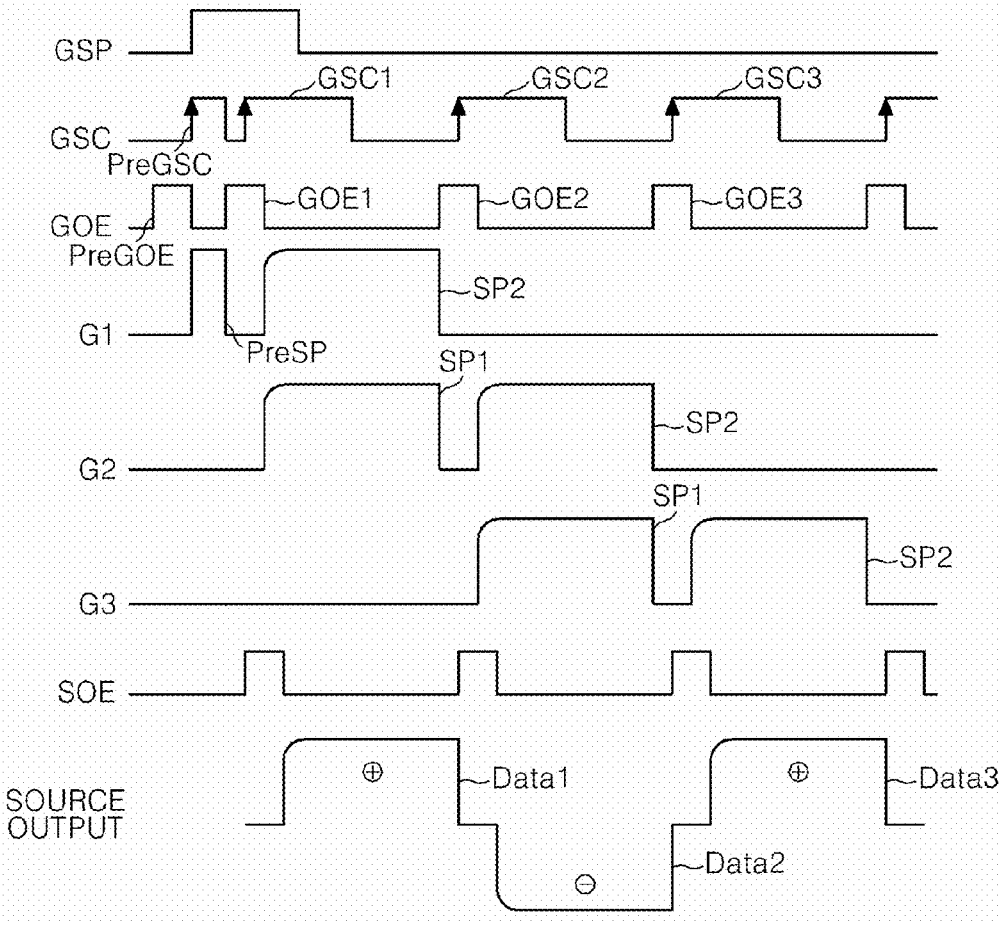
FIGS. 28 and 29 are exemplary waveform diagrams showing a timing signal and a scanning pulse generated in Nth-multiple frame periods.

FIG. 28 shows an exemplary embodiment of a gate timing control signal and a waveform of a data voltage which is generated at the Nth-multiple frame period. In FIG. 28, "Source Output" refers to a data voltage waveform output from the data driving circuit 263. In this case, the polarity of the data voltage is inverted at each horizontal period due to a polarity control signal. As shown in FIGS. 27 and 28, the second logic circuit 267 modulates a gate timing control signal at each Nth-multiple frame period.

A modulated gate timing control signal includes a pre-gate shift clock PreGSC, which is generated prior to a first gate shift clock GSC1, and a pre-gate output enable signal PreGOE, which is generated prior to a first gate output enable signal GOE1. The pre-gate shift clock PreGSC is generated almost simultaneously with the gate start pulse GSP. The first gate shift clock GSC1 is generated after a designated time passes from a falling edge of the pre-gate shift clock PreGSC while the gate start pulse GSP is maintained as a high logic voltage. Accordingly, the pre-gate shift clock PreGSC is overlapped with the first gate shift clock GSC1 within the gate start pulse GSP. The pre-gate output enable signal PreGOE is overlapped with a rising edge of the pre-gate shift clock PreGSC, and the first gate output enable signal GOE1 is overlapped with a falling edge of the pre-gate shift clock PreGSC and a rising edge of the first gate shift clock GSC1.

In the shift register of the gate driving circuit 264, the first stage ST1 generates a pre-scanning pulse PreSP between a falling edge of the pre-gate output enable signal PreGOE and a rising edge of the first gate output enable signal GOE1 in response to the pre-gate shift clock PreGSC. In this case, TFTs, which are connected to the first gate line G1, are turned on in response to the pre-scanning pulse PreSP. However, because no data voltage is output at this time, liquid crystal cells of a first pixel row do not get charged with a data voltage.

Next, the gate start pulse GSP is maintained as a high logic voltage when the first gate shift clock GSC1 is generated. Thus, the first stage ST1 shifts the gate start pulse GSP to generate the second scanning pulse SP2 and, at the same time the second stage ST2 shifts the pre-scanning pulse PreSP output from the first stage ST1, to generate the first scanning pulse SP1. In this case, the TFTs connected to the first gate line G1 are turned on by the second scanning pulse SP2 supplied to the first gate line G1. Thus, the liquid crystal cells of the first pixel row are charged with a first data voltage Data1 having a positive (or negative) polarity. Simultaneously, the TFTs connected to a second gate line G2 are turned on by the first scanning pulse SP1 supplied to the second gate line G2. Thus, liquid crystal cells of a second pixel row are charged with the first data voltage Data1 having the positive (or negative) polarity.

Next, the gate start pulse GSP is inverted to a low logic voltage when the second gate shift clock GSC2 is generated. Thus, an output voltage of the first stage ST1 is discharged to a low-level power voltage Vss or a ground voltage GND. The second stage ST2 shifts the second scanning pulse SP2, which is output from the first stage ST1, to generate the second scanning pulse SP2 in response to the second gate shift clock GSC2. For this period, the third stage ST3 shifts the second scanning pulse SP2, which is output from the second stage ST2, to generate the first scanning pulse SP1. In this case, the TFTs connected to a second gate line G2 are turned on by the second scanning pulse SP2 supplied to the second gate line G2. Thus, the liquid crystal cells of the second pixel row are charged with the second data voltage Data2 having a negative (or positive) polarity. Simultaneously, TFTs connected to a third gate line G3 are turned on by the first scanning pulse SP1 supplied to a third gate line G3. Thus, liquid crystal cells of a third pixel row are charged with the second data voltage Data2 having the negative (or positive) polarity.

In the same manner, the shift register of the gate driving circuit 264 sequentially shifts a pair of scanning pulses SP1 and SP2 at each Nth-multiple frame period. The second scanning pulse SP2, which is supplied to the previous gate line, is overlapped with the first scanning pulse SP1, which is supplied to the next gate line. Accordingly, after the liquid crystal cells are pre-charged with a previous data voltage having an opposite polarity in the previous pixel row, the liquid crystal cells are charged with data voltages having the opposite polarity to be displayed in comparison with a polarity of the previous data voltage.

For purposes of example, a frame frequency is taken to be about 120 Hz. In this case, the time period for a data voltage having an opposite polarity charged to the previous pixel row to be pre-charged to the next pixel row is about "$1/120$(sec)×1/vertical resolution=1 line charging time." A data voltage to be displayed is maintained for other frame periods other than the 1 line charging time. Accordingly, immediately after the liquid crystal cells are temporarily charged with a data voltage having an opposite polarity applied to the previous pixel row, the liquid crystal cells are charged with a data voltage having a polarity that is opposite compared to the data voltage applied to the previous pixel row. Thus, an amount of charge is decreased. Also, a data voltage applied to the liquid crystal cells at every Nth-multiple frame period, includes two voltages having a different polarity. As a result, a frequency component of a data voltage, which is applied to the liquid crystal cells, is increased.

Figure 29:
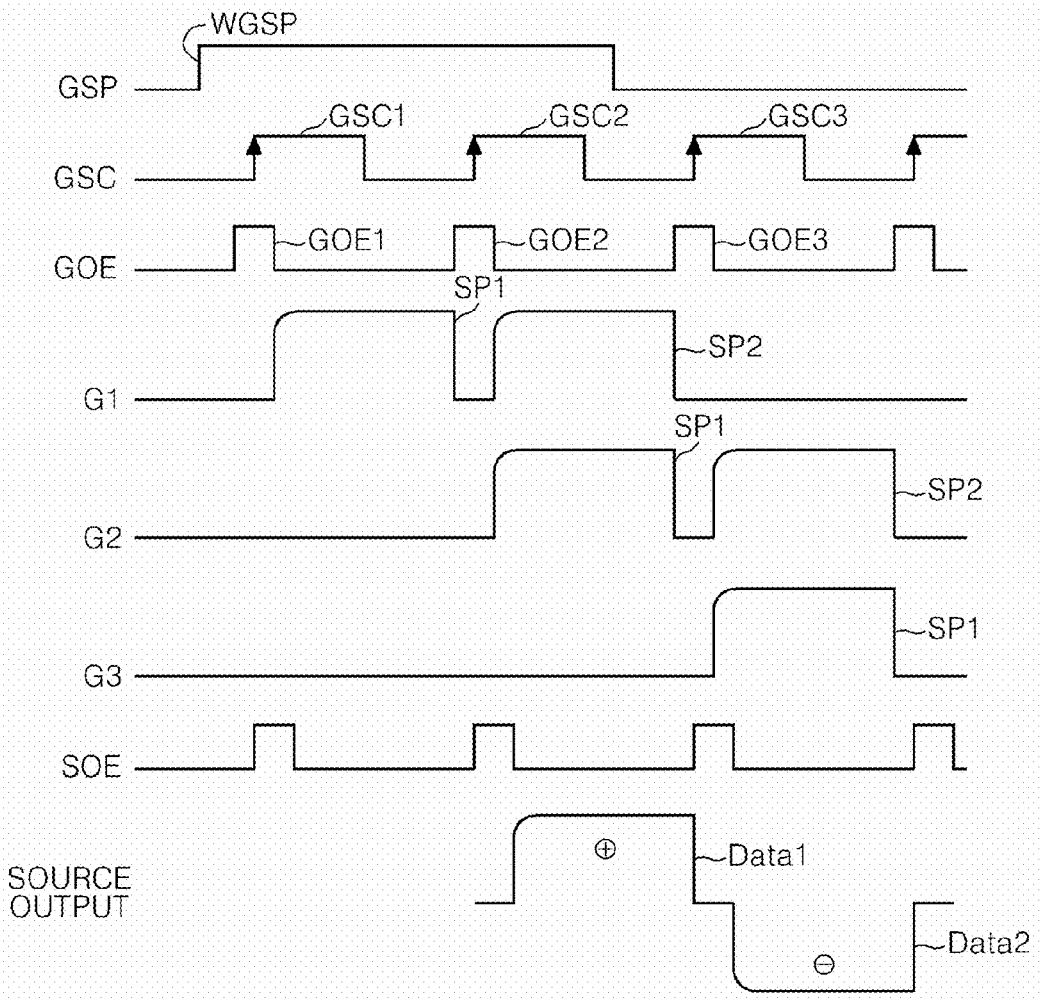

FIG. 29 is an exemplary waveform diagram showing another example of a gate timing control signal and a data voltage waveform generated at every Nth-multiple frame period. As shown in FIG. 29, "Source Output" refers to a data voltage waveform output from the data driving circuit 263. In this case, the polarity of the data voltage is inverted by each horizontal period due to a polarity control signal. As shown in FIGS. 27 and 29, the second logic circuit 267 modulates a gate timing control signal at every Nth-multiple frame period. A modulated gate timing control signal includes a gate start pulse WGSP with a widened pulse width. The first and second gate shift clocks GSC1 and GSC2 are generated within the pulse width period of the gate start pulse WGSP.

In the shift register of the gate driving circuit 264, the first stage ST1 generates the first scanning pulse SP1 between a falling edge of the first gate output enable signal GOE1 and a rising edge of the second gate output enable signal GOE2 in response to the first gate shift clock GSC1. In this case, the TFTs connected to the first gate line G1 are turned on in response to the first scanning pulse SP1. However, since no data voltage is output, the liquid crystal cells of the first pixel row do not charge a data voltage.

Next, the gate start pulse GSP is maintained as a high logic voltage when the second gate shift clock GSC2 is generated. Thus, the first stage ST1 shifts the gate start pulse GSP to generate the second scanning pulse SP2 and, at the same time the second stage ST2 shifts the first scanning pulse SP1 output from the first stage ST1, to generate the first scanning pulse SP1. In this case, the TFTs connected to the first gate line G1 are turned on by the second scanning pulse SP2 supplied to the first gate line G1. Thus, the liquid crystal cells of the first pixel row is charged with the first data voltage Data1 having a positive (or negative) polarity. Simultaneously, the TFTs connected to the second gate line G2 are turned on by the first scanning pulse SP1 supplied to the second gate line G2. Thus, the liquid crystal cells of the second pixel row are charged the first data voltage Data1 having the positive (no negative) polarity.

Next, the gate start pulse GSP is inverted to a low logic voltage when a third gate shift clock GSC3 is generated. Thus, an output voltage of the first stage ST1 is discharged to a low-level power voltage Vss or a ground voltage GND. The second stage ST2 shifts the second scanning pulse SP2 output from the first stage ST1 to generate the second scanning pulse SP2 in response to the third gate shift clock GSC3. For this period, the third stage ST3 shifts the second scanning pulse SP2 output from the second stage ST2 to generate the first scanning pulse SP1. In this case, the TFTs connected to a second gate line G2 are turned on by the second scanning pulse SP2 supplied to the second gate line G2. Thus, the liquid crystal cells of the second pixel row are charged with the second data voltage having the negative (or positive) polarity. Simultaneously, TFTs connected to a third gate line G3 are turned on by the first scanning pulse SP1 supplied to a third gate line G3. Thus, liquid crystal cells of a third pixel row is charged with a second data voltage Data2 having the negative (or positive) polarity.

In the same manner, the shift register of the gate driving circuit 264 sequentially shifts a pair of scanning pulses SP1 and SP2 at the Nth-multiple frame period. The second scanning pulse SP2, which is supplied to the previous gate line, is overlapped with the first scanning pulse SP1, which is supplied to the next gate line. Accordingly, after the liquid crystal cells are pre-charged with a previous data voltage having an opposite polarity charged to the previous pixel row, the liquid crystal cells are charged with data voltages having a polarity that is opposite to be displayed in comparison with a polarity of the previous data voltage.

For purposes of example, a frame frequency is taken to be about 120 Hz. In this case, the time period for a data voltage having an opposite polarity charged to the previous pixel row to be pre-charged to the next pixel row is about "$1/120$(sec)×1/vertical resolution=1 line charging time." A data voltage to be displayed is maintained for other frame periods other than the 1 line charging time. Accordingly, immediately after the liquid crystal cells are temporarily charged with a data voltage having an opposite polarity applied to the previous pixel row, the liquid crystal cells are charged with a data voltage having a polarity that is opposite compared to the data voltage applied to the previous pixel row. Thus, an amount of charge is decreased. Also, a data voltage applied to the liquid crystal cells at every Nth-multiple frame period, includes two voltages having a different polarity. As a result, a frequency component of a data voltage, which is applied to the liquid crystal cells, is increased.

In the exemplary embodiment of FIG. 29, the first data voltage Data1 must be synchronized with the second scanning pulse SP2 supplied to the first gate line G1. Thus, the timing controller 261 must supply the digital video data RGB corresponding to the first data voltage Data1 with delay in comparison with the embodiment of FIG. 28.

Figure 30:
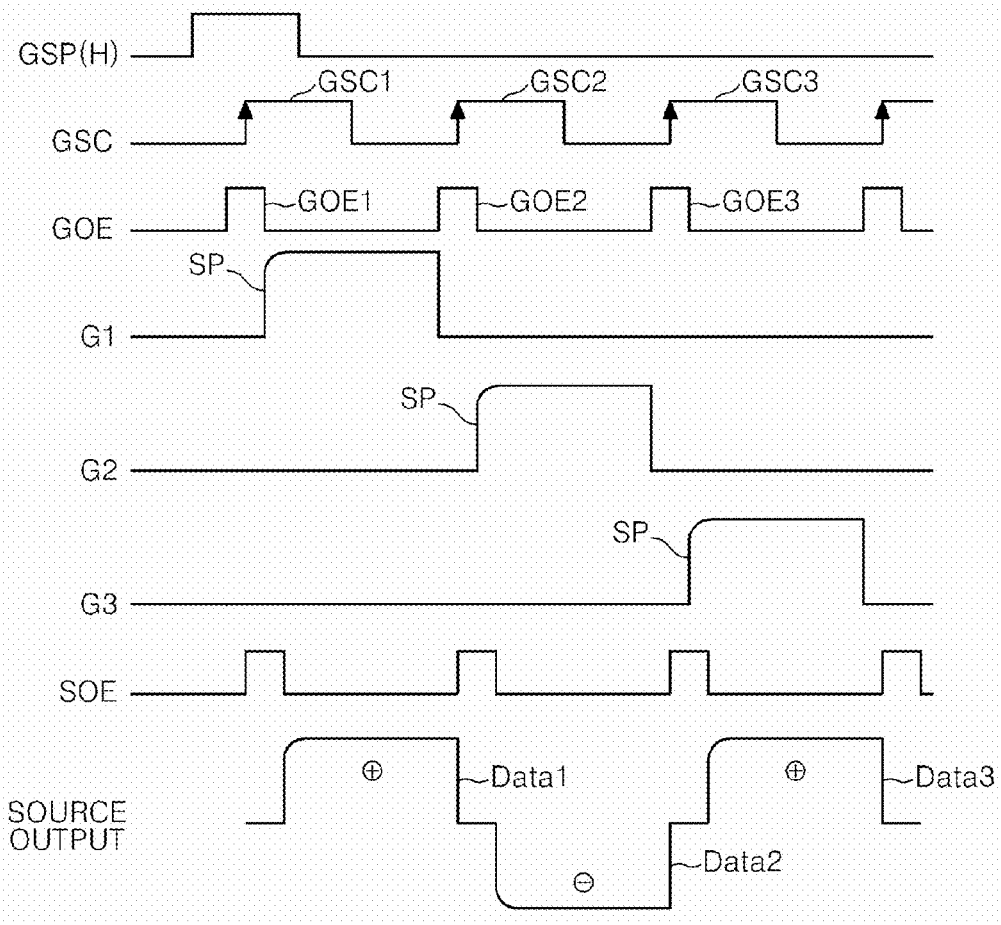
FIG. 30 is an exemplary waveform diagram showing a gate timing signal and a scanning pulse which are generated at frame periods other than Nth-multiple frame periods.

FIG. 30 is a waveform diagram showing an exemplary a gate timing control signal and a waveform of a data voltage generated at frame periods other than the Nth-multiple frame period in the exemplary method of driving the liquid crystal display according to the present invention. As shown in FIG. 30, "Source Output" refers to a data voltage waveform output from the data driving circuit 263. In this case, the polarity of the data voltage is inverted at each horizontal period due to a polarity control signal. As shown in FIGS. 27 and 30, the second logic circuit 267 does not modulate but bypass a gate timing control signal at frame periods other than the Nth-multiple frame period. The first gate shift clock GSC1 is generated only within a pulse width period of the gate start pulse GSP.

In the shift register of the gate driving circuit 264, the first stage ST1 generates the scanning pulse SP between a falling edge of the first gate output enable signal GOE1 and a rising edge of the second gate output enable signal GOE2 in response to the first gate shift clock GSC1. In this case, the TFTs connected to the first gate line G1 are turned on in response to the scanning pulse SP. Thus, the liquid crystal cells of the first pixel row is charged with the first data voltage Data1 having a positive (or negative) polarity.

Next, the gate start pulse GSP is maintained as a low logic voltage when the second gate shift clock GSC2 is generated. Thus, the first stage ST1 does not shift a scanning pulse and the second stage ST2 shifts the scanning pulse output from the first stage ST1. In this case, the TFTs connected to the second gate line G2 are turned on by the scanning pulse SP supplied to the second gate line G2. Thus, the liquid crystal cells of the second pixel row is charged with the second data voltage Data2 having a negative (or positive) polarity.

Next, the third stage ST3 shifts the scanning pulse SP output from the second stage ST2 in response to the third gate shift clock GSC3. In this case, the TFTs connected to the third gate line G3 are turned on by the scanning pulse SP supplied to the third gate line G3. Thus, the liquid crystal cells of the third pixel row is charged with a third data voltage Data3 having a positive (or negative) polarity.

In the same manner, the shift register of the gate driving circuit 264 sequentially shifts one scanning pulse SP at frame periods other than the Nth-multiple frame period. Accordingly, since the liquid crystal cells are only charged with a data voltage to be displayed when the scanning pulse is generated, the charge amount is not decreased.

Figure 31:
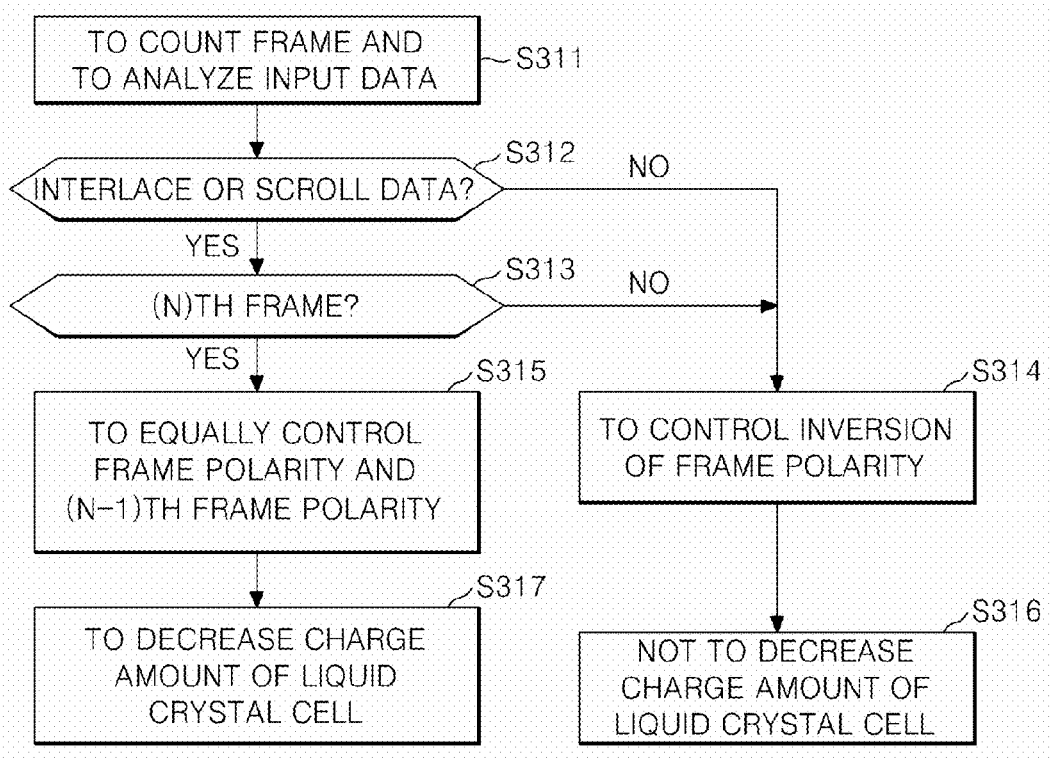
FIG. 31 is a flow chart illustrating an exemplary method of driving a liquid crystal display according to a seventh embodiment of the present invention.

FIG. 31 is a flow chart illustrating an exemplary method of driving the liquid crystal display according to a seventh embodiment of the present invention. As shown in FIG. 31, the exemplary method of driving the liquid crystal display according to the seventh embodiment of the present invention analyzes input data, judges whether the input data is data that is likely to generate DC image sticking, such as interlace data or scroll data, and counts the frame period. (S311 and S312) The present invention repeatedly compares two line data using a line memory and a comparator. If the adjacent two line data is more than a predetermined threshold, the present invention deems the adjacent two line data to be interlace data. Also, the present invention compares previous frame images with current frame images using a frame memory and a comparator to detect a portion that moves at a constant speed in the current frame, thereby detecting scroll data.

If the currently input data is data that will not generate DC image sticking and the current frame period is not an Nth-multiple frame period, the present invention controls the polarity of the data voltage with the first polarity control signal POL and therefore does not modulate the gate timing control signals. (S313, S314, and S316) Accordingly, since a voltage having an opposite polarity is not charged in the liquid crystal cell, the amount of the data voltage charged in the liquid crystal cell is not decreased. On the other hand, if the currently input data is data that is likely to generate DC image sticking and the current frame period is an Nth-multiple frame period, the present invention controls the polarity of the data voltage with the second polarity control signal FGDPOL and therefore modulates the gate timing control signals in the manner shown in FIG. 28 or FIG. 29. (S313, S315, and S317) Accordingly, the amount of data voltage charged in the liquid crystal cell is decreased due to a charge of a voltage having a reverse polarity stored in the liquid crystal cell.

Figure 32:
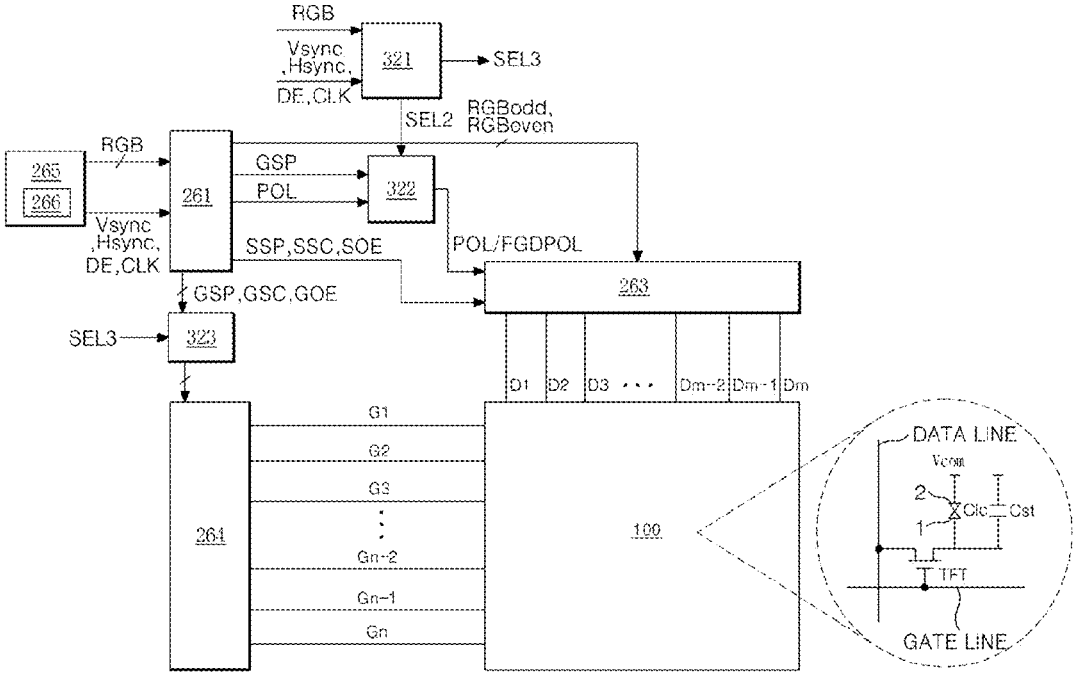
FIG. 32 is a block diagram illustrating an exemplary liquid crystal display according to the seventh embodiment of the present invention.

FIG. 32 shows an exemplary liquid crystal display according to the seventh embodiment of the present invention. As shown in FIG. 21, the liquid crystal display according to the seventh embodiment of the present invention include a video signal source 265, a liquid crystal display panel 100, an image analyzing circuit 321, a timing controller 261, a first logic circuit 322, a second logic circuit 323, a data driving circuit 263, and a gate driving circuit 264. In this embodiment, the video signal source 265, the liquid crystal display panel 100, the timing controller 261, the data driving circuit 263, and the gate driving circuit 264 may be implemented in substantially the same manner as described above for the sixth embodiment. Thus, the same reference numerals are given to the same components and a detail description thereof is omitted.

The image analyzing circuit 321 determines whether the digital video data of the currently input image is data that is likely to generate DC image sticking. The image analyzing circuit 321 compares the data between adjacent lines in one frame image and determines the currently input data to be interlace data if the data between the lines is not less than a predetermined threshold. Further, the image analyzing circuit 321 compares the data of each pixel by the unit of a frame and detects a moving picture in a display image and the speed of the moving the picture. If the moving picture moves at a pre-set speed, the frame data with the moving picture is deemed to be scroll data. As a result of the image analysis, the image analyzing circuit 321 generates a second and third selection signals SEL2 and SEL3 which indicates the interlace data and the scroll data.

The principles of the operation of the first polarity control signal POL and the second polarity control signal FGDPOL may be explained using FIG. 16. As shown in FIG. 16, the first logic circuit 322 supplies a first polarity control signal POL to the data driving circuit 263 in response to a first logic value of the second selection signal SEL2 at a period when data that does not generate DC image sticking are input. On the other hand, the first logic circuit 322 supplies the second polarity control signal FGDPOL to the data driving circuit 263 in response to a second logic value of the second selection signal SEL2 at a period when data that is likely to generate DC image sticking are input.

The second logic circuit 323 supplies unmodulated gate timing control signals to the gate driving circuit 264 in response to a first logic value of the third selection signal SEL3 at a period when data that does not generate DC image sticking are input. On the other hand, the second logic circuit 203 modulates the gate timing control signals, as shown in FIG. 28 or 29, to supply them to the gate driving circuit 264 in response to the third selection signal SEL3 at the Nth-multiple frame period when data that is likely to generate DC image sticking are input. The timing controller 261, the image analyzing circuit 321, the first logic circuit 322, and the second logic circuit 323 may be integrated into one chip.

Figure 33:
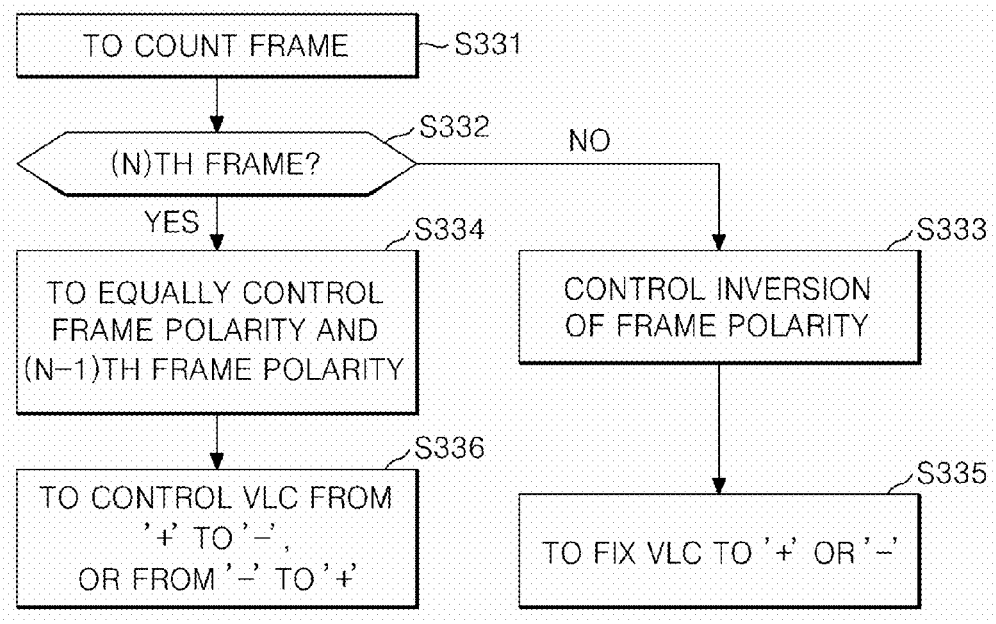
FIG. 33 is a flow chart illustrating an exemplary method of driving a liquid crystal display according to a eighth embodiment of the present invention.

FIG. 33 is a flow chart illustrating an exemplary method of driving a liquid crystal display according to an eighth embodiment of the present invention. As shown in FIG. 33, the exemplary method of driving the liquid crystal display according to the eighth embodiment of the present invention counts a timing signal input with the digital video data to determine the frame period. (S331) At each frame period, the frame polarity is inverted to invert the polarity of the data voltage, which is charged in the liquid crystal cell Clc at each frame period. (S332 and S333). At every Nth-multiple frame period, the frame polarity is controlled to be the same polarity as the previous frame period. (S332 and S334)

A frame polarity refers to a polarity of the liquid crystal cells of one screen, which is determined by a polarity control signal POL within each frame period (i.e., a polarity of a data voltage of one screen). The polarity control signal POL is generated from a timing controller that controls an operation timing of the data driving circuit and the gate driving circuit. The logic of the polarity control signal POL is inverted at each horizontal period (e.g., 1-dot) or each two horizontal periods (e.g., 2-dot). Accordingly, a data voltage, which is charged to a liquid crystal cell for (N−1) frame periods prior to the (N)th frame period, has a polarity which is inverted for each frame period. (S332 and S333) Furthermore, a data voltage charged in the liquid crystal cell at the (N−1)th frame period and the (N)th frame period is fixed to any one polarity. (S332 and S334) In the same manner, a data voltage charged in the liquid crystal cell at (N−1) frame periods prior to a (2N)th frame period has a polarity which is inverted at each frame period. (S332 and S333) Furthermore, a data voltage charged in the liquid crystal cell at the (2N−1)th frame period and the (2N)th frame period is fixed to any one polarity. (S332 and S334)

The exemplary method of driving the liquid crystal display according to the eighth embodiment of the present invention synchronizes a data voltage with a scanning pulse at each frame period for (N−1) frame periods prior to the Nth-multiple frame period to fix a polarity of a data voltage charged in the liquid crystal cell at each horizontal period to any one polarity. (S335) On the other hand, the exemplary method of driving the liquid crystal display according to the eighth embodiment of the present invention controls a phase of a data voltage and a phase of a scanning pulse to be different from each other in the Nth-multiple frame period to control a polarity of a data voltage charged in the liquid crystal cell at each horizontal period from positive (+) to negative (−), or from negative (−) to positive (+). (S336)

As a result, an amount of a data voltage charged in the liquid crystal cell at the (N)th frame period is reduced compared to an amount of a data voltage charged in the liquid crystal cell at each horizontal period at each frame period for (N−1) frame periods prior to the (N)th frame period. In the same manner, an amount of a data voltage charged in the liquid crystal cell at each horizontal period in the (2N)th frame period is also reduced compared to an amount of a data voltage charged in the liquid crystal cell at each horizontal period at each frame period for (N−1) frame periods prior to the (2N)th frame period. The numeral reference "Vlc" in FIG. 33 refers to a voltage of the liquid crystal cell charged by a data voltage.

Figure 34:
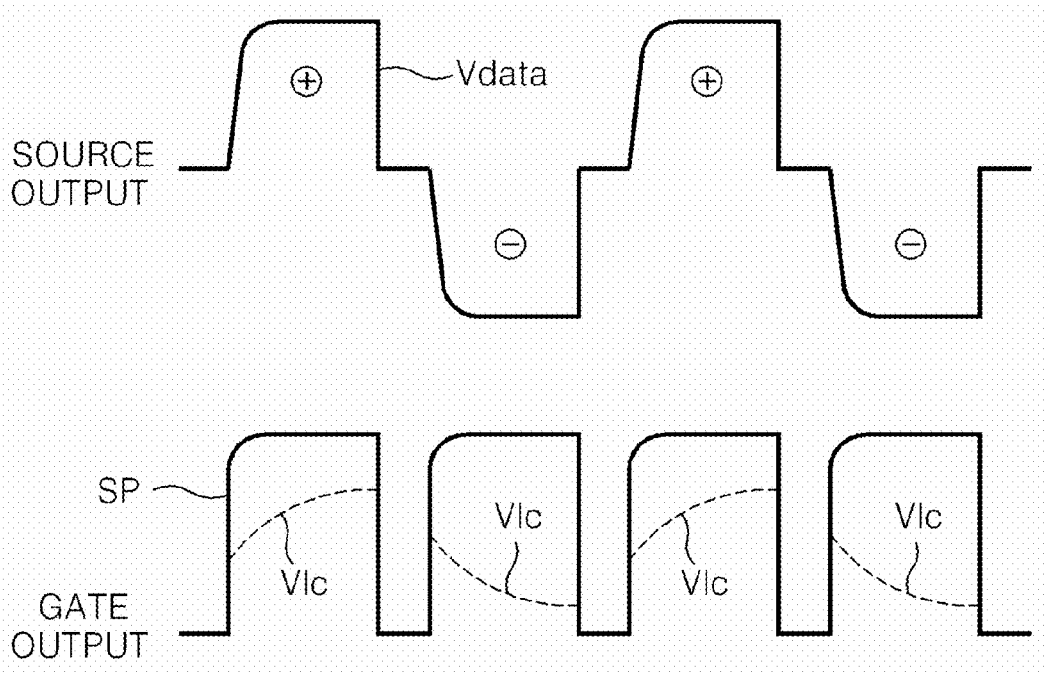
FIG. 34 is an exemplary waveform diagram showing a data voltage and a scanning pulse at frame periods other than Nth-multiple frame periods.

FIG. 34 shows exemplary waveforms of a data voltage and a scanning pulse which are generated for (N−1) frame periods prior to the (N)th frame period in the exemplary method of driving the liquid crystal display according to the eighth embodiment of the present invention. As shown in FIG. 34, "Source Output" refers to a waveform of a data voltage Vdata, which is output from the data driving circuit, and the polarity of the data voltage Vdata is inverted for each frame period. "Gate Output" refers to a waveform of a scanning pulse SP, which is output from the gate driving circuit, and a pulse width of one scanning pulse SP corresponds to about each horizontal period. As shown in FIG. 34, a phase of a waveform of the data voltage Vdata is equal to a phase of a waveform of the scanning pulse SP at each frame period for (N−1) frame periods prior to the (N)th frame period. Accordingly, the polarity of a voltage Vlc of the liquid crystal cell is fixed to be either positive or negative for each horizontal period at each frame period prior to the (N)th frame period.

Figure 35:
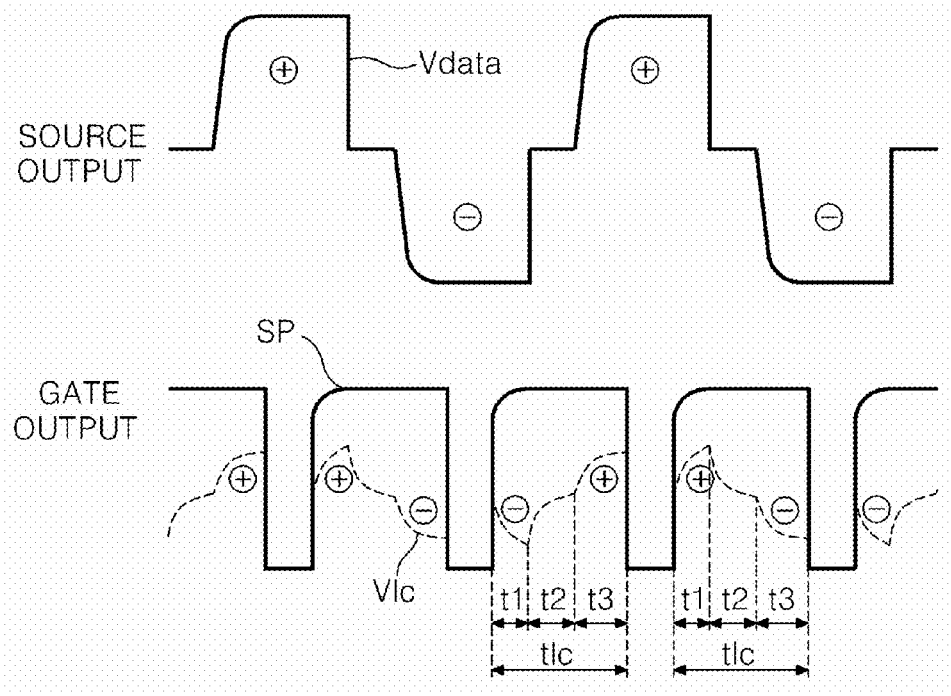
FIG. 35 an exemplary waveform diagram showing a data voltage and a scanning pulse during the Nth-multiple frame period in the exemplary method of driving the liquid crystal display according to the eighth embodiment of the present invention.

FIG. 35 shows exemplary waveforms of a data voltage and a scanning pulse generated at the Nth-multiple frame period, such as the (N)th frame period, the (2N)th frame period, and so on, in the exemplary method of driving the liquid crystal display according to the eighth embodiment of the present invention. As shown in FIG. 35, "Source Output" refers to a waveform of a data voltage Vdata, which is output from the data driving circuit, and the data voltage Vdata is generated to have the same polarity as the frame period prior to the Nth-multiple frame period. "Gate Output" refers to a waveform of a scanning pulse SP, which is output from the gate driving circuit, and a pulse width of one scanning pulse SP corresponds to about each horizontal period.

As shown in FIG. 35, the phase of the data voltage Vdata and the phase of the scanning pulse SP are controlled to be different from each other for the frame period of the multiple of N. Accordingly, a voltage Vlc of the liquid crystal cell is changed from positive (+) to negative (−), or from negative (−) to positive (+) for each horizontal period in the Nth-multiple frame period. As shown in FIG. 35, the reference numeral "tlc" refers to each horizontal period when the data voltage Vdata is charged in the liquid crystal cell. Each horizontal period tlc includes a first period t1 when a data voltage of the previous line is charged, a second period t2 when a charge share voltage or a common voltage Vcom between the positive data voltage and the negative data voltage is charged, and a third period t3 when a data voltage having a different polarity than the data voltage of the previous line is charged. In this case, the charge share voltage is a voltage that is an average value of the positive data voltage and the negative data voltage generated by a short circuit between two adjacent data lines, one to which the positive data voltage is supplied in the high logic section of the source output enable signal SOE, and another to which the negative data voltage is supplied. When "tlc" is defined as 100%, the first period t1 is about 30% to 40%, the second period t2 is about 0% to 20%, and the third period t3 is about 40% to 60%. These values of t1, t2, and t3 were obtained based on experimentation of the DC image sticking phenomenon. The obtained values of t1, t2, and t3 were found to be an optimum time when DC image sticking did not occur and were found to reduce an amount of voltage charged in a liquid crystal cell, thereby increasing picture quality in the Nth-multiple frame period.

The exemplary method of driving the liquid crystal display according to the eighth embodiment of the present invention controls an output of the gate driving circuit using the first gate shift clock signal GSC1 and the first gate output enable signal GOE1, which have synchronized phases, in order to synchronize a phase of the data voltage with a phase of the scanning pulse at (N−1) frame periods prior to the Nth-multiple frame period. On the other hand, in order to differentiate a phase of the data voltage and a phase of the scanning pulse at the Nth-multiple frame period, the exemplary method of driving the liquid crystal display according to the eighth embodiment of the present invention modulates the gate timing control signals to control an output of the gate driving circuit using the second gate shift clock signal GSC2 and the second gate output enable signal GOE2 at the Nth-multiple frame period. The second gate shift clock signal GSC2 is generated with timing that is faster than the first gate shift clock signal GSC1, and the second gate output enable signal GOE2 is generated with timing that is faster than the first gate output enable signal GOE1.

The exemplary liquid crystal display according to the eighth embodiment of the present invention includes a driving circuit and a logic circuit as shown in FIG. 26B. The second logic circuit 267 of the liquid crystal display according to the eighth embodiment of the present invention generates the second gate shift clock signal GSC2 and the second gate output enable signal GOE2, both of which have a faster phase than the first gate shift clock signal GSC1 and the first gate output enable signal GOE1, using the gate start pulse GSP, the first gate shift clock signal GSC1, and the first gate output enable signal GOE1 in order to decrease a charge amount of a data voltage of the liquid crystal cell in the frame period of the multiple of N.

Figure 36:
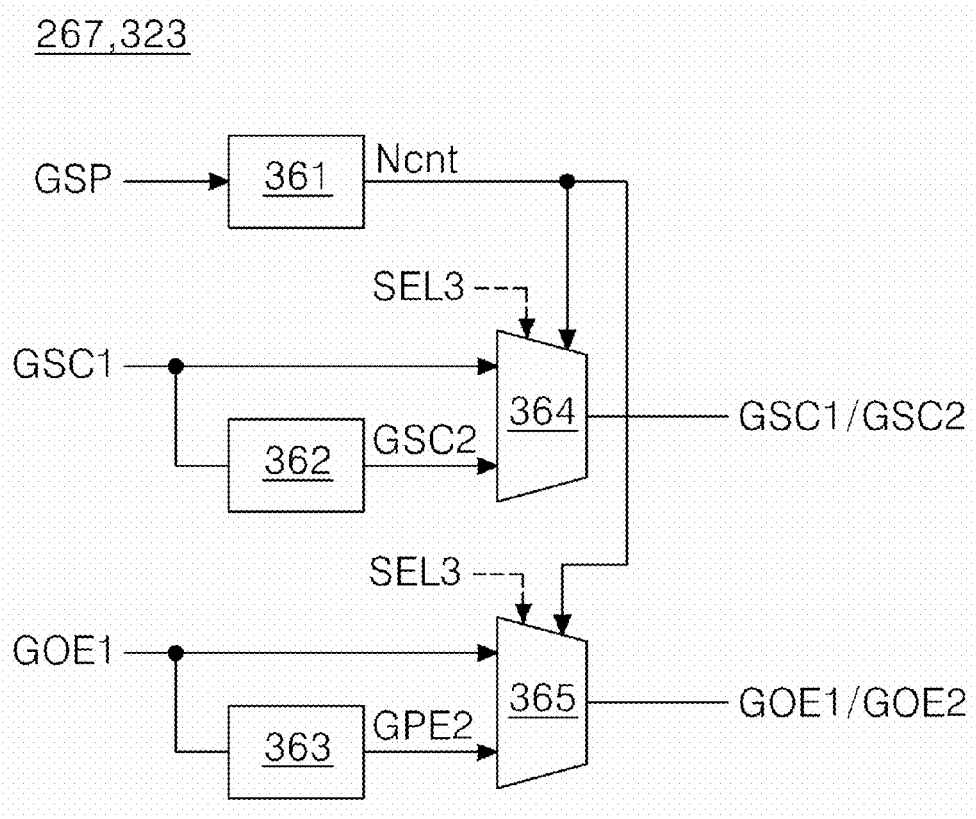
FIG. 36 is a block diagram illustrating an exemplary second logic circuit shown in FIG. 26 and FIG. 32.

FIG. 36 shows an exemplary logic circuit for controlling the phase of the gate shift clock signal and the gate output enable signal. As shown in FIG. 36, the second logic circuit 267 (or 323) of the liquid crystal display according to the eighth embodiment of the present invention includes a frame counter 361, a first phase adjuster 362, a second phase adjuster 363, and a first and second multiplexer 364 and 365. The frame counter 361 counts the gate start pulse GSP to generate N frame information Ncnt that indicates the Nth-multiple frame period. The first phase adjuster 362 rapidly adjusts a phase of the first gate shift clock signal GSC1 to generate the second gate shift clock signal GSC2. The second phase adjuster 363 rapidly adjusts a phase of the first gate output enable signal GOE1 to generate the second gate output enable signal GOE2.

The first multiplexer 364 outputs the first gate shift clock signal GSC1 for (N−1) frame periods prior to the Nth-multiple frame period and outputs the second gate shift clock signal GSC2 at the Nth-multiple frame period in response to N frame information Ncnt. The second multiplexer 365 outputs the first gate output enable signal GOE1 for (N−1) frame periods prior to the Nth-multiple frame period and outputs the second gate output enable signal GOE2 at the Nth-multiple frame period in response to N frame information Ncnt. The first and second multiplexers 364 and 365 select between the gate shift clock signals GSC1 and GSC2 and between the gate output enable signals GOE1 and GOE2, respectively, in accordance with the third selection signal SEL3 generated based on the result of the input image determination as described above.

Figure 37:
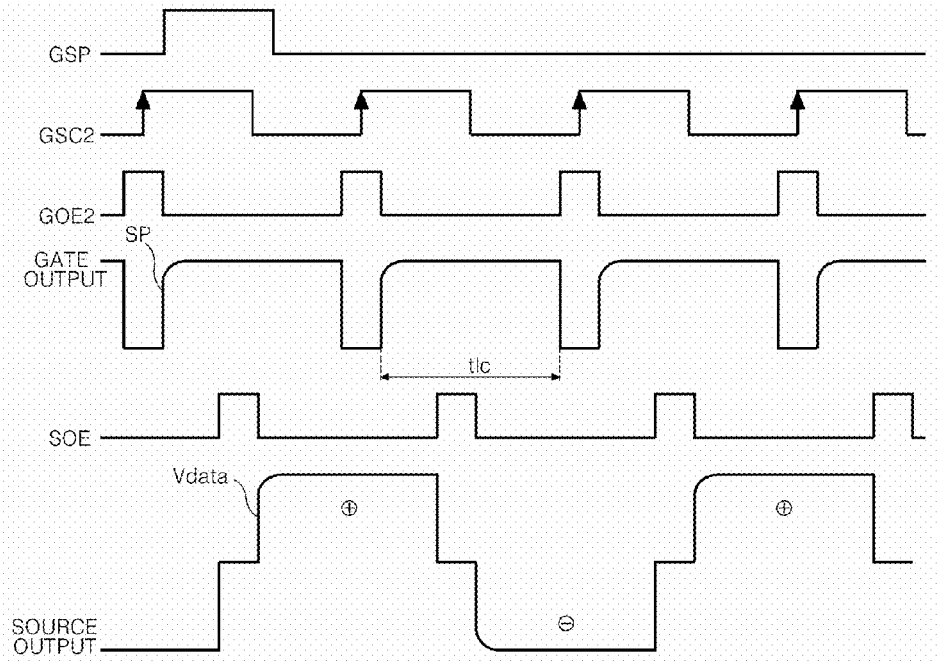
FIG. 37 is an exemplary waveform diagram showing data timing control signals and gate timing control signals during Nth-multiple frame periods in the exemplary method of driving the liquid crystal display according to the eighth embodiment of the present invention.

FIG. 37 is a waveform diagram showing exemplary data timing control signals and gate timing control signals for the frame period of the multiple of N in the method of driving the liquid crystal display according to the third embodiment of the present invention. As shown in FIG. 37, the second logic circuit 267 outputs the second shift clock signal GSC2 having a fast phase, and outputs the second gate output enable signal GOE2 having a fast phase during the Nth-multiple frame period. Accordingly, a phase of the scanning pulse SP is different from a phase of the data voltage Vdata during the Nth-multiple frame period. The liquid crystal cell is charged with a data voltage of the previous line at each horizontal period in the Nth-multiple frame period. Thereafter, the liquid crystal cell is charged with the data voltage Vdata, which is to be displayed, having a polarity that is opposite to the data voltage of the previous line. As a result, an amount voltage charged in the liquid crystal cell is decreased at the Nth-multiple frame period.

Figure 38:
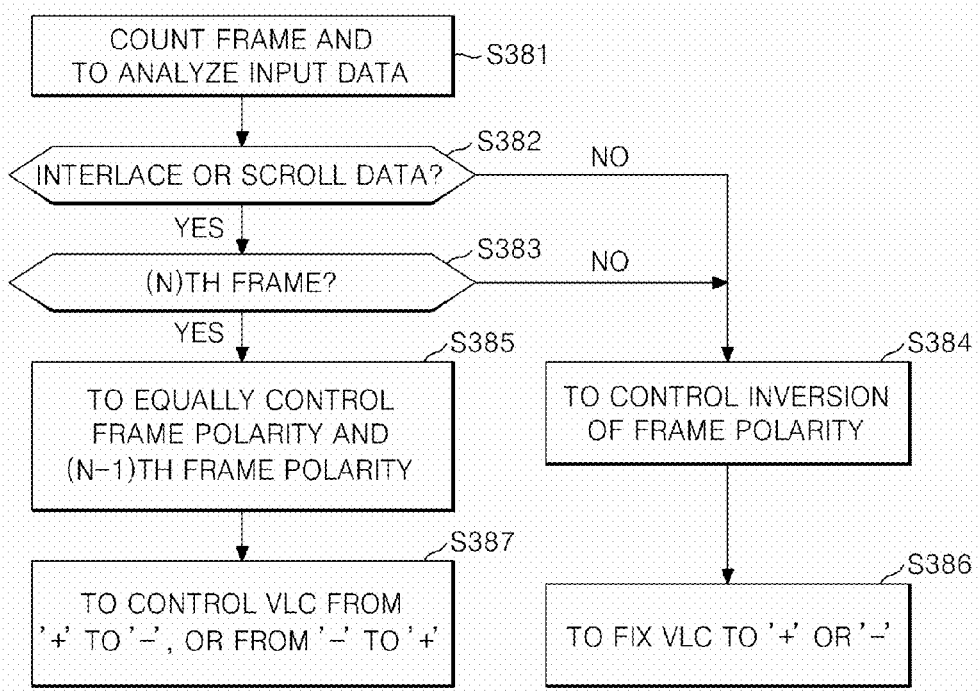
FIG. 38 is flow chart illustrating an exemplary method of driving a liquid crystal display according to a ninth embodiment of the present invention.

FIG. 38 is a flow chart illustrating an exemplary method of driving a liquid crystal display according to a ninth embodiment of the present invention. As shown in FIG. 38, the exemplary method of driving the liquid crystal display according to the ninth embodiment of the present invention analyzes the input data to determine whether the input data is data that is likely to generate DC image sticking, such as interlace data or scroll data, and counts frame periods. (S381 and S382) The present invention repeatedly compares two line data using the line memory and the comparator. If line data from two adjacent lines are more than a predetermined threshold, the present invention deems the adjacent two line data as interlace data. The present invention also compares the previous frame images with the current frame images using the frame memory and the comparator to detect a portion that moves at a constant speed in the current frame, thereby determining scroll data.

If the currently input data is data that do not generate DC image sticking and a current frame period is not an Nth-multiple frame period, the present invention inverts the frame polarity at every frame period and fixes a polarity of a liquid crystal cell voltage Vlc to any one polarity within each horizontal period. (S383, S384, and S386) On the other hand, if the currently input data is data that is likely to generate DC image sticking and a current frame period is an Nth-multiple frame period, the present invention controls the frame polarity of the Nth-multiple frame period to be the same as the frame polarity of the previous frame period and inverts a polarity of the liquid crystal cell voltage Vlc within each horizontal period. (S383, S385, and S387)

The exemplary method of driving a liquid crystal display device according to the ninth embodiment of the present invention may be implemented in the manner described above for FIG. 32. As shown in FIG. 32, the image analyzing circuit 321 of the liquid crystal display according to the ninth embodiment of the present invention determines whether the digital video data RGB of the currently input image is data that is likely to generate DC image sticking. The image analyzing circuit 321 compares the data between adjacent lines in one frame image and deems the currently input data to be interlace data if the data between the lines is not less than a predetermined threshold. Additionally, the image analyzing circuit 321 compares the data of each pixel by the unit of a frame and detects a moving picture in a display image and the speed of the moving picture. If the moving picture moves at a pre-set speed, the frame data with the moving picture is deemed to be scroll data. From the result of the image analysis, the image analyzing circuit 321 generates the second and third selection signals SEL2 and SEL3 that indicate the presence of data that is likely to generate DC image sticking, such as interlace data and scroll data, and controls the first and second logic circuits 322 and 323 using the selection signals SEL2 and SEL3.

The second logic circuit 323 supplies the first gate shift clock signal GSC1 and the first gate output enable signal GOE1 to the gate driving circuit 264 in response to the third selection signal SEL3 at a period when data that does not generate DC image sticking are input. Additionally, the second logic circuit 323 supplies the second gate shift clock signal GSC2 and the second gate output enable signal GOE2 to the gate driving circuit 264 in response to the third selection signal SEL3 at a period when data that is likely to generate DC image sticking are input.

Figure 39A:
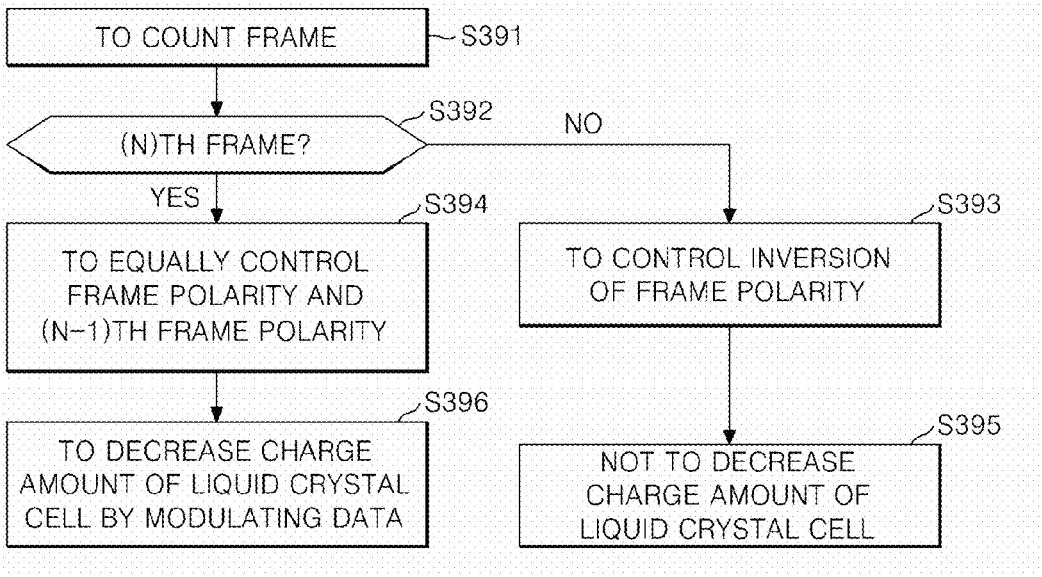
FIG. 39A is a flow chart illustrating an exemplary method of driving a liquid crystal display according to a tenth embodiment of the present invention.

FIG. 39A is a flow diagram illustrating an exemplary method of driving a liquid crystal display according to a tenth embodiment of the present invention. As shown in FIG. 39A, the exemplary method of driving the liquid crystal display according to the tenth embodiment of the present invention counts a timing signal input with digital video data to count frame periods. (S391) Next, the exemplary method of driving the liquid crystal display according to the tenth embodiment of the present invention inverts a frame polarity at each frame period to invert a polarity of a data voltage charged in the liquid crystal cell Clc at each frame period, and maintains a frame polarity of an Nth-multiple frame period to be the same as a frame polarity of the previous frame period by the use of a first polarity control signal POL and a second polarity control signal FGDPOL. Because the generation and use of the first and second polarity control signals POL and FGDPOL have already been described above in reference to FIG. 16, a detailed description thereof is omitted. Accordingly, a polarity of a data voltage charged in the liquid crystal cell for (N−1) frame periods prior to the Nth-multiple frame period is inverted at each frame period (S392 and S393) and polarities of a data voltage charged in the liquid crystal cell during the Nth-multiple frame periods and the previous frame period are controlled to be the same. (S392 and S394)

The exemplary method of driving the liquid crystal display according to the tenth embodiment of the present invention does not reduce the charge amount of the liquid crystal cell in frame periods other than the Nth-multiple frame periods. (S395) On the other hand, in order to compensate for an overcharge of the liquid crystal cell during the Nth-multiple frame periods due to the charging of a data voltages having the same polarity for two frame periods, the exemplary method of driving the liquid crystal display according to the tenth embodiment of the present invention temporarily modulates the data voltage to decrease the charge amount of the liquid crystal cell during the Nth-multiple frame periods. (S396)

Figure 39B:
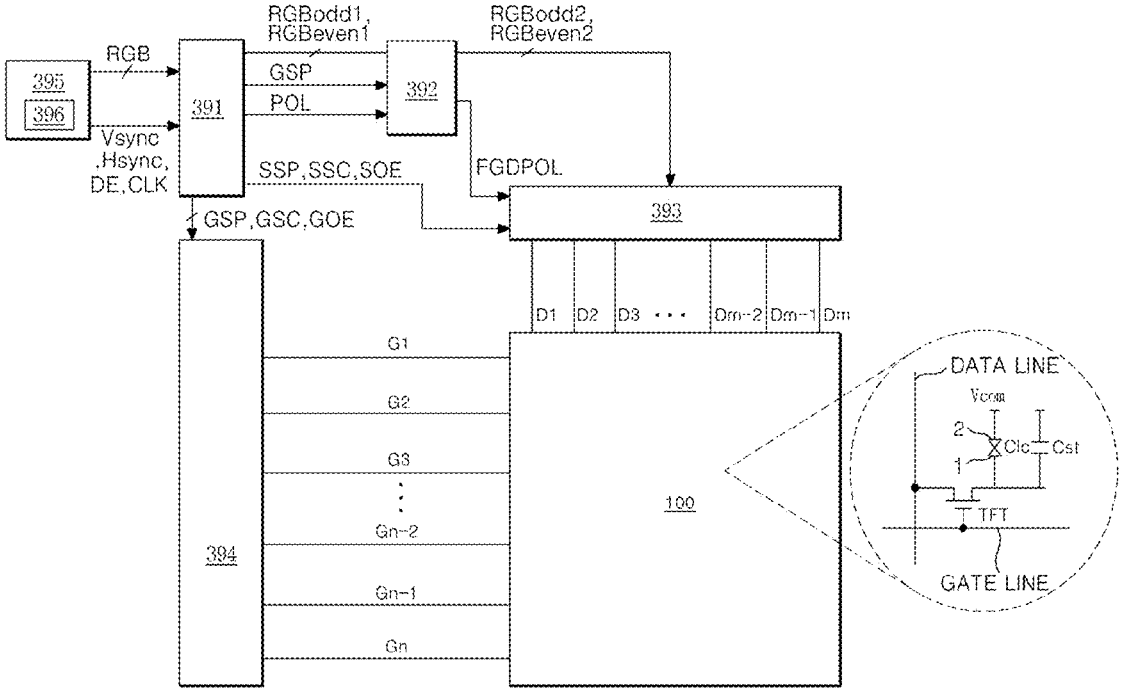
FIG. 39B is a block diagram illustrating an exemplary liquid crystal display according to the tenth embodiment of the present invention.

FIG. 39B illustrates an exemplary liquid crystal display according to the tenth embodiment of the present invention. As shown in FIG. 39B, the exemplary liquid crystal display according to the tenth embodiment of the present invention includes a liquid crystal display panel 100, a timing controller 391, a logic circuit 392, a data driving circuit 393, and a gate driving circuit 394. The liquid crystal display panel 100 is substantially the same as the liquid crystal display panel 100 described above. Accordingly, a detailed description thereto is omitted.

The basic functions of the timing controller 391 are substantially the same as the time controller 321 of FIG. 32 as described above. In addition to the basic functions as described above, the timing controller 391 divides input digital video data RGB into odd-numbered pixel digital video data RGBodd1 and even-numbered pixel digital video data RGBeven1 to reduce by half a transmission frequency of data with which the logic circuit 392 are supplied. In order to prevent a residual image (i.e., DC image sticking) and flicker, the logic circuit 392 receives the gate start pulse GSP and the first polarity control signal POL to generate the second polarity control signal FGDPOL of which a polarity is inverted at each frame period for (N−1) frame periods prior to the Nth-multiple frame period and a phase is the same in the Nth-multiple frame period and the previous frame period. The logic circuit 392 may selectively supply either the first polarity control signal POL or the second polarity control signal FGDPOL to the data driving circuit 393. The timing controller 391 and the logic circuit 392 may be integrated into one chip.

The principle of operation of the first and second polarity control signals POL and FGDPOL is described above with reference to FIG. 16. As shown in FIG. 16, the first polarity control signal POL has its logic inverted at each horizontal period (e.g., 1-dot) or at every two horizontal periods (e.g., 2-dot) and the phase is also inverted at each frame period in order to invert the polarity of the data voltage at each frame period. In order to maintain a polarity of a data voltage with the same polarity pattern as in the previous frame period at the Nth-multiple frame period, the second polarity control signal FGDPOL is generated to have the same phase as the first polarity control signal POL at the frame period prior to the Nth-multiple frame period and is generated to have a phase that is opposite of the first polarity control signal POL at the Nth-multiple frame period. Furthermore, the logic circuit 392 modulates the data RGBodd1 and RGBeven1 downward in the Nth-multiple frame period. For example, the logic circuit 392 modulates a data input at the Nth-multiple frame period having a gray scale value of "191" down to "127."

The data driving circuit 393 latches digital video data RGBodd2 and RGBeven2 output from the logic circuit 392 under the control of the timing controller 391. The data driving circuit 393 converts the digital video data RGBodd2 and RGBeven2 into an analog positive/negative gamma compensation voltage in accordance with the second polarity control signal FGDPOL to generate a positive/negative analog data voltage and supply the data voltages to the data lines D1 to Dm. The gate driving circuit 394 includes a plurality of gate drive ICs of which each includes a shift register, a level shifter for converting the swing width of the output signal of the shift register into a swing width that is suitable for driving the TFT of the liquid crystal cell, and an output buffer connected between the level shifter and the gate line G1 to Gn. The gate driving circuit 394 sequentially supplies a scanning pulse to the gate lines in response to the gate timing control signals.

The liquid crystal display according to the tenth embodiment of the present invention further includes a video signal source 395 that supplies the digital video data RGB and the timing signals Vsync, Hsync, DE, and CLK to the timing controller 391. The video signal source 395 includes a broadcasting signal, an external device interface circuit, a graphic processing circuit, a line memory 396, and other components. The video signal source 395 extracts the video data from an image source input from an external device or the broadcasting signal and converts the video data into the digital data to supply to the timing controller 391. An interlaced broadcasting signal received in the video signal source 395 is stored in the line memory 396. The video data of the interlaced broadcasting signal exist only in the odd-numbered lines at odd-numbered frame periods and only in even-numbered lines at even-numbered frame periods. Accordingly, if the interlaced broadcasting signal is received, the video signal source 395 generates black data value or the average value of the effective data stored in the line memory 396 as the even-numbered line data for the odd-numbered frame periods and as odd-numbered line data for the even-numbered frame periods. The video signal source 395 supplies the timing signals Vsync, Hsync, DE, CLK together with the digital video data to the timing controller 391. Additionally, the video signal source 395 supplies power to circuits such as the timing controller 391, logic circuit 392, the data driving circuit 393, the gate driving circuit 394, a DC-DC converter for generating a drive voltage of the liquid crystal display panel, and an inverter for lighting the light source of a backlight unit, and other components to operate the liquid crystal display device.

Figure 40:
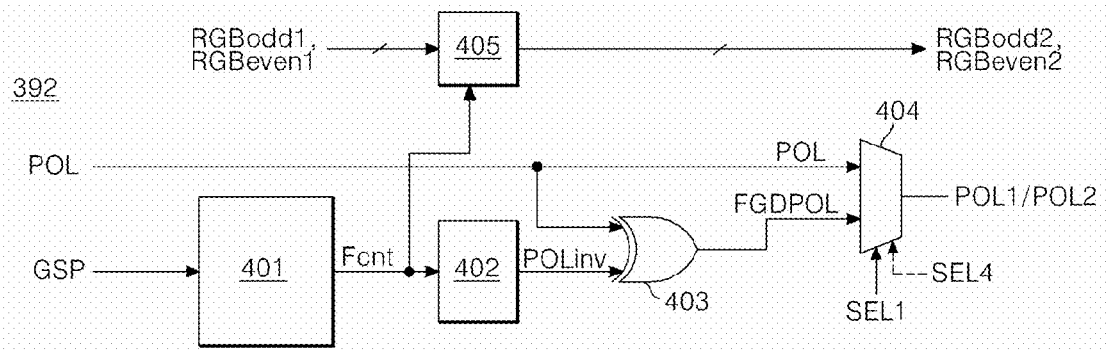
FIG. 40 is a block diagram illustrating an exemplary logic circuit according to the tenth embodiment of the present invention.

FIG. 40 is an exemplary circuit diagram illustrating a logic circuit according to the tenth embodiment of the present invention. As shown in FIG. 40, the logic circuit 392 includes a frame counter 401, a POL inverter 402, an exclusive OR gate (hereinafter, referred to as "XOR gate") 403, a multiplexer 404, and a data modulator 405.

The frame counter 401 outputs a frame count information Fcnt that indicates the number of frames by counting the gate start pulse GSP, which is generated one time during one frame period and which is generated at the same time as the start of the frame period. The POL inverter 402 receives the frame count information Fcnt from the frame counter 401 and performs a modulus division on the frame count information Fcnt with N. The POL inverter 402 inverts the logic when the remainder of the modulus division operation becomes "0," thereby generating an output signal. The output signal is a POL inversion signal POLinv. As shown in FIG. 40, the output signal maintains the low logic (or high logic) for (N−1) frame periods prior to the Nth-multiple frame period and is inverted to the high logic (or low logic) at the start time of the Nth-multiple frame period. Accordingly, the logic of the POL inversion signal POLinv output from the POL inverter 402 is inverted at every Nth-multiple frame period. The POL inversion signal POLinv also indicates a start time of the Nth-multiple frame period.

The XOR 403 performs an exclusive OR operation of the first polarity control signal POL and the POL inversion signal POLinv to generate the second polarity control signal FGDPOL. As shown in FIG. 16, a polarity pattern of the second polarity control signal FGDPOL in the Nth-multiple frame period is maintained the same as that of the previous frame period and is inverted at every frame period other than the Nth-multiple frame period.

The multiplexer 404 selects between the first polarity control signal POL and the second polarity control signal FGD- POL under the control of a first selection signal SEL1. The first selection signal SEL1 may be determined by an option pin that is connected to a control terminal of the multiplexer 404. The option pin may be selectively connected to a ground voltage source GND or a power supply voltage Vcc by a manufacturer. For example, if the option pin is connected to the ground voltage source GND, the multiplexer 404 has the control terminal supplied with a first selection signal SEL1 of "0" to output the second polarity control signal FGDPOL. If the option pin is connected to the power supply voltage Vcc, the multiplexer 404 has the control terminal supplied with a first selection signal SEL1 of "1" to output the first polarity control signal POL. The liquid crystal display according to the tenth embodiment of the present invention connects a control terminal of the multiplexer 404 with a ground voltage source GND to allow the multiplexer 404 to output the second polarity control signal FGDPOL. The multiplexer 404 may select between the first and second polarity control signals POL and FGDPOL in accordance with a fourth selection signal SEL4 that is generated by a result of the judgment of the input image in another embodiment of the present invention.

The data modulator 405 receives the frame count information Fcnt from the frame counter 401 and performs a modulus division on the frame count information Fcnt with N to modulate the data RGBodd1 and RGBeven1 downward when the remainder of the modulus division operation becomes "0" (i.e., the current frame period is an Nth-multiple frame period). To this end, the data modulator 405 is enabled by the frame count information Fcnt at every Nth-multiple frame period and modulates the gray scale values of the data downward using a look-up table or a subtractor.

Figure 41A:
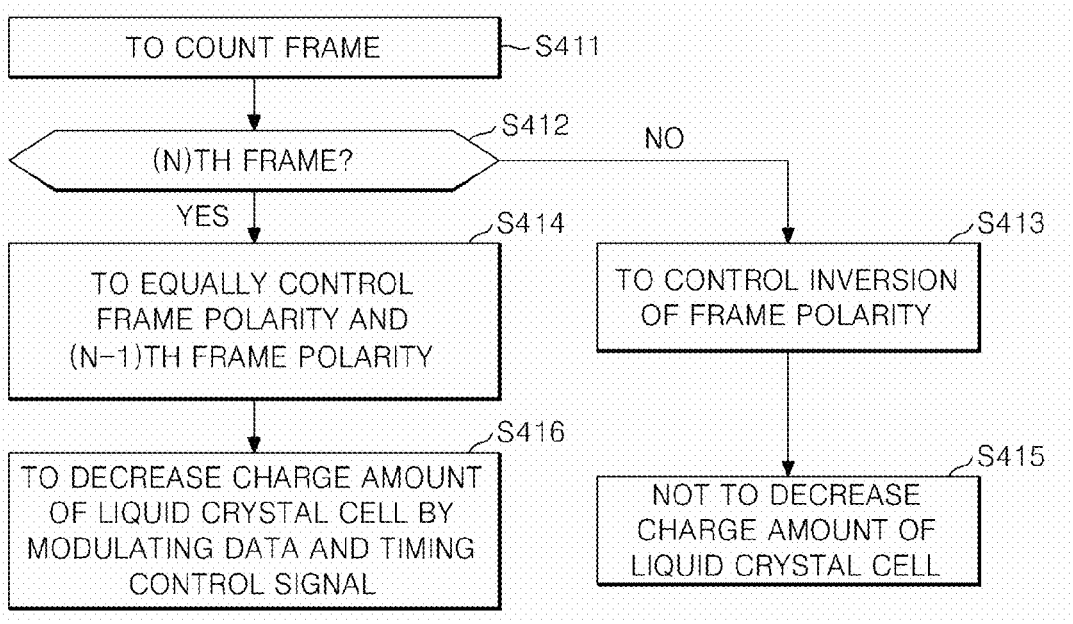
FIG. 41A is a flow chart illustrating an exemplary method of driving a liquid crystal display according to an eleventh embodiment of the present invention.

FIG. 41A is a flow diagram illustrating an exemplary method of driving a liquid crystal display according to an eleventh embodiment the present invention. As shown in FIG. 41A, the eleventh method of driving the liquid crystal display according to the tenth embodiment of the present invention counts a timing signal input with digital video data to count frame periods. (S411) Next, the method of driving the liquid crystal display according to the eleventh embodiment of the present invention inverts a frame polarity at each frame period to invert a polarity of a data voltage charged in the liquid crystal cell Clc at each frame period, and maintains a frame polarity at Nth-multiple frame periods the same as a frame polarity of the previous frame period. Accordingly, a polarity of a data voltage charged in the liquid crystal cell at (N−1) frame periods prior to the Nth-multiple frame period is inverted at each frame period (S412 and S413) and polarities of a data voltage charged in the liquid crystal cell at the Nth-multiple frame period and the previous frame period are controlled to be the same. (S412 and S414)

The exemplary method of driving the liquid crystal display according to the eleventh embodiment of the present invention does not reduce the charge amount of the liquid crystal cell during frame periods other than the Nth-multiple frame periods. (S415) On the other hand, in order to compensate for an overcharge of the liquid crystal cell at the Nth-multiple frame period due to the charging of data voltages having the same polarity for two frame periods, the exemplary method of driving the liquid crystal display according to the eleventh embodiment of the present invention modulates data downward, and pre-charges a liquid crystal display cell with a data voltage of the previous line having a polarity opposite to a polarity of a data voltage that is to be displayed by modulating a data timing control signal or a gate timing control signal to decrease the amount of voltage charged in the liquid crystal cell during the Nth-multiple frame period. (S416)

Figure 41B:
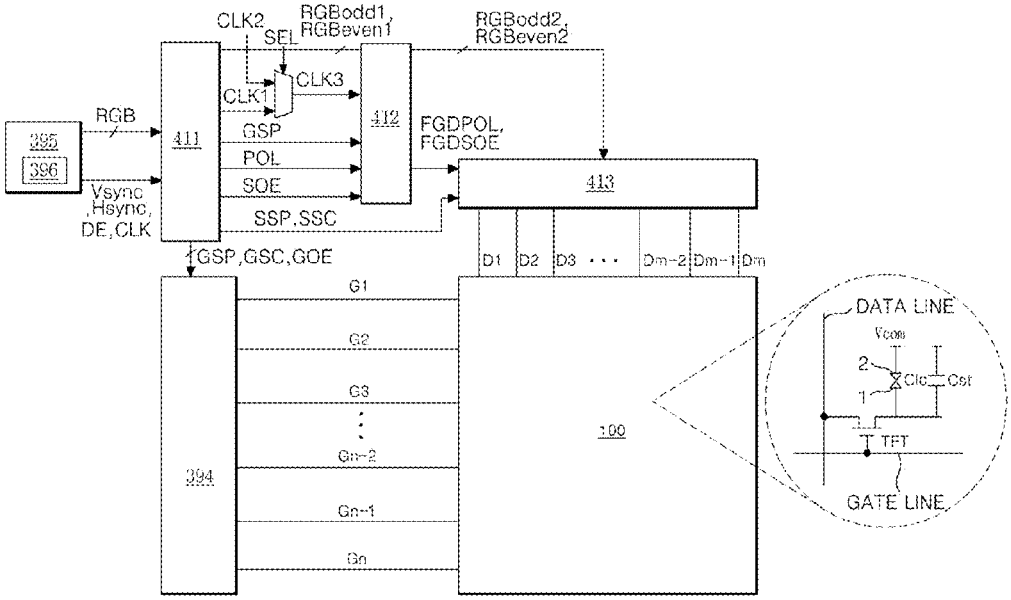
FIG. 41B is a block diagram illustrating an exemplary liquid crystal display according to the eleventh embodiment of the present invention.

FIG. 41B illustrates an exemplary liquid crystal display according to the eleventh embodiment of the present invention. As shown in FIG. 41B, the exemplary liquid crystal display according to the eleventh embodiment of the present invention includes a liquid crystal display panel 100, a timing controller 411, a logic circuit 412, a data driving circuit 413, and a gate driving circuit 394. In this embodiment, the video signal source 395, the liquid crystal display panel 100, and the gate driving circuit 394 are substantially the same as the foregoing tenth embodiment. Thus, the same reference numerals are given to the same components and a detail description thereof is omitted.

The basic functions of the timing controller 411 are substantially the same as the time controller 101 of FIG. 11 as described above. In addition, the timing controller 411 divides input digital video data RGB into odd-numbered pixel digital video data RGBodd1 and even-numbered pixel digital video data RGBeven1 to reduce by half a transmission frequency of data with which the logic circuit 412 are supplied. In order to prevent a residual image (i.e., DC image sticking) and flicker, the logic circuit 412 receives the gate start pulse GSP and the first polarity control signal POL to generate a second polarity control signal FGDPOL as shown in FIG. 16, and modulates the input data downward at every Nth-multiple frame. Additionally, the logic circuit 412 modulates the data timing signals to supply a data voltage of the previous line, which has a polarity that is opposite to a polarity of a data voltage to be displayed, to a liquid crystal cell at every Nth-multiple frame period to reduce an amount of voltage charged in the liquid crystal cells when the data voltage to be displayed is supplied thereto.

The exemplary liquid crystal display according to the eleventh embodiment of the present invention further includes a multiplexer that is connected between the timing controller 411 and the logic circuit 412 to generate a third clock signal CLK3. The multiplexer selects between a first clock signal CLK1, which is generated from an internal oscillator of the timing controller 411, and a second clock signal CLK2, which is supplied from an external oscillator, in accordance with a control signal supplied to its control terminal. Furthermore, the multiplexer supplies the selected clock signal CLK1 or CLK2 to the logic circuit 412 as the third clock signal CLK3. A control terminal of the multiplexer is connected to an option pin. The option pin may be selectively connected to a ground voltage source GND or a power supply voltage Vcc as designated by a manufacturer. For example, if the option pin is connected to the ground voltage source GND, the multiplexer has the control terminal supplied with a selection control signal SEL of "0" to output the first clock signal CLK1 as the third clock signal CLK3. If the option pin is connected to the power supply voltage Vcc, the multiplexer has the control terminal supplied with a selection control signal SEL of "1" to output the second clock signal CLK2 as the third clock signal CLK3.

The data driving circuit 413 latches digital video data RGBodd2 and RGBeven2, which are output from the logic circuit 412, under the control of the timing controller 411. The data driving circuit 413 converts the digital video data RGBodd2 and RGBeven2 into an analog positive/negative gamma compensation voltage in accordance with the second polarity control signal FGDPOL to generate a positive/negative analog data voltage and supply the data voltage to the data lines D1 to Dm. The timing controller 411 and the logic circuit 412 may be integrated into one chip.

Figure 42:
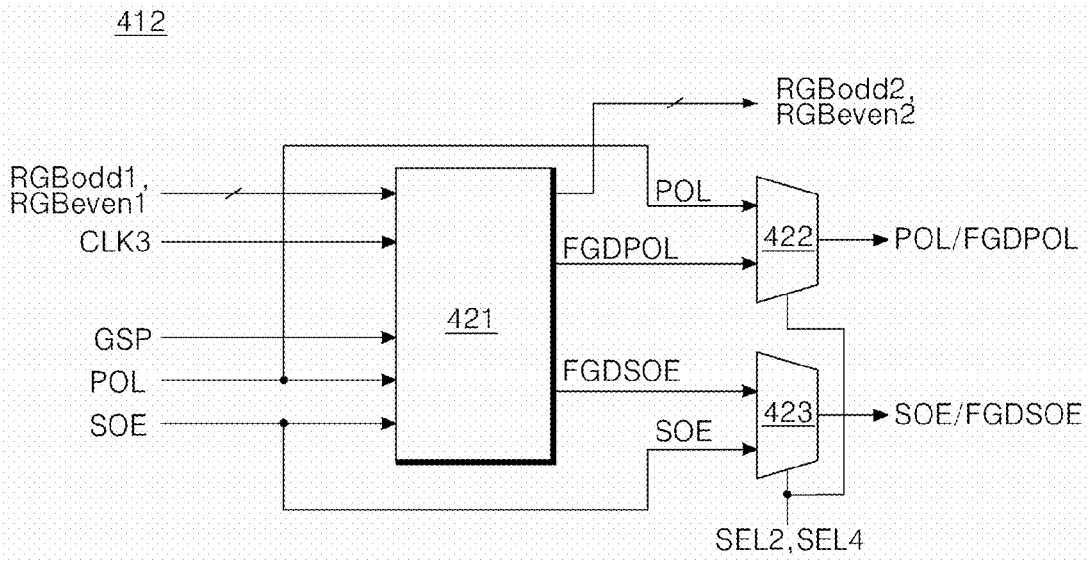
FIG. 42 is a block diagram showing an exemplary logic circuit according to the eleventh embodiment of the present invention.
Figure 43:
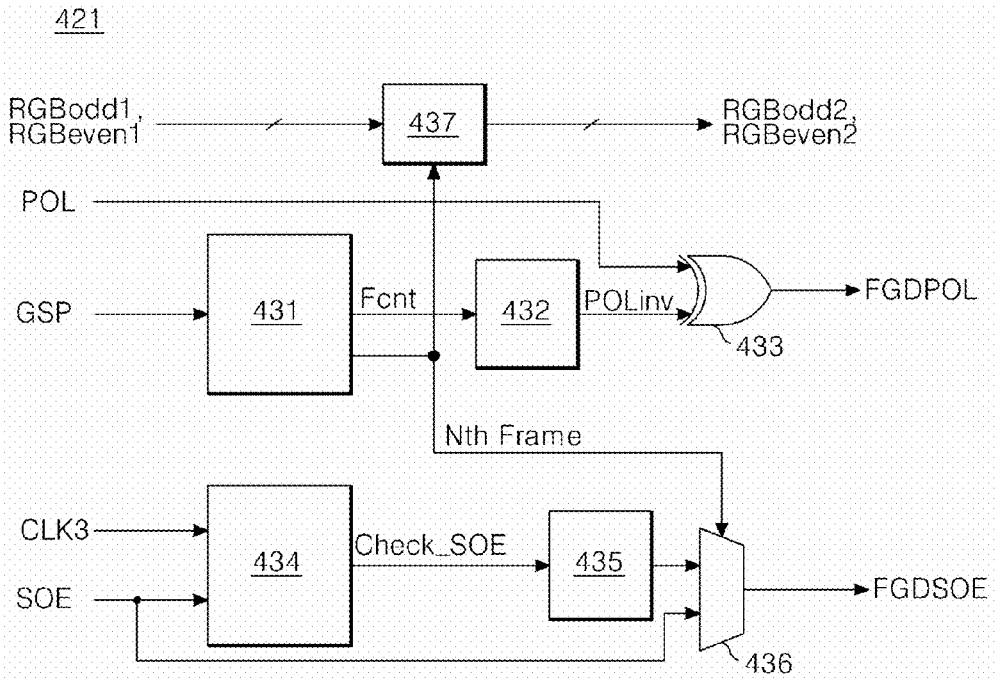
FIG. 43 is a block diagram illustrating an exemplary logic part shown in FIG. 42.

FIGS. 42 and 43 are circuit diagrams showing an exemplary logic circuit according to the eleventh embodiment of the present invention. As shown in FIG. 42, the logic circuit 412 includes a logic part 421, a first multiplexer 422, and a second multiplexer 423. The logic part 421 receives the gate start pulse GSP, the first polarity control signal POL, and the first source output enable signal SOE to modulate data downward at the Nth-multiple frame periods. The logic part 421 generates the second polarity control signal FGDPOL as shown in FIG. 16 and modulates a data timing signal in order to reduce the amount of voltage charged in the liquid crystal cell at every Nth-multiple frame period. A timing control signal, which is modulated by the logic part 421, is the first source output enable signal SOE. The logic part 421 adjusts a pulse width of the first source output enable signal SOE to become wide to generate a second source output enable signal FGDSOE at every Nth-multiple frame period.

The first multiplexer 422 selects between the first polarity control signal POL and the second polarity control signal FGDPOL in accordance with a logical value of a control signal with which a control terminal is applied. The second multiplexer 423 selects between the first source output enable signal SOE and the second source output enable signal FGDSOE in accordance with a logical value of a control signal with which a control terminal is applied. Control terminals of the first and second multiplexers are connected to an option pin. The option pin may be selectively connected to a ground voltage source GND or a power supply voltage Vcc as designated by a manufacturer. For example, if the option pin is connected to the ground voltage source GND, the first multiplexer 422 has the control terminal supplied with a selection control signal SEL2 of "0" to output the second polarity control signal FGDPOL, and the second multiplexer 423 has the control terminal supplied with the selection control signal SEL2 of "0" to output the second source output enable signal FGDSOE. If the option pin is connected to the power supply voltage Vcc, the first multiplexer 422 has the control terminal supplied with a selection control signal SEL2 of "1" to output the first polarity control signal POL1, and the second multiplexer 423 has the control terminal supplied with a selection control signal SEL2 of "1" to output the first source output enable signal SOE.

The exemplary liquid crystal display according to the eleventh embodiment of the present invention controls the first and second multiplexers 422 and 423 to supply the second polarity control signal FGDPOL in the manner shown in FIG. 16 and the second source output enable signal FGDSOE in the manner shown in FIG. 6 to the data driving circuit 413.

As shown in FIG. 43, the logic part 421 includes a frame counter 431, a POL inverter 432, a XOR gate 433, a SOE timing analyzer 434, a SOE adjuster 435, a third multiplexer 436, and a data modulator 437. The frame counter 431 outputs a frame count information Fcnt that indicates the number of frames of an image to be displayed on the liquid crystal display panel 100 in response to the gate start pulse GSP, which is generated one time during one frame period and which is generated at the same time as the start of the frame period. Furthermore, the frame counter 431 generates the (N)th frame information that indicates the Nth-multiple frame periods.

The POL inverter 432 receives the frame count information Fcnt from the frame counter 431 and performs a modulus division on the frame count information Fcnt with N to generate an output signal of which the logic is inverted when the remainder of the modulus division operation becomes "0." The output signal is a POL inversion signal POLinv. As shown in FIG. 16, the output signal maintains the high logic (or low logic) for (N−1) frame periods and inverted to the low logic (or high logic) at the start time of the (N)th frame period. Accordingly, the POL inversion signal POLinv, which is output from the POL inverter 432, indicates a start time of each Nth-multiple frame periods. The XOR 433 performs an exclusive OR operation of the first polarity control signal POL and the POL inversion signal POLinv to generate the second polarity control signal FGDPOL that has the same phase in an Nth-multiple frame period as the previous frame period, and of which the phase is inverted for every other frame periods.

The SOE timing analyzer 434 analyzes the first source output enable signal SOE by the third clock signal CLK3 unit to detect a rising edge, a pulse width, and a falling edge of the first source output enable signal SOE. The SOE adjuster 435 generates a pulse having a pulse width that is wider than that of the first source output enable signal SOE using SOE information from the SOE timing analyzer 434 at every Nth-multiple frame period. The third multiplexer 436 selects an output of the SOE adjuster 435 at every Nth-multiple frame period and selects the first source output enable signal SOE for all other frame periods to generate the second source output enable signal FGDSOE in accordance with the (N)th frame information from the frame counter 431.

The data modulator 437 receives the (N)th frame information Fcnt from the frame counter 431 to modulate the data RGBodd1 and RGBeven1 input at the Nth-multiple frame period downward. To this end, the data modulator 437 is enabled by the (N)th frame information at every Nth-multiple frame period and modulates data downward using a look-up table or a subtractor.

Figure 44:
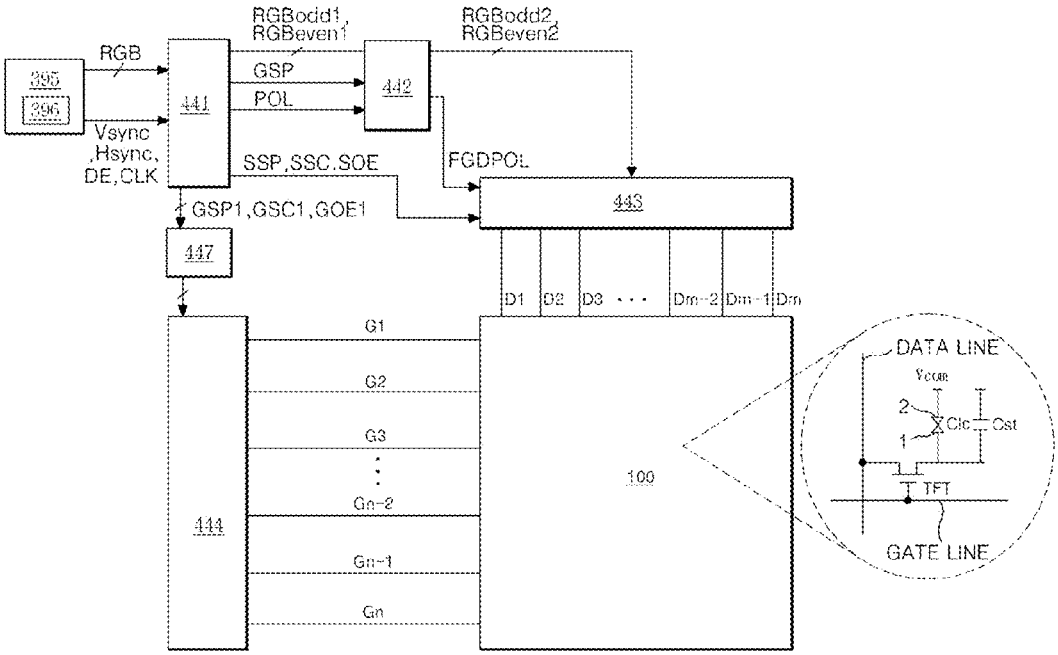
FIG. 44 is a block diagram illustrating an exemplary liquid crystal display according to a twelfth embodiment of the present invention.

FIG. 44 illustrates an exemplary liquid crystal display according to a twelfth embodiment of the present invention. As shown in FIG. 44, the exemplary liquid crystal display according to the twelfth embodiment of the present invention includes a liquid crystal display panel 100, a timing controller 441, a first logic circuit 442, a data driving circuit 443, a gate driving circuit 444, and a second logic circuit 447. In this embodiment, the video signal source 395 and the liquid crystal display panel 100 are substantially the same as the foregoing embodiments. Thus, the same reference numerals are given to the same components and a detail description thereof is omitted.

The basic functions of the timing controller 441 are substantially the same as the time controller 391 of FIG. 39B as described above. The first logic circuit 442 generates the second polarity control signal FGDPOL of which the phase is inverted at each frame period in (N−1) frame periods prior to the Nth-multiple frame period and a phase is the same in the Nth-multiple frame period as and the previous frame period using the circuit as shown in FIG. 40. The first logic circuit 442 modulates the data RGBodd1 and RGBeven1 downward at every Nth-multiple frame period.

The second logic circuit 447 modulates a gate timing control signal to reduce the amount of data voltage charged in the liquid crystal cell at every Nth-multiple frame period. The liquid crystal cell is pre-charged with a data voltage having an opposite polarity from the previous line by gate timing modulation, and then is charged with a data voltage to be displayed. Accordingly, the amount of data voltage charged in the liquid crystal display is reduced at every Nth-multiple frame period compared to the other frame periods.

The exemplary methods of modulating the gate timing signal includes the embodiments:

(1) A method of generating a pre GSP clock prior to the gate shift clock GSC, which is first generated, in the Nth-multiple frame periods and generating a pre GOE clock prior to the gate output enable signal GOE1, which is first generated, in the Nth-multiple frame periods.

(2) A method of widening a pulse width of the gate start pulse GSP1 for the frame period of the multiple of N.

(3) A method of increasing the timing of a phase of the gate shift clock signal GSC1 and the gate output enable signal GOE1.

The timing controller 441 synchronizes a second scanning pulse SP2 of the first and second scanning pulses SP1, SP2 of the first gate line, which receives the scanning pulse first, with the first data by delaying the digital video data RGBodd1 and RGBeven1, which are supplied to the data driving circuit 443 in the method of modulating a gate timing of (2). The timing controller 441, and the first and second logic circuits 442 and 447 may be integrated into one chip.

The data driving circuit 443 latches the digital video data RGBodd2 and RGBeven2. The data driving circuit 443 converts the digital video data RGBodd2 and RGBeven2 into an analog positive/negative gamma compensation voltage in accordance with the second polarity control signal FGDPOL to generate a positive/negative analog data voltage and supply the data voltage to the data lines D1 to Dm.

The gate driving circuit 444 includes a plurality of gate drive ICs of which each includes a shift register, a level shifter for converting the swing width of the output signal of the shift register into a swing width that is suitable for driving the TFT of the liquid crystal cell, and an output buffer connected between the level shifter and the gate line G1 to Gn. The gate driving circuit 444 sequentially supplies a pair of scanning pulses to the gate lines or quickens an output timing of the scanning pulse in response to the gate timing control signals, which are modulated at the Nth-multiple frame periods. The pair of scanning pulses includes the first and second scanning pulses, which are continuously generated. At least a portion of the first scanning pulse of the first and second scanning pulses is overlapped with the second scanning pulse with which the previous gate line is supplied.

Figure 45:
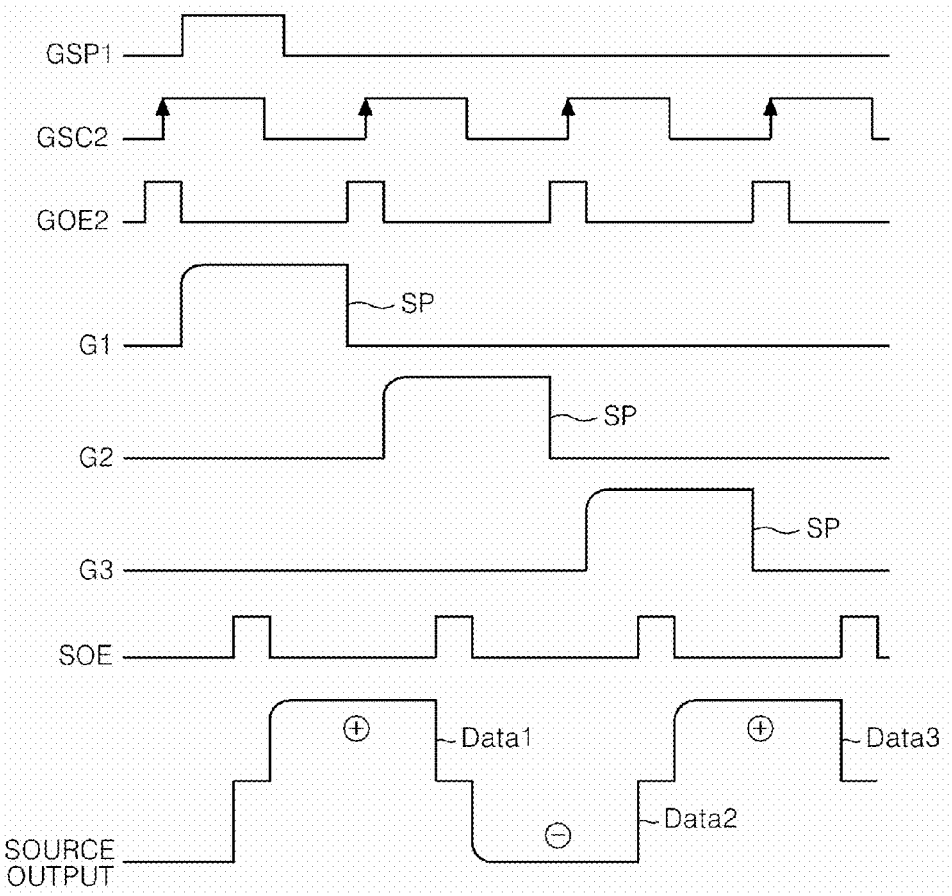
FIG. 45 is a waveform diagram illustrating an exemplary method of modulating gate timing control signals according to the twelfth embodiment of the present invention.

FIG. 45 illustrates an exemplary method of modulating gate timing control signals according to the twelfth embodiment of the present invention. As shown in FIG. 25, "Source Output" refers to a waveform of the data voltage output from the data driving circuit 443. In the twelfth embodiment, a polarity of the data voltage is inverted at each horizontal period due to a polarity control signal FGDPOL. "GSC2" refers to a gate shift clock that is modulated by the second logic circuit 447 at the Nth-multiple frame period, and "GOE2" refers to a gate output enable signal that is modulated by the second logic circuit 447 at the Nth-multiple frame period.

As shown in FIG. 44, the second logic circuit 447 modulates phases of the gate shift clock signal GSC1 and the gate output enable signal GOE1 at every Nth-multiple frame period. Accordingly, phases of the scanning pulse SP and the data voltage Vdata are changed at the Nth-multiple frame period. The liquid crystal cell is pre-charged with a data voltage from the previous line at each horizontal period during the Nth-multiple frame period, and then is charged with a data voltage to be displayed having a polarity that is opposite to the data voltage of the previous line. As a result, the charge amount of the liquid crystal cell is reduced at every Nth-multiple frame period.

Figure 46:
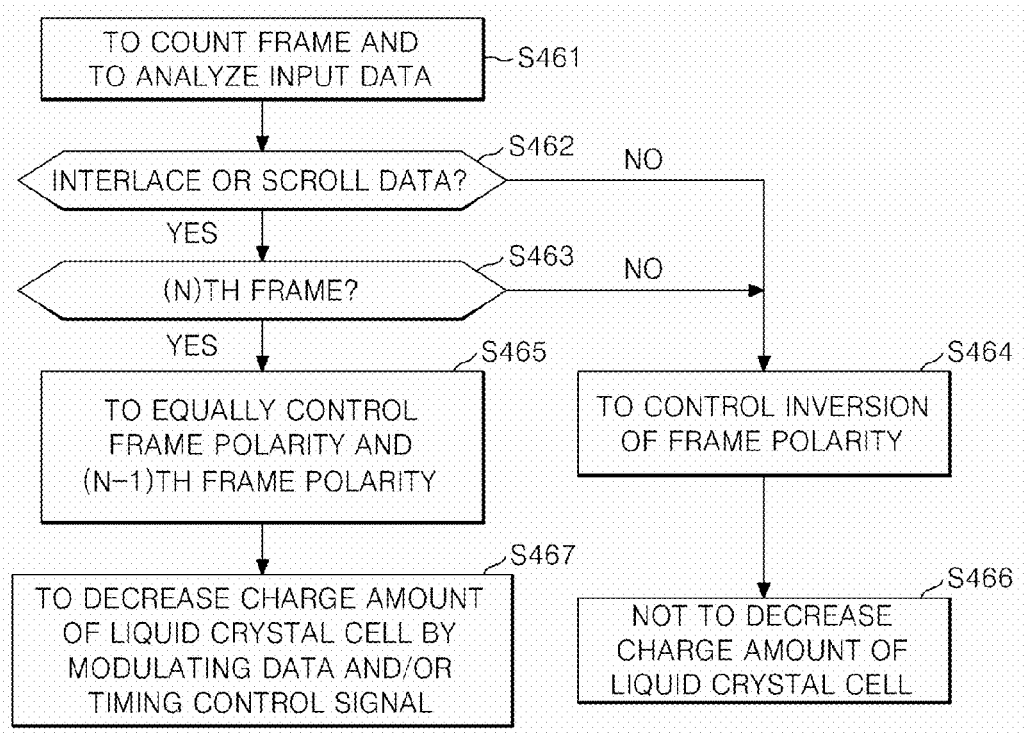
FIG. 46 is a flow chart illustrating an exemplary method of driving a liquid crystal display according to a thirteenth embodiment of the present invention.

FIG. 46 is a flow diagram illustrating an exemplary method of driving the liquid crystal display according to a thirteenth embodiment of the present invention. As shown in FIG. 46, the exemplary method of driving the liquid crystal display according to the thirteenth embodiment of the present invention analyzes input data to determine whether the input data is data that is likely to generate DC image sticking, such as interlace data or scroll data, and counts frame periods. (S461 and S472) Next, the present invention repeatedly compares two line data using a line memory and a comparator. If the adjacent two line data is more than a predetermined threshold, the present invention deems the adjacent two line data as interlace data. The present invention also compares previous frame images with the current frame images using a frame memory and the comparator to detect a portion that moves at a constant speed in the current frame, thereby determining scroll data.

If the currently input data is data that do not generate DC image sticking and a current frame period is not an Nth-multiple frame period, the present invention controls a polarity of the data voltage with a first polarity control signal POL and does not modulate the data and/or the timing control signals. (S463, S464, and S466) Accordingly, if the currently input data is data that do not generate DC image sticking and the current frame period is not an Nth-multiple frame period, the liquid crystal cell is not charged with a voltage having an opposite polarity. As a result, an amount of data voltage charged in the liquid crystal cell is not decreased.

On the other hand, if the currently input data is data that is likely to generate DC image sticking and the current frame period is an Nth-multiple frame period, the thirteenth embodiment of the present invention controls a polarity of the data voltage with a second polarity control signal FGDPOL and modulates the data and/or the timing control signals at the Nth-multiple frame period in the manner described in the above-mentioned embodiments. (S463, S465, and S467) Accordingly, if the currently input data is data that is likely to generate DC image sticking and the current frame period is the Nth-multiple frame period, an amount of data voltage charged in the liquid crystal cell is decreased compared to other frame periods.

Figure 47:
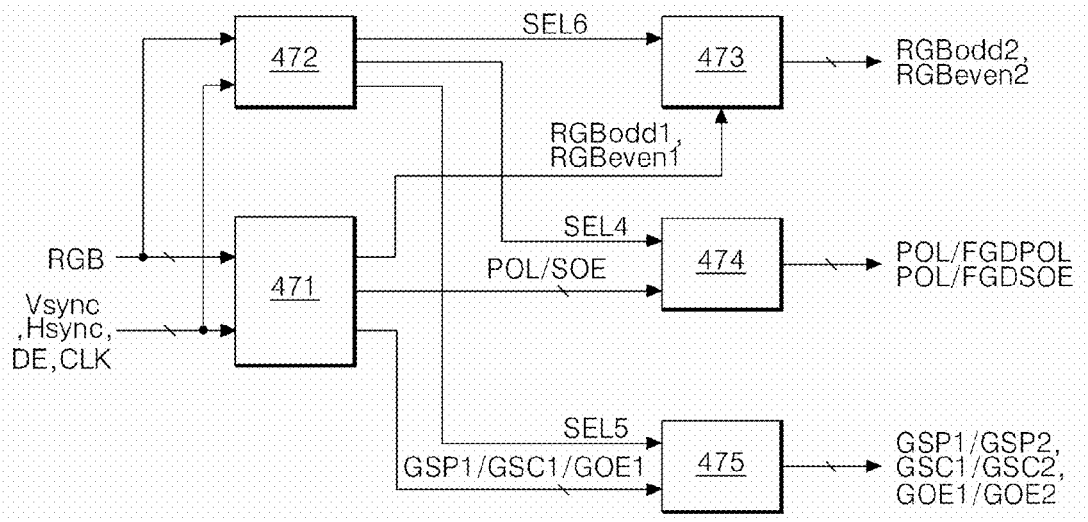
FIG. 47 is a block diagram illustrating an exemplary liquid crystal display according to the thirteenth embodiment of the present invention.

FIG. 47 illustrates an exemplary liquid crystal display according to the thirteenth embodiment of the present invention. In the thirteenth embodiment, a video signal source, a liquid crystal display panel, a data driving circuit, and a gate driving circuit are substantially the same as the foregoing embodiments. Thus, a detailed description thereof is omitted. As shown in FIG. 28, the liquid crystal display according to the thirteenth embodiment of the present invention includes a timing controller 471, an image analyzer 472, a data modulator 473, a first timing control signal modulator 474, and a second timing control signal modulator 475.

The timing controller 471 receives timing signals such as vertical/horizontal synchronization signals Vsync and Hsync, data enable signals, clock signals CLK and other signals to generate timing control signals that control the operation timing of a data driving circuit, a gate driving circuit, the data modulator 473, and the first and second timing control signal modulator 284 and 285. The timing control signals include the gate timing control signal such as the gate start pulse GSP1, the gate shift clock signal GSC1, and the gate output enable signal GOE1, etc. Furthermore, the timing control signals include the data timing control signal such as the source start pulse SSP, the source sampling clock SSC, the source output enable signal SOE1, and the polarity control signal POL1, etc.

The image analyzer 472 determines whether the digital video data of the currently input image is data that is likely to generate DC image sticking. The image analyzer 472 compares the data between adjacent lines in one frame image and deems the currently input data to be interlace data if the data between the lines is not less than a predetermined threshold. In addition, the image analyzer 472 compares the data of each pixel by the unit of a frame and detects a moving picture in a display image and the speed of the moving picture. If the moving picture moves at a pre-set speed, the frame data with the moving picture is deemed to be scroll data.

From the result of the image analysis, if data that is likely to generate DC image sticking, such as interlace data or scroll data, are input, the image analyzer 472 generates selection signals SEL4, SEL5, and SEL6 that activate the data modulator 473, the first timing control signal modulator 474, and the second timing control signal modulator 475.

The data modulator 473 receives the data that is likely to generate DC image sticking and modulates the data RGBodd1 and RGBeven1 downward from the timing controller 471 when the current frame period is the Nth-multiple frame period in response to the sixth selection signal SEL6.

The first timing control signal modulator 474 receives the data that is likely to generate DC image sticking and modulates the data timing control signal, which is input from the timing controller 471, when the current frame period is the Nth-multiple frame period in response to the fourth selection signal SEL4. The modulated source output enable signal SOE2 is input to the data driving circuit to decrease the amount of data voltage charged in the liquid crystal cell at the Nth-multiple frame period. The modulated polarity control signal FGDPOL is input to the data driving circuit to control a polarity of the data voltage such that the polarity pattern in the Nth-multiple frame period is the same as in the previous frame period. The modulated polarity control signal FGDPOL also inverts a frame polarity pattern at each frame period to control a polarity of the data voltage in all other frame periods.

The second timing control signal modulator 475 receives the data that is likely to generate DC image sticking and modulates the gate timing control signal, which is input from the timing controller 471, when the current frame period is the Nth-multiple frame period in response to the fifth selection signal SEL5. The modulated gate start pulse GSP2, the modulated gate shift clock GSC2, and the modulated gate output enable signal GOE2 are input to the gate driving circuit to decrease the amount of data voltage charged in the liquid crystal cell at the Nth-multiple frame period.

It will be apparent to those skilled in the art that various modifications and variations can be made in the liquid crystal display and the driving methods of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel including a plurality of data lines, a plurality of gate lines, and a plurality of liquid crystal cells;

a data drive circuit to invert a polarity of the data voltage in response to a polarity control signal and supplies the data voltage to the data lines in response to a source output enable signal;

a gate drive circuit to supply a scan pulse to the gate lines;

an image analyzing circuit to detect any one of interlace data and scroll data in an input image;

a first controller to increase a data charge amount of the liquid crystal cell during an aging period, the aging period beginning from the time when power to drive the drive circuits is generated to a predetermined time thereafter, and to decrease the data charge amount of the liquid crystal cell at every Nth-multiple frame period (wherein N is a positive integer) using the source output enable signal when any one of the interlace data and the scroll data is detected by the image analyzing circuit during a normal drive period after the aging period; and a second controller to control the polarity of the data supplied to the liquid crystal cell at every Nth-multiple frame period to be the same as the previous frame period when any one of the interlace data and the scroll data is detected by the image analyzing circuit during the normal drive period, and to invert the polarity of the data supplied to the liquid crystal cell at all other frame periods using the polarity control signal.

2. The liquid crystal display device according to claim 1, wherein a pulse of the source output enable signal and a gate pulse are overlapped during the Nth-multiple frame period.

3. The liquid crystal display device according to claim 1, wherein during the Nth-multiple frame period, the liquid crystal cell is sequentially charged with the data voltages for about each horizontal period including a first period when the liquid crystal cell is charged with a data voltage of the previous line, a second period when the liquid crystal cell is charged with any one of a common voltage and a charge share voltage between the positive data voltage and the negative data voltage, and a third period when the liquid crystal cell is charged with a data voltage having an opposite polarity than the data voltage of the previous line.

4. The liquid crystal display device according to claim 3, wherein when the each horizontal period is defined as 100%, the first period is about 30% to about 40%, the second period is about 0% to about 20%, and the third period is about 40 to about 60%.

5. The liquid crystal display device according to claim 1, further comprising a third controller to generate gate timing control signals, the gate drive circuit supplying the scan pulse to the gate lines based on the gate timing control signals.

6. The liquid crystal display device according to claim 5, wherein the gate timing control signals including a first gate shift clock signal and a first gate output enable signal at every frame period except for Nth-multiple frame periods, and a second gate shift clock signal having a faster phase compared to the first gate shift clock signal and a second gate output enable signal having a faster phase compared to the first gate output enable signal at every Nth-multiple frame period.

7. The liquid crystal display device according to claim 6, wherein the third controller includes a frame counter to output N frame information by counting the gate start pulse to indicate the Nth-multiple frame period, a first phase adjuster to rapidly adjust a phase of the first gate shift clock signal to generate the second gate shift clock signal, a second phase adjuster to rapidly adjust a phase of the first gate shift clock signal to generate the second gate shift clock signal;

a first multiplexer to supply the first gate shift clock signal to the gate driving circuit for (N−1) frame periods prior to the Nth-multiple frame period and to supply the second gate shift clock signal to the gate driving circuit for the Nth-multiple frame period in response to the N frame information, and a second multiplexer to supply the first gate output enable signal to the gate driving circuit for (N−1) frame periods prior to the Nth-multiple frame period and to supply the second gate output enable signal to the gate driving circuit for the Nth-multiple frame period in response to the N frame information.

8. The liquid crystal display device according to claim 5, wherein the gate timing control signal includes a gate start pulse to be input to a shift register in the gate driving circuit to indicate a starting point of a first scanning pulse, a gate shift clock signal to be input to the shift register in the gate driving circuit to sequentially shift the gate start pulse, and a gate output enable signal to indicate an output of the gate driving circuit.

9. The liquid crystal display device according to claim 5, wherein the third controller generates a pre-gate shift clock, which is overlapped with the gate start pulse, and a first gate shift clock such that the pre-gate shift clock and the first gate shift clock are overlapped by the gate start pulse for Nth-multiple frame periods, and further generates a pre-gate output enable signal, which is overlapped with a rising edge of the pre-gate shift clock, and a first gate output enable signal, which is overlapped with a falling edge of the pre-gate shift clock, for Nth-multiple frame periods.

10. The liquid crystal display device according to claim 9, wherein the data driving circuit outputs the data voltage after the first gate output enable signal.

11. The liquid crystal display device according to claim 10, wherein the gate driving circuit sequentially supplies a pair of scanning pulses including a first scanning pulse and a second scanning pulse to the gate lines in response to a modulated gate shift clock having the gate start pulse, the pre-gate shift clock, and the first gate shift clock, and a modulated gate output enable signal having the pre-gate output enable signal and the first gate output enable signal for Nth-multiple frame periods, and wherein the second scanning pulse supplied to a (i−1)th gate line (where i is a positive integer) is overlapped with the first scanning pulse supplied to a (i)th gate line.

12. The liquid crystal display device according to claim 11, wherein the data driving circuit differentiates a polarity of the data voltage output to be synchronized with the first scanning pulse and a polarity of the data voltage output to be synchronized with the second scanning pulse in response to the polarity control signal.

* * * * *